US011284671B2

(12) United States Patent
Hurd et al.

(10) Patent No.: US 11,284,671 B2
(45) Date of Patent: Mar. 29, 2022

(54) ARTICLE OF FOOTWEAR INCORPORATING PARTICULATE MATTER

(71) Applicant: NIKE, Inc., Beaverton, OR (US)

(72) Inventors: John Hurd, Lake Oswego, OR (US); Cassidy R. Levy, West Linn, OR (US); Tetsuya T. Minami, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 132 days.

(21) Appl. No.: 16/497,053

(22) PCT Filed: Mar. 22, 2018

(86) PCT No.: PCT/US2018/023786

§ 371 (c)(1),
(2) Date: Sep. 24, 2019

(87) PCT Pub. No.: WO2018/175734

PCT Pub. Date: Sep. 27, 2018

(65) Prior Publication Data

US 2020/0375307 A1 Dec. 3, 2020

Related U.S. Application Data

(60) Provisional application No. 62/476,300, filed on Mar. 24, 2017.

(51) Int. Cl.
*A43B 13/18* (2006.01)
*A43B 1/00* (2006.01)

(52) U.S. Cl.
CPC ..... *A43B 13/188* (2013.01); *A43B 1/0072* (2013.01); *A43B 13/18* (2013.01); *A43B 13/181* (2013.01)

(58) Field of Classification Search
CPC ..... A43B 13/186; A43B 13/188; A43B 13/42; A43B 7/184; A43B 1/0072; A43B 7/148;
(Continued)

(56) References Cited

U.S. PATENT DOCUMENTS 2,930,149 A 3/1960 Hack
3,971,839 A 7/1976 Taylor
(Continued)

FOREIGN PATENT DOCUMENTS

DE 202012008989 U1 12/2012
EP 2807939 A1 12/2014
(Continued)

OTHER PUBLICATIONS

WO1997046125_Google_Machine_Translation_SHOE_METHOD_OF_MANUFACTURING_IT_AND_ITS_USE.pdf (Year: 1997).*
(Continued)

*Primary Examiner* — Marie D Bays
(74) *Attorney, Agent, or Firm* — Honigman LLP; Matthew H. Szalach; Jonathan O' Brien

(57) ABSTRACT

A sole structure for an article of footwear is provided and includes a midsole having a first surface, a second surface formed on an opposite side of the midsole than the first surface, a first cavity formed in the first surface and tapering in a direction from the first surface toward the second surface, and a second cavity formed in the second surface and tapering in a direction from the second surface toward the first surface. A first quantity of particulate matter is disposed within the first cavity and a second quantity of particulate matter is disposed within the second cavity.

18 Claims, 44 Drawing Sheets

(58) Field of Classification Search
CPC ... A43B 13/127; A43B 13/125; A43B 7/1485; A43B 13/14; A43B 13/18; A43B 13/12
USPC ..... 36/28
See application file for complete search history.

(56) References Cited

U.S. PATENT DOCUMENTS

| | | | | |
|---|---|---|---|---|
| 4,658,515 | A * | 4/1987 | Oatman | A43B 17/14 36/2.6 |
| 4,779,359 | A * | 10/1988 | Famolare, Jr. | A43B 13/20 36/28 |
| 7,037,571 | B2 * | 5/2006 | Fish | A43B 13/02 36/37 |
| 2005/0160626 | A1 * | 7/2005 | Townsend | A43B 7/1445 36/30 R |
| 2006/0010717 | A1 * | 1/2006 | Finkelstein | A43B 13/188 36/25 R |
| 2011/0099845 | A1 * | 5/2011 | Miller | A43B 7/1465 36/91 |
| 2011/0171420 | A1 * | 7/2011 | Yang | F16F 9/0418 428/116 |

FOREIGN PATENT DOCUMENTS

| | | | | |
|---|---|---|---|---|
| FR | 2774566 | A1 | 8/1999 | |
| WO | WO-9746125 | A2 * | 12/1997 | A43B 13/18 |

OTHER PUBLICATIONS

European Patent Office (ISA), International Preliminary Report on Patentability for PCT Application No. PCT/US2018/023786, dated Oct. 3, 2019.

European Patent Office (ISA), International Search Report and Written Opinion for PCT Application No. PCT/US2018/023786, dated Jun. 7, 2018.

* cited by examiner

ARTICLE OF FOOTWEAR INCORPORATING PARTICULATE MATTER

CROSS REFERENCE TO RELATED APPLICATIONS

This application is a 371 National Stage entry based on International Application No. PCT/US2018/023786, filed Mar. 22, 2018, which claims priority to U.S. Provisional Application No. 62/476,300, filed Mar. 24, 2017. The disclosures of these prior applications are considered part of the disclosure of this application and are hereby incorporated by reference in their entirety.

FIELD

The present disclosure relates to cushioning members incorporating particulate matter and more particularly to cushioning members incorporating particulate matter for use with articles of footwear.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole or a sockliner located within a void proximate to the bottom portion of the upper.

Midsoles using polymer foam materials are generally configured as a single slab that compresses resiliently under applied loads, such as during walking or running movements. Generally, single-slab polymer foams are designed with an emphasis on balancing cushioning characteristics that relate to softness and responsiveness as the slab compresses under gradient loads. Polymer foams providing cushioning that is too soft will decrease the compressibility and the ability of the midsole to attenuate ground-reaction forces after repeated compressions. Conversely, polymer foams that are too hard and, thus, very responsive, sacrifice softness, thereby resulting in a loss in comfort. While different regions of a slab of polymer foam may vary in density, hardness, energy return, and material selection to balance the softness and responsiveness of the slab as a whole, creating a single slab of polymer foam that loads in a gradient manner from soft to responsive is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
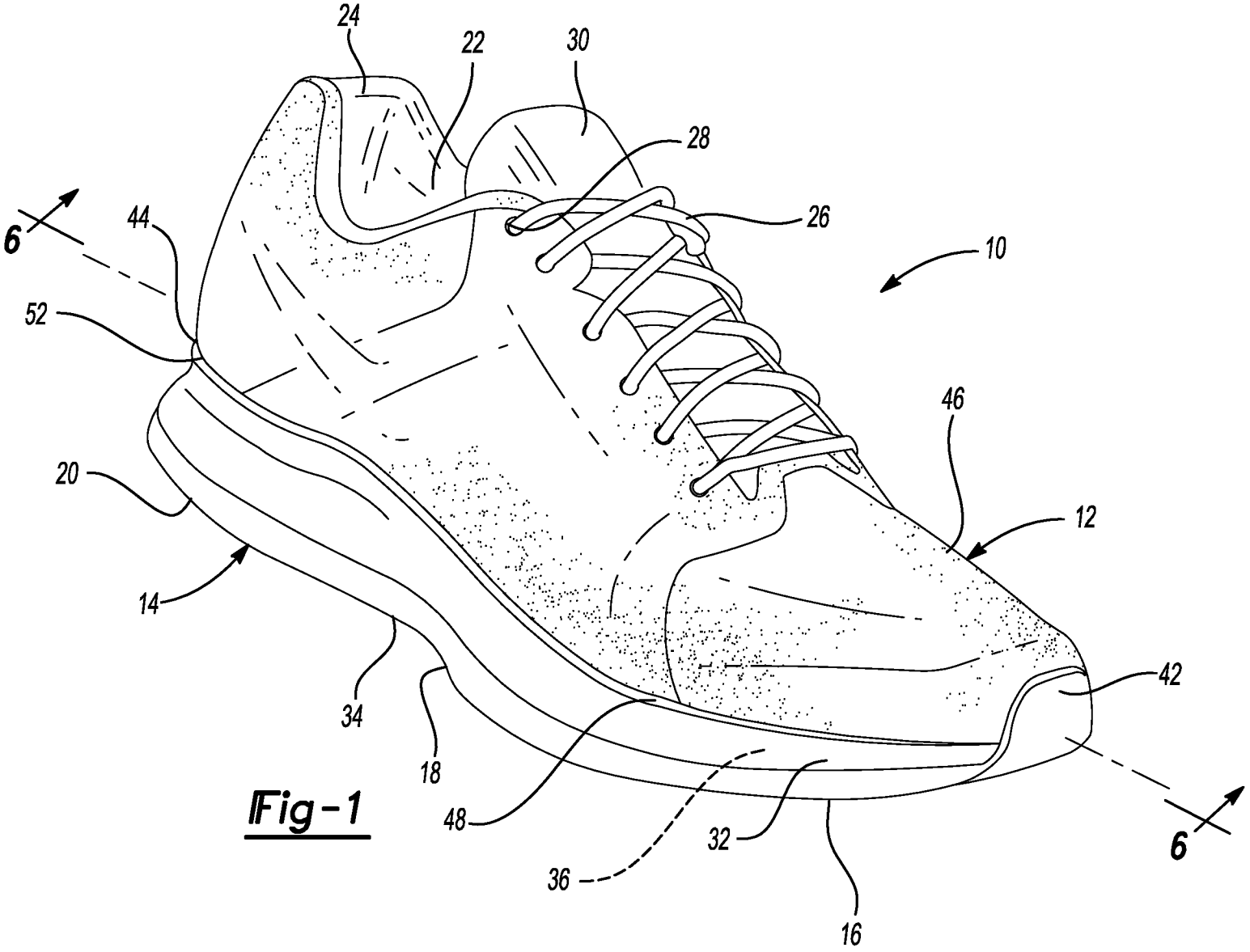
FIG. 1 is a perspective view of an article of footwear in accordance with the principals of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear. The sole structure includes a midsole having a first surface, a second surface formed on an opposite side of the midsole than the first surface, a first cavity formed in the first surface and tapering in a direction from the first surface toward the second surface, and a second cavity formed in the second surface and tapering in a direction from the second surface toward the first surface. A first quantity of particulate matter is disposed within the first cavity and a second quantity of particulate matter is disposed within the second cavity.

Implementations of the disclosure may include one or more of the following optional features. In some implementations, the first cavity and the second cavity are substantially the same shape. The first cavity and the second cavity may be spaced apart from one another in a direction extending substantially parallel to a longitudinal axis of the midsole. The first cavity and the second cavity may also overlap one another in a direction extending substantially parallel to a longitudinal axis of the midsole. The first cavity and the second cavity may include one of a spherical shape, an oval shape, and a trapezoidal shape.

In some examples, the first cavity may include a first passageway in fluid communication with the first cavity and extending from the first cavity to the second surface and the second cavity may include a second passageway in fluid communication with the second cavity and extending from the second cavity to the first surface.

The first passageway may include a different shape than the first cavity and the second passageway may include a different shape than the second cavity.

In some examples, the first quantity of particulate matter is received by a first barrier member and the second quantity of particulate matter is received by a second barrier member, the first barrier member being disposed between the first quantity of particulate matter and the first cavity and the second barrier member being disposed between the second quantity of particulate matter and the second cavity.

The first barrier member and the second barrier member may be formed from a polymer. In some examples, the first barrier member and the second barrier member are formed from thermoplastic polyurethane (TPU).

The first barrier member may include a first barrier portion received within the first cavity and the second barrier member may include a first barrier portion received within the second cavity. The first barrier member may also include a second barrier portion attached to the first barrier portion to define a first inner void that receives the first quantity of particulate matter and the second barrier member may include a second barrier portion attached to the first barrier portion of the second barrier member to define a second inner void that receives the second quantity of particulate matter.

In some examples, the second barrier portion of the first barrier member and the second barrier portion of the second barrier member are be formed from the same material as the first barrier portion of the first barrier member and the first barrier portion of the second barrier member. Alternatively, the second barrier portion of the first barrier member and the second barrier portion of the second barrier member may be formed from a different material than the first barrier portion of the first barrier member and the first barrier portion of the second barrier member.

In some implementations, the first quantity of particulate matter and the second quantity of particulate matter are approximately the same. Alternatively, the first quantity of particulate matter and the second quantity of particulate matter may be different.

In some examples, the first quantity of particulate matter and the second quantity of particulate matter include foam beads having a substantially spherical shape. The first quantity of particulate matter and the second quantity of particulate matter may also include foam beads having approximately the same size and shape. Alternatively, the foam beads may include at least one of a different size and shape.

Another aspect of the disclosure provides a sole structure for an article of footwear. The sole structure includes a midsole having a first surface, a second surface formed on an opposite side of the midsole than the first surface, a first cavity formed in the first surface and including a first shape, and a second cavity formed in the second surface and including the first shape, the second cavity being inverted relative to the first cavity. A first quantity of particulate matter is disposed within the first cavity and a second quantity of particulate matter is disposed within the second cavity.

Implementations of the disclosure may include one or more of the following optional features. In some implementations, the first cavity tapers in a direction from the first surface toward the second surface and the second cavity tapers in a direction from the second surface toward the first surface.

The first cavity and the second cavity may be spaced apart from one another in a direction extending substantially parallel to a longitudinal axis of the midsole. The first cavity and the second cavity may also overlap one another in a direction extending substantially parallel to a longitudinal axis of the midsole. The first cavity and the second cavity may include one of a spherical shape, an oval shape, and a trapezoidal shape.

In some examples, the first cavity includes a first passageway in fluid communication with the first cavity and extending from the first cavity to the second surface. The second cavity may also include a second passageway in fluid communication with the second cavity and extending from the second cavity to the first surface.

The first passageway may include a different shape than the first cavity and the second passageway may include a different shape than the second cavity.

The first quantity of particulate matter may be received by a first barrier member and the second quantity of particulate matter may be received by a second barrier member, the first barrier member being disposed between the first quantity of particulate matter and the first cavity and the second barrier member being disposed between the second quantity of particulate matter and the second cavity.

The first barrier member and the second barrier member may be formed from a polymer. In some examples, the first barrier member and the second barrier member are formed from thermoplastic polyurethane (TPU).

The first barrier member may include a first barrier portion received within the first cavity and the second barrier member may include a first barrier portion received within the second cavity. The first barrier member may also include a second barrier portion attached to the first barrier portion to define a first inner void that receives the first quantity of particulate matter and the second barrier member may include a second barrier portion attached to the first barrier portion of the second barrier member to define a second inner void that receives the second quantity of particulate matter.

In some implementations, the second barrier portion of the first barrier member and the second barrier portion of the second barrier member are formed from the same material as the first barrier portion of the first barrier member and the first barrier portion of the second barrier member. Alternatively, the second barrier portion of the first barrier member and the second barrier portion of the second barrier member are formed from a different material than the first barrier portion of the first barrier member and the first barrier portion of the second barrier member.

In some examples, the first quantity of particulate matter and the second quantity of particulate matter are approximately the same. Alternatively, the first quantity of particulate matter and the second quantity of particulate matter may be different.

The first quantity of particulate matter and the second quantity of particulate matter may include foam beads having a substantially spherical shape. The first quantity of particulate matter and the second quantity of particulate matter may also include foam beads having approximately the same size and shape. Alternatively, the foam beads may include at least one of a different size and shape.

Another aspect of the disclosure provides a sole structure for an article of footwear. The sole structure includes a midsole having a first surface, a second surface formed on an opposite side of the midsole than the first surface, a plurality of first cavities formed in the first surface, and a plurality of second cavities formed in the second surface, the plurality of second cavities alternating with the plurality of first cavities along a length of the midsole. A first quantity of particulate matter is disposed within the first cavity and a second quantity of particulate matter is disposed within the second cavity.

The plurality of first cavities may include a first shape and the plurality of second cavities may include the first shape. The plurality of second cavities may be inverted relative to the plurality of first cavities.

The plurality of first cavities may taper in a direction from the first surface toward the second surface and the plurality of second cavities may taper in a direction from the second surface toward the first surface.

In some examples, the plurality of first cavities and the plurality of second cavities are spaced apart from one another in a direction extending substantially parallel to a longitudinal axis of the midsole. Alternatively, the plurality of first cavities and the plurality of second cavities may overlap one another in a direction extending substantially parallel to a longitudinal axis of the midsole. The plurality of first cavities and the plurality of second cavities may include one of a spherical shape, an oval shape, and a trapezoidal shape.

The sole structure may include first passageways in fluid communication with respective ones of the plurality of first cavities and extending from the respective first cavity to the second surface. The sole structure may also include second passageways in fluid communication with respective ones of the plurality of second cavities and extending from the respective second cavity to the first surface. The first passageway includes a different shape than the plurality of first cavities and the second passageway includes a different shape than the plurality of second cavities.

The first quantity of particulate matter is received by first barrier members and the second quantity of particulate matter is received by second barrier members, the first barrier members being disposed between the first quantity of particulate matter and respective ones of the plurality of first cavities and the second barrier members being disposed between the second quantity of particulate matter and respective ones of the plurality of second cavities.

The first barrier members and the second barrier members may be formed from a polymer. In some examples, the first barrier members and the second barrier members may be formed from thermoplastic polyurethane (TPU).

The first barrier members may include a first barrier portion received within respective ones of the plurality of first cavities and the second barrier members may include a first barrier portion received within respective ones of the plurality of second cavities. The first barrier members may also include a second barrier portion attached to the first barrier portion to define a first inner void that receives the first quantity of particulate matter and the second barrier members may include a second barrier portion attached to the first barrier portion of the second barrier members to define a second inner void that receives the second quantity of particulate matter.

The second barrier portion of the first barrier members and the second barrier portion of the second barrier members may be formed from the same material as the first barrier portion of the first barrier members and the first barrier portion of the second barrier members. Alternatively, the second barrier portion of the first barrier members and the second barrier portion of the second barrier members may be formed from a different material than the first barrier portion of the first barrier members and the first barrier portion of the second barrier members.

In some examples, the first quantity of particulate matter and the second quantity of particulate matter may be approximately the same. Alternatively, the first quantity of particulate matter and the second quantity of particulate matter may be different.

At least one of the first quantity of particulate matter and the second quantity of particulate matter may include foam beads having a substantially spherical shape. The foam beads may also include approximately the same size and shape. Alternatively, the foam beads may include at least one of a different size and shape.

Figure 2:
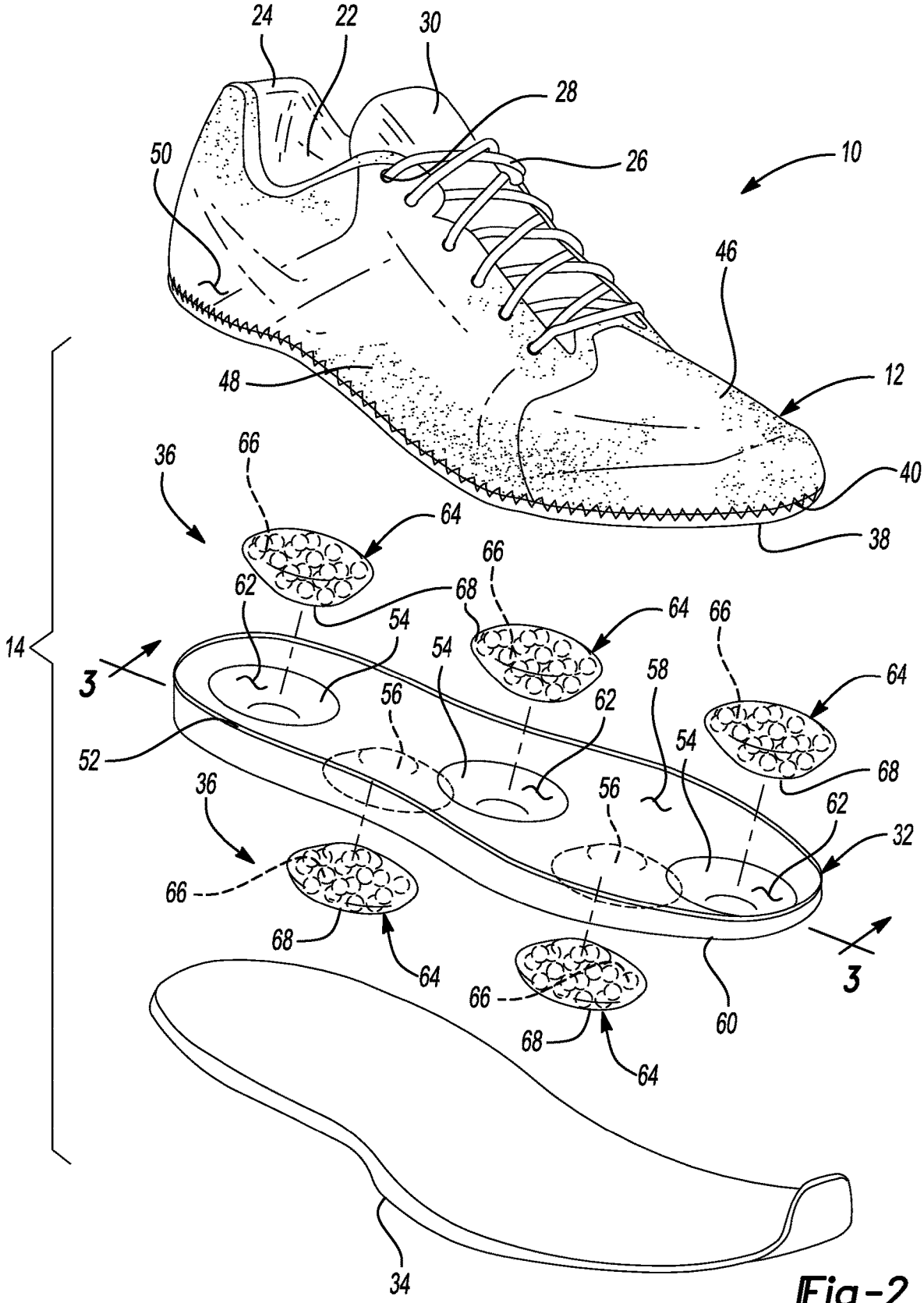
FIG. 2 is an exploded view of the article of footwear of FIG. 2.

With reference to FIGS. 1 and 2, an article of footwear 10 is provided. As shown in FIG. 1, the article of footwear 10 includes an upper 12 and a sole structure 14 attached to the upper 12. The article of footwear 10 may be divided into one or more portions. The portions may include a forefoot portion 16, a midfoot portion 18, and a heel portion 20. The forefoot portion 16 may correspond with toes and joints connecting metatarsal bones with phalanx bones of a foot. The midfoot portion 18 may correspond with an arch area of the foot, and the heel portion 20 may correspond with rear portions of the foot, including a calcaneus bone.

The upper 12 includes interior surfaces that define an interior void 22 that receives and secures a foot for support on the sole structure 14. An ankle opening 24 located in the heel portion 20 may provide access to the interior void 22. For example, the ankle opening 24 may receive a foot to secure the foot within the void 22 and facilitate entry and removal of the foot from and to the interior void 22. In some examples, one or more fasteners 26 extend along the upper 12 to adjust a fit of the interior void 22 around the foot while concurrently accommodating entry and removal of the foot therefrom. The upper 12 may include apertures 28 such as eyelets and/or other engagement features such as fabric or mesh loops that receive the fasteners 26. The fasteners 26 may include laces, straps, cords, hook-and-loop, or any other suitable type of fastener.

The upper 12 may additionally include a tongue portion 30 that extends between the interior void 22 and the fasteners 26. The upper 12 may be formed from one or more materials that are stitched or adhesively bonded together to form the interior void 22. Suitable materials for the upper may include, but are not limited to, textiles, foam, leather, and synthetic leather. The materials may be selected and located to impart properties of durability, air-permeability, wear-resistance, flexibility, and comfort to the foot while disposed within the interior void 22.

Figure 8:
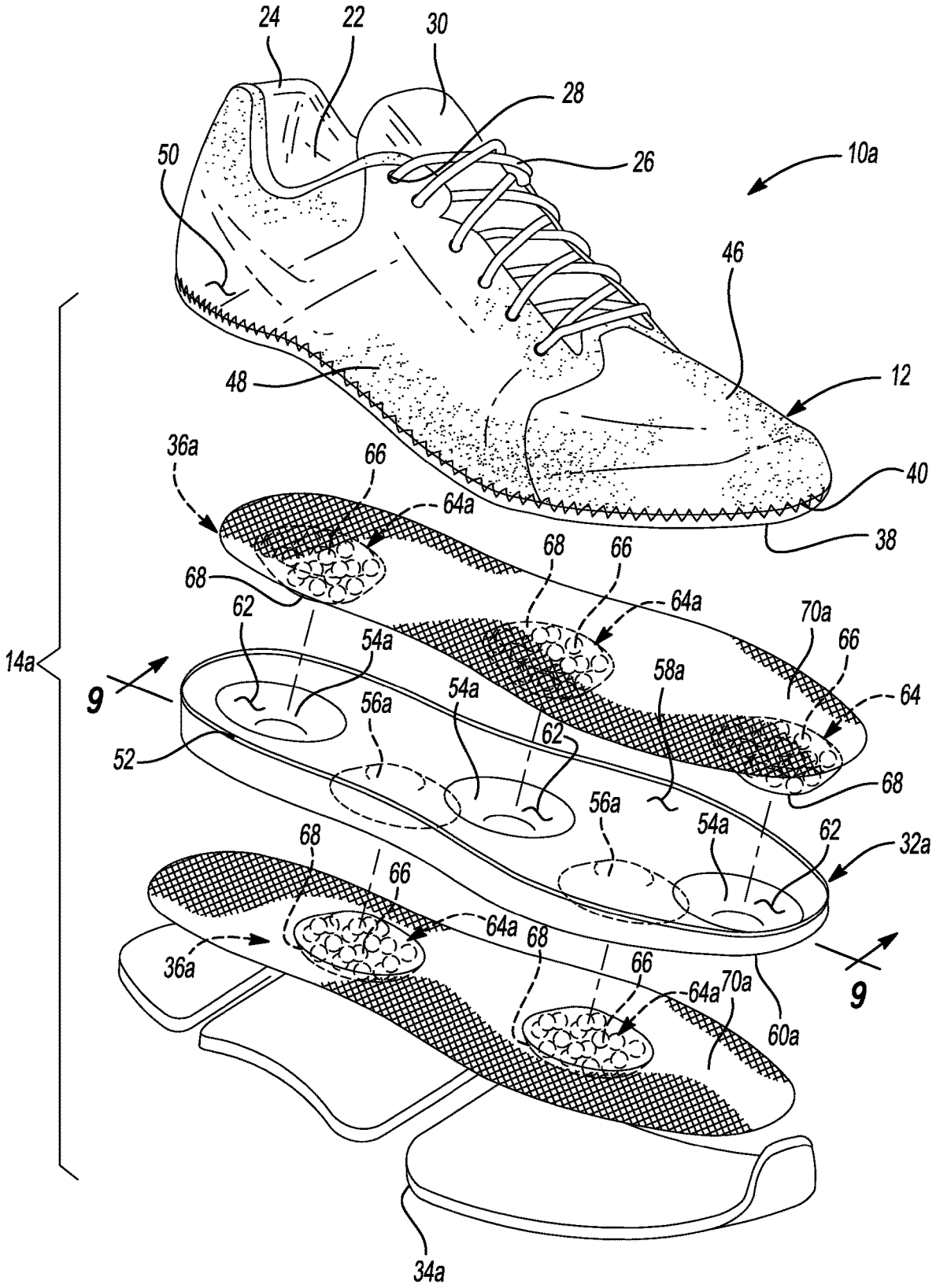
FIG. 8 is an exploded view of the article of footwear of FIG. 1.
Figure 9:
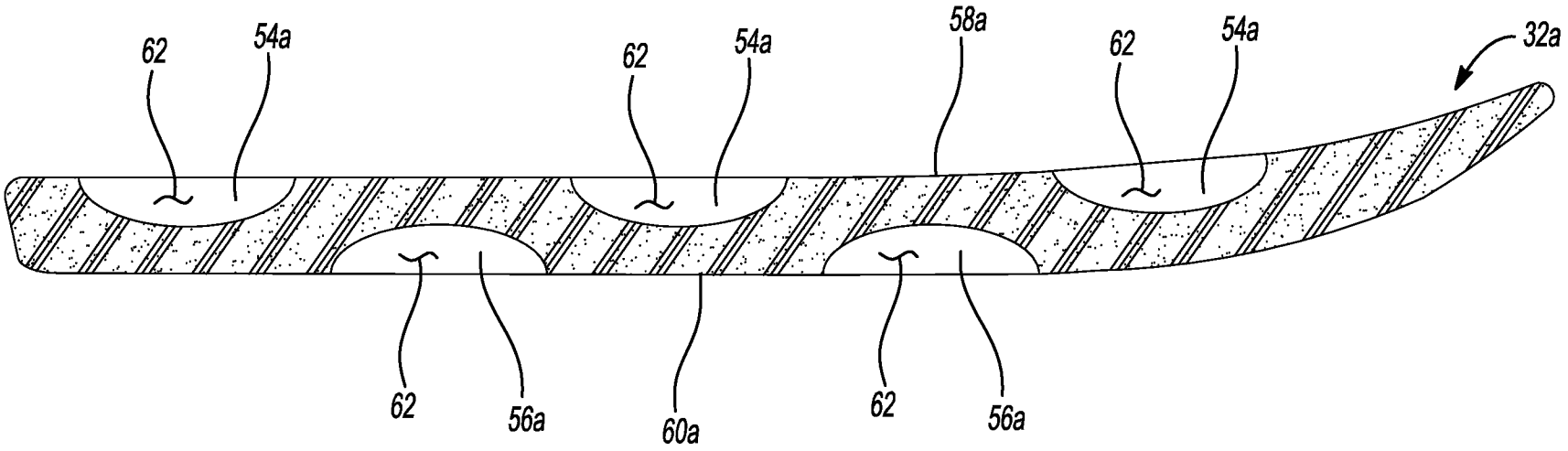
FIG. 9 is a cross-sectional view of a midsole of the article of footwear of FIG. 7 taken along Line 9-9 of FIG. 8.

With continued reference to FIGS. 1 and 2, the sole structure 14 is shown as including a midsole 32, an outsole 34, and a cushioning member 36. As shown in FIGS. 2 and 8, the midsole 32 is generally disposed between the outsole 34 and the upper 12 and supports the cushioning member 36 relative to the upper 12. Namely, the midsole 32 may support the cushioning member 36 between the outsole 34 and a lower substrate 38 of the upper 12. The substrate 38 may be attached to the upper 12 via stitching 40 (FIG. 2) or, alternatively, may be integrally formed with a material of the upper 12. For example, if the upper 12 or a portion of the upper 12 is formed from a knit material, the knit material may likewise form the substrate 38 and, as such, the substrate 38 that opposes the midsole 32 and the cushioning member 36 may be integrally formed with the upper 12.

If the substrate 38 is separately formed from the upper 12, the substrate 38 may be attached to the upper 12 via stitching 40. Regardless of whether the substrate 38 is integrally formed with the upper 12 or, alternatively, is a separate component that is attached to the upper 12, the substrate 38 is disposed generally between the midsole 32 and the upper 12 and is formed from a flexible material. Forming the substrate 38 from a flexible material allows the substrate 38 to stretch and move when loaded by a user's foot during use. Allowing the substrate 38 to flex and move in response to a load received by a user's foot during use allows the user's foot to depress the midsole 32 and/or the cushioning member 36, thereby providing the user with a degree of comfort and cushioning during use of the article of footwear 10, as will be described in greater detail below.

The midsole 32 may be formed from a polymer material such as, for example, a foamed polymer material. Namely, the foamed polymer material may be ethyl-vinyl-acetate or polyurethane. Regardless of the particular construction of the midsole 32, the midsole 32 extends generally from an anterior end 42 of the upper 12 to a posterior end 44 of the upper 12. Further, the midsole 32 may extend between a medial side 46 of the upper 12 and a lateral side 48 of the upper 12. In so doing, a portion of the midsole 32 may extend onto an outer surface 50 of the upper 12 proximate to a junction of the upper 12 and the midsole 32. For example, the midsole 32 may include a projection 52 that extends at least partially around a perimeter of the midsole 32 and extends from the midsole 32 to cover a portion of the outer surface 50 of the upper 12. The projection 52 may be integrally formed with the midsole 32 when the material of the midsole is formed into the shape shown in FIG. 2.

Figure 4:
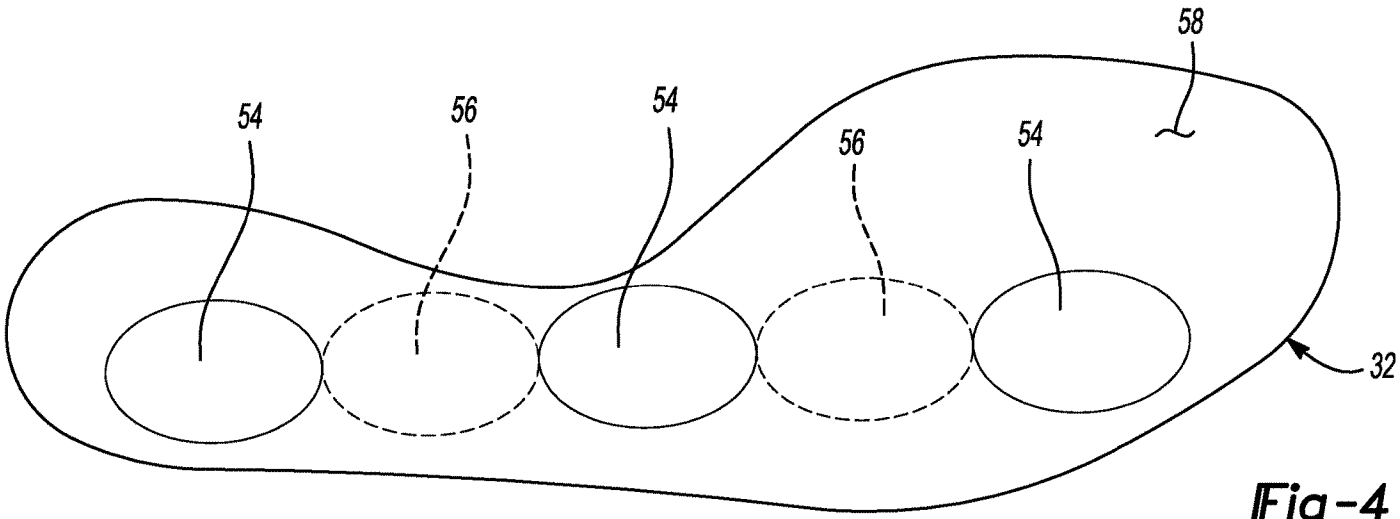
FIG. 4 is a top view of the midsole of FIG. 3.
Figure 5:
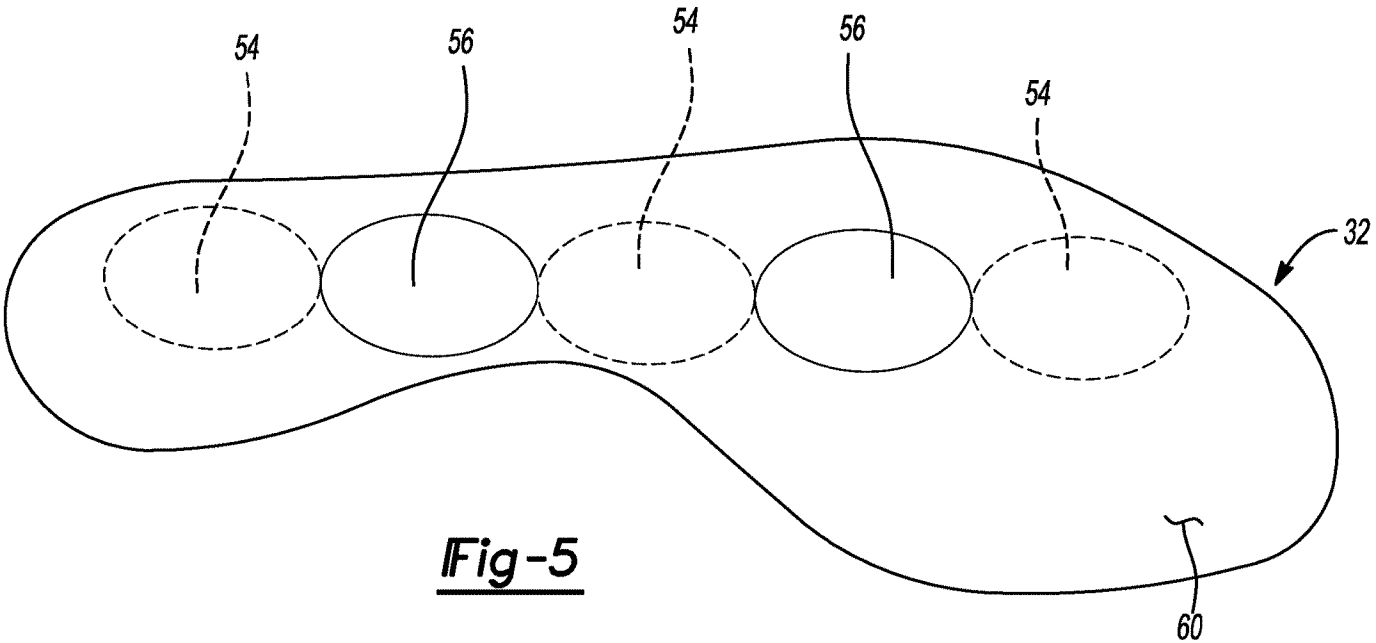
FIG. 5 is a bottom view of the midsole of FIG. 3.
Figure 6:
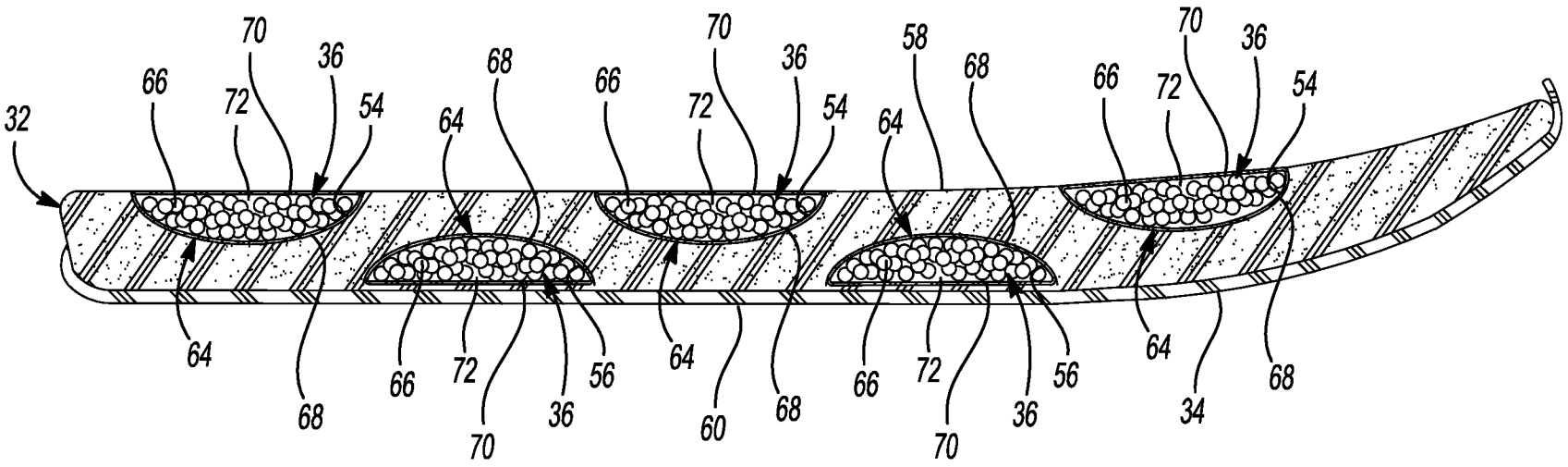
FIG. 6 is a partial cross-sectional view of the article of footwear of FIG. 1 taken along Line 6-6 of FIG. 1.
Figure 7:
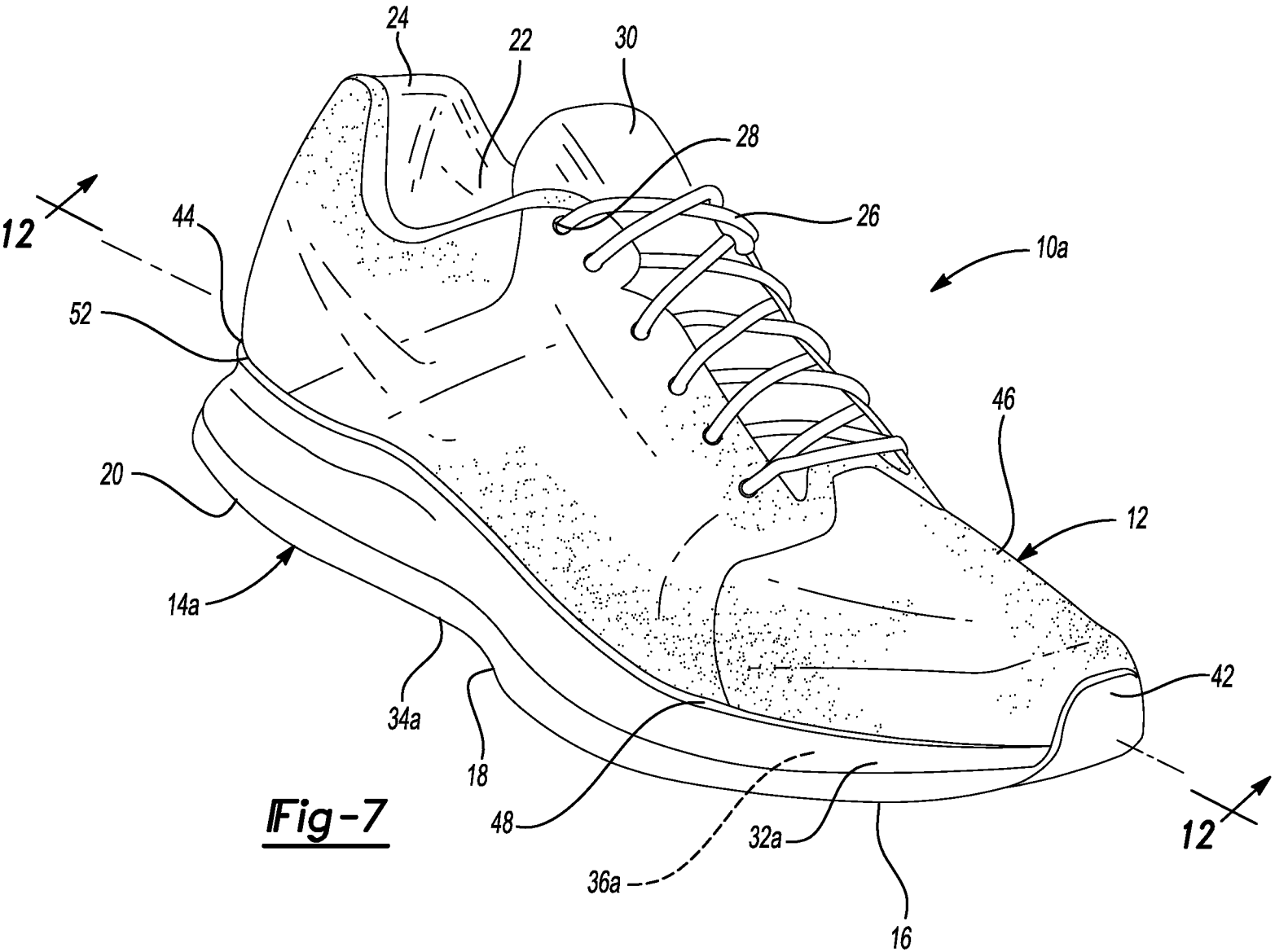
FIG. 7 is a perspective view of an article of footwear in accordance with the principles of the present disclosure.

With particular reference to FIGS. 2-6, the midsole 32 is shown as including a plurality of first cavities 54 and a plurality of second cavities 56 formed on an opposite side of the midsole 32 then the plurality of first cavities 54. The plurality of first cavities 54 are formed in a first surface 58 of the midsole 32 and the plurality of second cavities 56 are formed in a second surface 60 of the midsole 32 located on an opposite side of the midsole 32 then the first surface 58. As shown in FIGS. 2 and 6, the first surface 58 opposes the lower substrate 38 of the upper 12 while the second surface 60 opposes the outsole 34.

In the configuration shown in FIGS. 2 and 6, the plurality of first cavities 54 and the plurality of second cavities 56 include a substantially circular shape. Further, the plurality of first cavities 54 decrease in volume as the cavities 54 extend from the first surface 58 in a direction toward the second surface 60 and the and the plurality of second cavities 56 decrease in volume as the cavities 56 extend in a direction from the second surface 60 toward the first surface 58. Namely, the plurality of first cavities 54 taper in a direction extending from the first surface 58 toward the second surface 60 and the plurality of second cavities 56 taper in a direction extending from the second surface 60 toward the first surface 58.

Providing the plurality of first cavities 54 and the plurality of second cavities 56 with a circular or oval shape provides each cavity 54, 56 with an arcuate surface 62 that defines the shape of each cavity 54, 56. In one configuration, the plurality of first cavities 54 and the plurality of second cavities 56 include the same shape. Further, the plurality of second cavities 56 may be nested with the plurality of first cavities 54 such that the plurality of second cavities 56 are inverted relative to the plurality of first cavities 54. Namely, and with particular reference to FIGS. 4 and 5, the plurality of first cavities 54 and the plurality of second cavities 56 may alternate along a length of the midsole 32 such that the plurality of first cavities 54 alternate with the plurality of second cavities 56 along a length of the sole structure 14 between the anterior end 42 and the posterior and 44.

Figure 3:
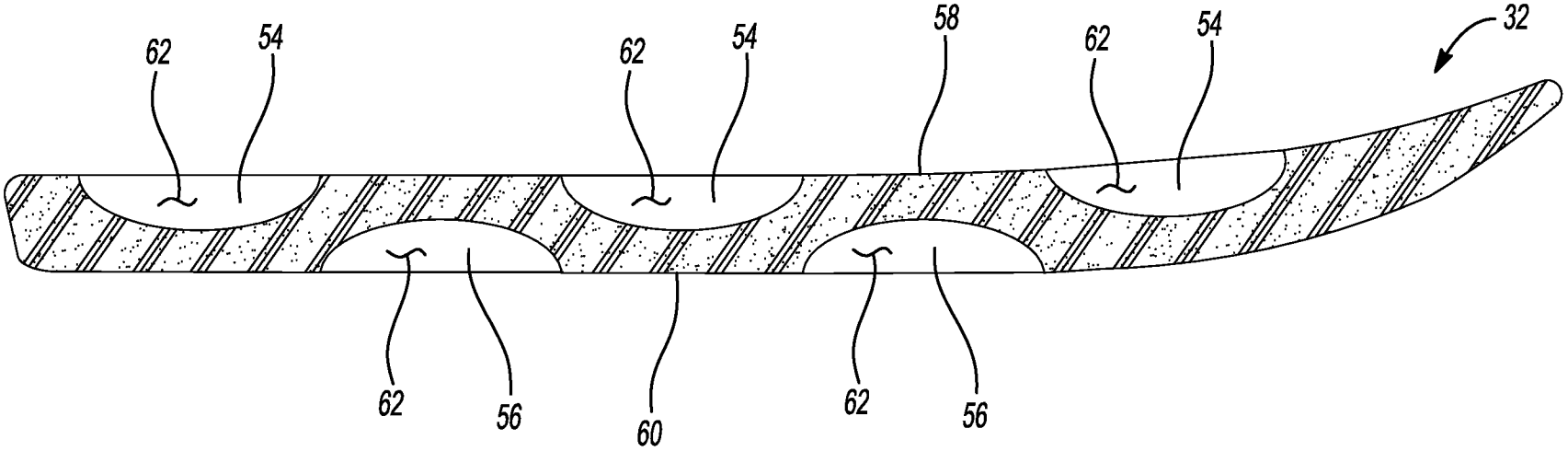
FIG. 3 is a cross-sectional view of a midsole of the article of footwear of FIG. 1 taken along Line 3-3 of FIG. 2.

As shown in FIGS. 4 and 5, the plurality of first cavities 54 and plurality of second cavities 56 may be positioned relative to one another such that the plurality of first cavities 54 are aligned vertically with the plurality of second cavities 56 through a thickness of the midsole 32, but do not overlap one another. For example, edges of adjacent first cavities 54 may be aligned with edges of adjacent second cavities 56 when the midsole is viewed from the top (FIG. 4) or viewed from the bottom (FIG. 5). Further, as shown in FIG. 3, the plurality of first cavities 54 may be spaced apart from the plurality of second cavities 56 by a material of the midsole 32 extending between adjacent ones of the plurality of the first cavities 54 and the plurality of second cavities 56.

With particular reference to FIGS. 2 and 6, the cushioning number 36 is shown as being received within the respective cavities 54, 56 of the midsole 32 to provide a degree of cushioning during use of the article of footwear at 10. The cushioning member 36 includes a series of discrete barrier members 64 each containing a quantity of particulate matter 66. Each of the barrier members 64 may include a first barrier member 68 and a second barrier member 70. The second barrier member 70 may be attached to the first barrier member 68 to define an interior void 72 generally between the first barrier member 68 and a second barrier member 70. The particulate matter 66 may be received within the interior void 72 and, therefore, contained within the interior void 72 between the first barrier member 68 and the second barrier member 70.

The first barrier member 68 and the second barrier member 70 may be formed from the same material. For example, the first barrier member 68 and the second barrier member 70 may be formed from a polymer material such as thermoplastic polyurethane (TPU). Forming the first barrier member 68 and the second barrier member 70 from an impermeable material such as, for example, TPU, provides a sealed interior void 72, thereby preventing fluid such as, for example, air, from entering or exiting the interior void 72.

While the first barrier member 68 and the second barrier member 70 are described as being formed from the same material, the first barrier member 68 and the second barrier member 70 could alternatively be formed from different materials. For example, the first barrier member 68 may be formed from TPU while the second barrier member 70 is formed from a flexible material such as, for example, spandex. Forming the second barrier member 70 from a flexible material such as spandex allows the second barrier member 70 to flex to a greater extent than the first barrier member 68. Further, forming the second barrier member 70 from spandex allows the second barrier member 70 to be permeable. As such, a fluid such as, for example, air, is permitted to move into and out of the interior void 72 of the barrier member 64 via the second barrier member 70.

Regardless of the particular materials used in constructing the first barrier member 68 and the second barrier member 70, the barrier members 64 serve to support and contain the particulate matter 66 relative to and within the respective cavities 54, 56 of the midsole 32. Namely, once the first barrier member 68 receives a predetermined quantity of particulate matter 66, the second barrier 70 may be attached to the first barrier member 68, thereby defining the interior void 72 and containing the particulate matter 66 within interior void 72. At this point, the individual barrier member 64 may be located within the respective cavities 54, 56 prior to assembly of the midsole 32 to the upper 12 and the outsole 34. The barrier members 64 and the associated particulate matter 66 include a volume that allows the barrier members 64 to substantially fill each cavity 54, 56. In one configuration, the barrier members 64 each include a volume that causes the second barrier member 70 to be substantially flush with the first surface 58 of the midsole 32 and with the second surface 60 of the midsole 32. Alternatively, the barrier members 64 may include a volume and an associated volume of particulate matter 66 that causes the second barrier member 70 to protrude from one or more of the first surface 58 and the second surface 60 when the barrier members 64 are installed in the midsole 32.

Regardless of the amount of particulate matter 66 received within the barrier members 64 and, thus, within the plurality of the first cavities 54 and the plurality of second cavities 56, the particulate matter 66 may be used to enhance the functionality and cushioning characteristics that the material of the midsole 32 provides. For example, the particulate matter 66 contained within the cavities 54, 56 may include foam beads having a substantially spherical shape and/or a substantially oval shape. Further, the foam beads defining the particulate matter 66 may have approximately the same size and shape or, alternatively, may have at least one of a different size and shape. For example, the cavities 54, 56 may each include the same quantity of particulate matter 66, whereby the particulate matter 66 includes the same size and shape. Alternatively, one or more of the cavities 54, 56 may include a different amount of particulate matter 66 and/or particulate matter 66 having a different size and/or shape.

Once the particulate matter 66 is received within the interior void 72 of the barrier members 64, the barrier members 64 may be installed in the midsole 32. Specifically, the first barrier member 68 may be positioned relative to respective ones of the cavities 54, 56 such that the first barrier member 68 opposes and contacts the arcuate surface 62 of each cavity 54, 56. Once the barrier members 64 containing particulate matter 66 are received by the respective cavities 54, 56, the outsole 34 may be attached to the midsole 32 and the midsole 32 may be attached to the lower substrate 38 of the upper 12. In so doing, the barrier members 64 received within the plurality of first cavities 54 are maintained within the plurality of first cavities 54 by the lower substrate 38. Likewise, the barrier members 64 received within the plurality of second cavities 56 are maintained within the second cavities 56 by the outsole 34. As such, the barrier members 64 and, thus, the particulate matter 66 contained within the interior void 72 of the barrier members 64 are maintained in a desired position relative to the midsole 32 by the material of the midsole 32 at the cavities 54, 56 and, further, by the lower substrate 38 of the upper 12 opposing the first surface 58 of the midsole 32 and by the outsole 34 opposing the second surface 60 of the midsole 32.

Maintaining the barrier members 64 and, thus, the associated particulate matter 66 in a desired position relative to the midsole 32 and within the plurality of first cavities 54 and the plurality of second cavities 56 provides the midsole 32 and, thus, the article of footwear 10 with enhanced cushioning. Further, because the particulate matter 66 is free to move relative to and within each barrier member 64, the particulate matter 66 provides a degree of responsive and adaptive cushioning. For example, if during use of the article of footwear 10, forces are applied at the forefoot portion 66 during a running movement, downward forces imparted on the midsole 32 and, thus, the particulate matter 66 may cause the particulate matter 66 to move and shift around a user's foot, thereby providing adaptive and responsive cushioning during use of the article of footwear 10.

With particular reference to FIGS. 7-12, an article of footwear 10*a* is provided and includes an upper 12 and a sole structure 14*a* attached to the upper 12. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

The sole structure 14*a* is identical to the sole structure 14 associated with the article of footwear 10 with the exception of the midsole 32*a*, the outsole 34*a*, and the cushioning member 36*a*. Namely, the midsole 32*a* of the sole structure 14*a* includes a plurality of first cavities 54*a* and a plurality of second cavities 56*a* that are otherwise identical to the plurality of first cavities 54 and the plurality of second cavities 56, respectively, of the sole structure 14, with the exception of the relative position of the cavities 54*a*, 56*a* along a longitudinal axis of the midsole 32*a*.

Figure 10:
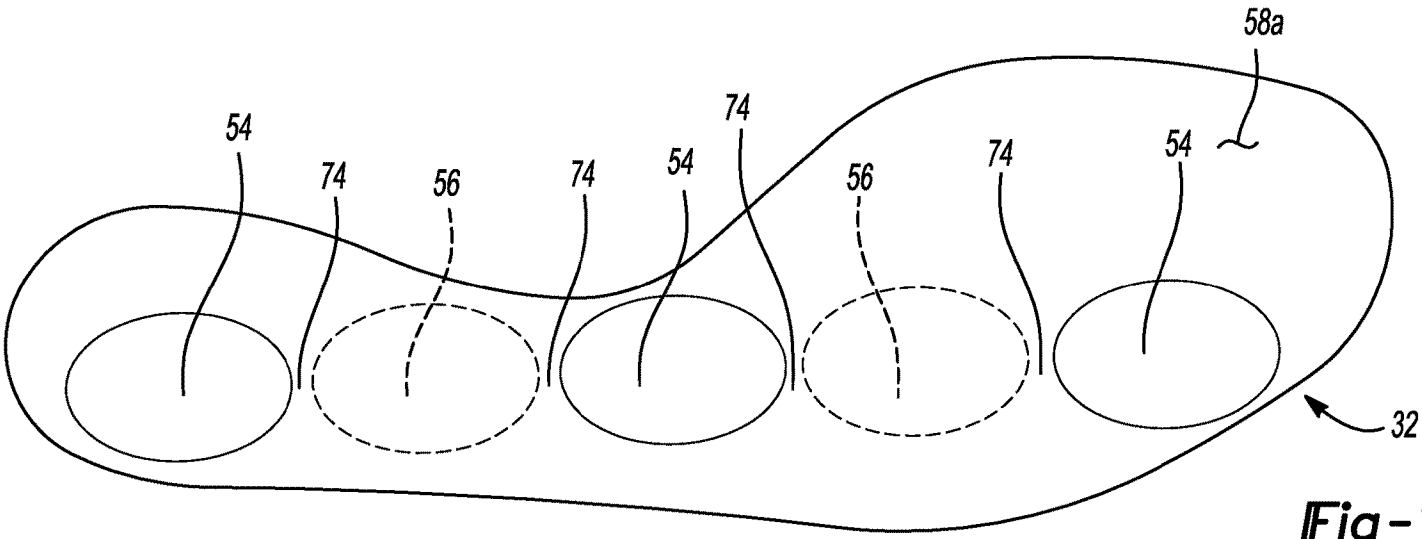
FIG. 10 is a top view of the midsole of FIG. 9.
Figure 11:
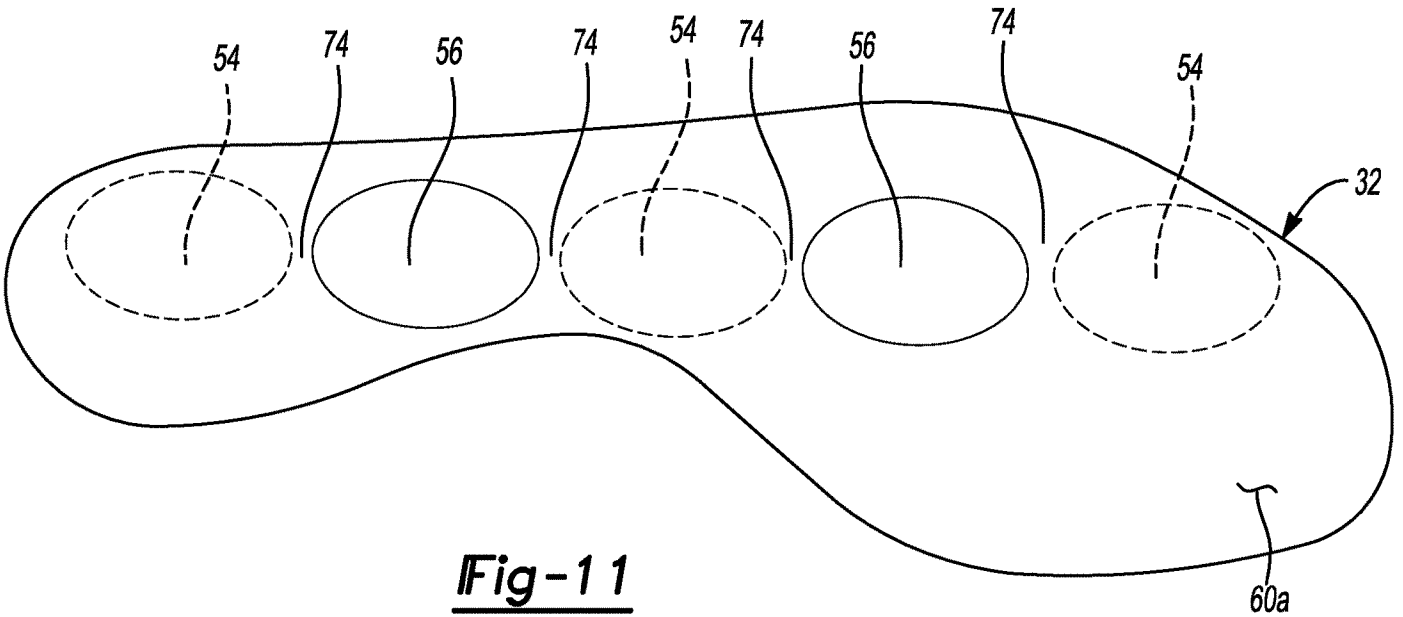
FIG. 11 is a bottom view of the midsole of FIG. 9.

The plurality of first cavities 54*a* and plurality of second cavities 56*a* alternate with one another along a length of the midsole 32*a* in a similar fashion as the plurality of first cavities 54 and the plurality of second cavities 56. However, and as shown in FIGS. 10 and 11, the plurality of first cavities 54*a* and the plurality of second cavities 56*a* are spaced apart from one another along a length of the midsole 32*a*. Namely, a gap 74 is formed between adjacent ones of the plurality of first cavities 54*a* and the plurality of second cavities 56*a* in a direction extending substantially parallel to a longitudinal access of the midsole 32*a*. In other words, the plurality of first cavities 54*a* are spaced apart from adjacent ones of the plurality of second cavities 56*a* by the gap 74 in the direction extending substantially parallel to the longitudinal access of the midsole 32*a* when the midsole 32*a* is viewed from the top (FIG. 10) or when the midsole 32*a* is viewed from the bottom (FIG. 11). In contrast to the midsole 32, which includes a plurality of first cavities 54 that have an outer edge aligned with an outer edge of adjacent ones of the plurality of second cavities 56, the edges of the plurality of first cavities 54*a* are spaced apart from edges of adjacent ones of the plurality of second cavities 56*a* by the gap 74 when viewed from the top or bottom of the midsole 32*a*.

While the midsole 32*a* includes cavities 54*a*, 56*a* that are spaced apart and separated from one another by respective gaps 74 in longitudinal direction of the midsole 32*a*, the midsole 32*a* is otherwise identical to the midsole 32 of the sole structure 14. As such, the midsole 32*a* receives the cushioning member 36*a* to provide and enhance the ability of the midsole 32 to attenuate ground-reaction forces during use of the article of footwear 10*a*.

Figure 12:
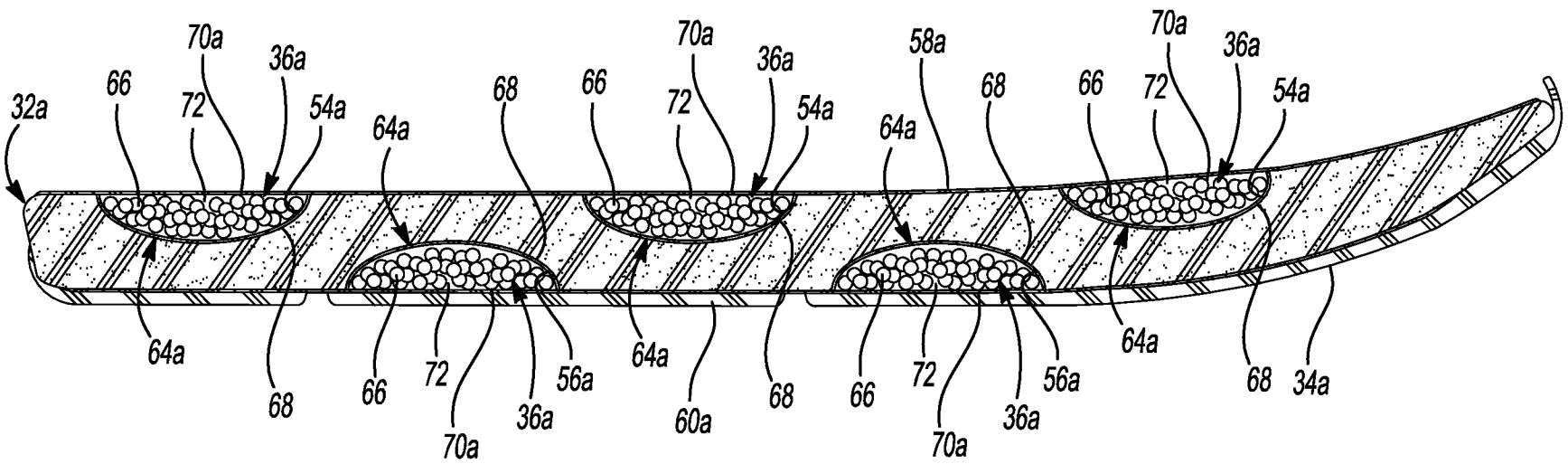
FIG. 12 is a partial cross-sectional view of the article of footwear of FIG. 7 taken along Line 12-12 of FIG. 7.
Figure 13:
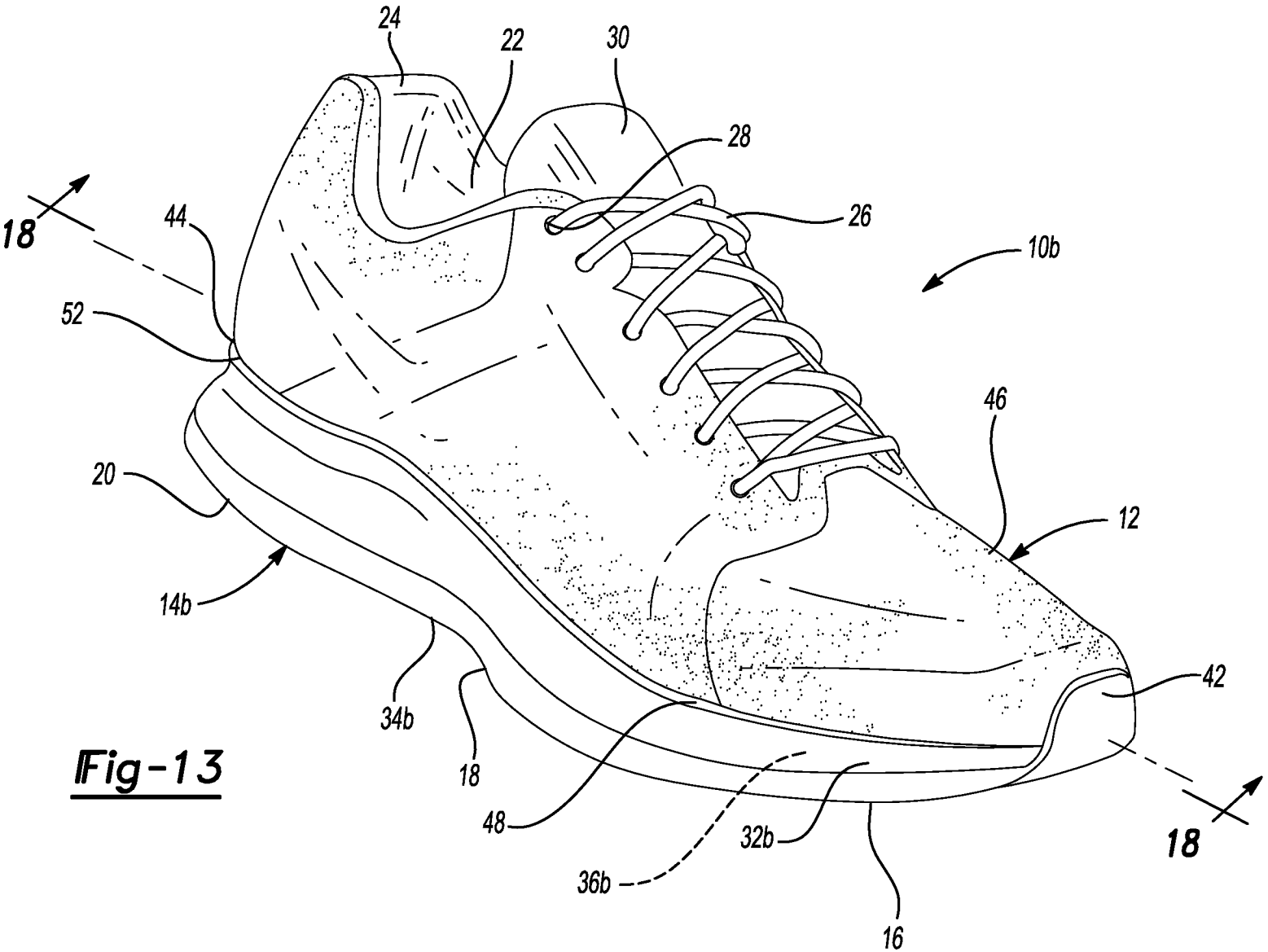
FIG. 13 is a perspective view of an article of footwear in accordance with the principles of the present disclosure.

As described above, the cushioning member 36 associated with the article of footwear 10 includes a plurality of discrete, individual barrier members 64 each containing a quantity of particulate matter 66. Further, and as described above, the barrier members 64 may include a first barrier member 68 and a second barrier member 70 that are formed from the same or different material. The cushioning member 36*a* of the sole structure 14*a* is virtually identical to the cushioning member 36 with the exception of the second barrier member 70. Namely, and as shown in FIGS. 8 and 12, the barrier members 64*a* each include a discrete first barrier member 68 that receives a quantity of particulate matter 66 in a similar fashion as the barrier members 64 associated with the cushioning member 36 of the sole structure 14. However, the cushioning member 36*a* of the sole structure 14*a* includes a second barrier member 70*a* that extends across and connects the individual first barrier members 68 of the barrier members 64*a*. Namely, the second barrier member 70*a* connects the first barrier members 68 that are received by the plurality of first cavities 54*a*. Likewise, a second barrier member 70*a* extends between and connects adjacent first barrier members 68 that are received by the plurality of second cavities 56*a*. In so doing, the second barrier members 70*a* connect adjacent ones of the first barrier members 68 to create a single assembly that may be installed into the plurality of first cavities 54*a* at the first surface 58*a*. Similarly, the second barrier member 70*a* connects first barrier members 68, thereby creating a single assembly that may be inserted into the plurality of second cavities 56*a* at the second surface 60*a*.

Causing the second barrier member 70*a* to extend across and connect adjacent first barrier members 68 results in a relative position of the first barrier members 68 being fixed once the second barrier member 70*a* is attached to the first barrier members 68. In so doing, a position of the first barrier members 68 relative to one another and relative to the second barrier member 70*a* is fixed and, as such, ensures that the first barrier members 68 are properly aligned with the spacing of the plurality of first cavities 54*a*. Likewise, applying a second barrier member 70*a* to extend across first barrier members 68 of a cushioning member 36*a* that is intended for use with the plurality of second cavities 56*a* likewise properly positions and spaces apart the first barrier members 68 such that the first barrier members 68 may be received within respective ones of the plurality of second cavities 56*a* when the cushioning member 36*a* is installed in the plurality of second cavities 56*a* of the midsole 32*a*.

While the midsole 32*a* is described as including first barrier members 68 that are joined by a single second barrier member 70*a*, the plurality of first cavities 54*a* and a plurality of second cavities 56*a* could alternatively receive individual, discrete barrier members 64 in an identical fashion as the midsole 32. Further, while the midsole 32 is described and shown as receiving individual and discrete barrier members 64, the midsole 32 could alternatively receive first barrier members 68 that are joined by a single second barrier member 70*a* at the first surface 58 and the second surface 60. Regardless of whether the first barrier members 68 receive individual second barrier members 70 or, alternatively, adjacent first barrier members 68 are joined by a single second barrier member 70*a* at the first surface 58, 58*a* and at the second surface 60, 60*a*, providing the cavities 54, 54*a*, 56, 56*a* with a quantity of particulate matter 66 enhances the ability of the midsole 32, 32*a* to attenuate ground-reaction forces during use of the article of footwear 10, 10*a*.

As shown in FIG. 12, the outsole 34*a* includes a series of separate outsole portions rather than a continuous outsole 34, as incorporated into the sole structure 14. The separate outsole portions are shown as being spaced apart and separated from one another along a length of the midsole 32*a* and provide the article of footwear 10*a* with abrasion resistance and traction during use. The separate outsole portions further provide the sole structure 14*a* with increased flexibility at gaps disposed between adjacent outsole portions, as compared to a sole structure incorporating a continuous outsole. In one configuration, one or more of the portions of the outsole 34*a* may be formed from a transparent or translucent material to expose the particulate matter 66 disposed within the second cavity 56*a* at the outsole 34*a*. While the sole structure 14 is described and shown as including a continuous outsole 34 and the sole structure 14*a* is described and shown as including an outsole 34*a* having separate outsole portions, either sole structure 14, 14*a* could include a continuous outsole 34 or an outsole 34*a* having separate outsole portions.

With reference to FIGS. 13-18, an article of footwear 10*b* is provided and includes an upper 12 and a sole structure 14*b* attached to the upper 12. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

The article of footwear 10*b* is virtually identical to the article of footwear 10 with the exception of the midsole 32*b*, the outsole 34*b*, and the cushioning member 36*b*. Accordingly, the article of footwear 10*b* includes a different sole structure 14*b* than the article of footwear 10 primarily due to the midsole 32*b* and the cushioning member 36*b*.

The midsole 32*b* includes a plurality of first cavities 54*b* each having a trapezoidal shape that tapers in a direction from the first surface 58*b* to the second surface 60*b*. The midsole 32*b* additionally includes a second cavity 56*b* disposed on an opposite side of the midsole 32*b* than the plurality of first cavities 54*b*. The second cavity 56*b* similarly includes a trapezoidal shape that tapers in a direction extending from the second surface 60*b* of the midsole 32*b* toward the first surface 58*b*. While the midsole 32*b* will be described and shown hereinafter as including a pair of first cavities 54*b* and a single second cavity 56*b*, the midsole 32*b* could alternatively include a single first cavity 54*b* and a plurality of second cavities 56*b*. Namely, the midsole 32*b* could include a single first cavity 54*b* formed into the first surface 58*b* at a location that opposes the location of the second cavity 56*b* shown in FIG. 14 and could include a pair of second cavities 56*b* formed into the second surface 60*b* at locations that oppose the locations of the first cavities 54*b* shown in FIG. 14. While the midsole 32*b* could include any number of first cavities 54*b* and any number of second cavities 56*b*, the midsole 32*b* will be described and shown as including a pair of first cavities 54*b* and a single second cavity 56*b*.

Figure 16:
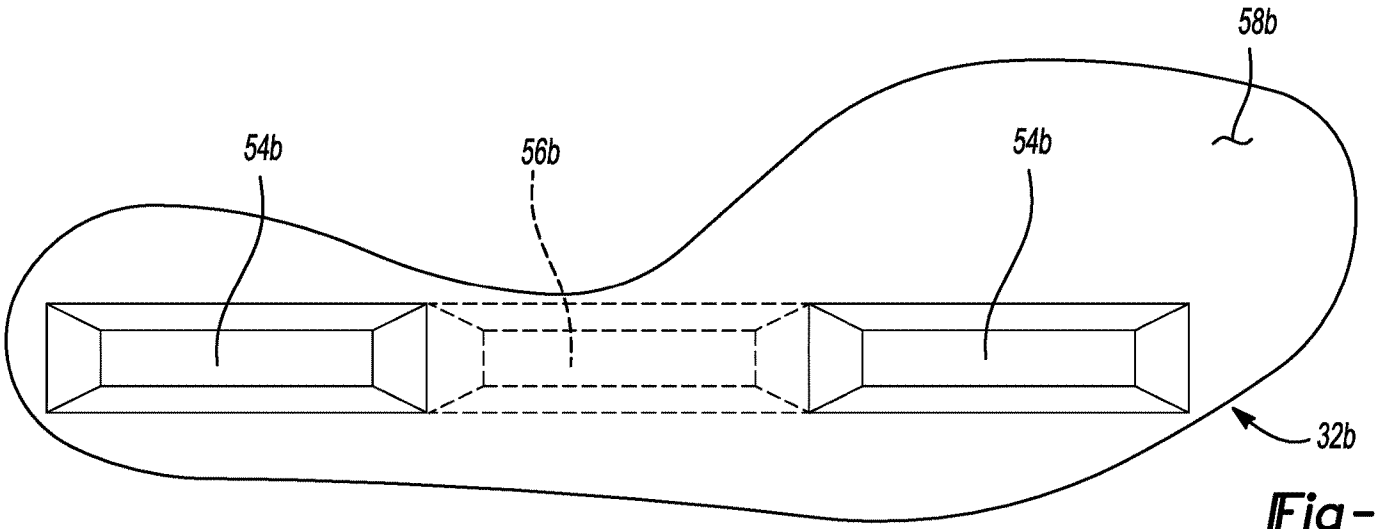
FIG. 16 is a top view of the midsole of FIG. 15.
Figure 17:
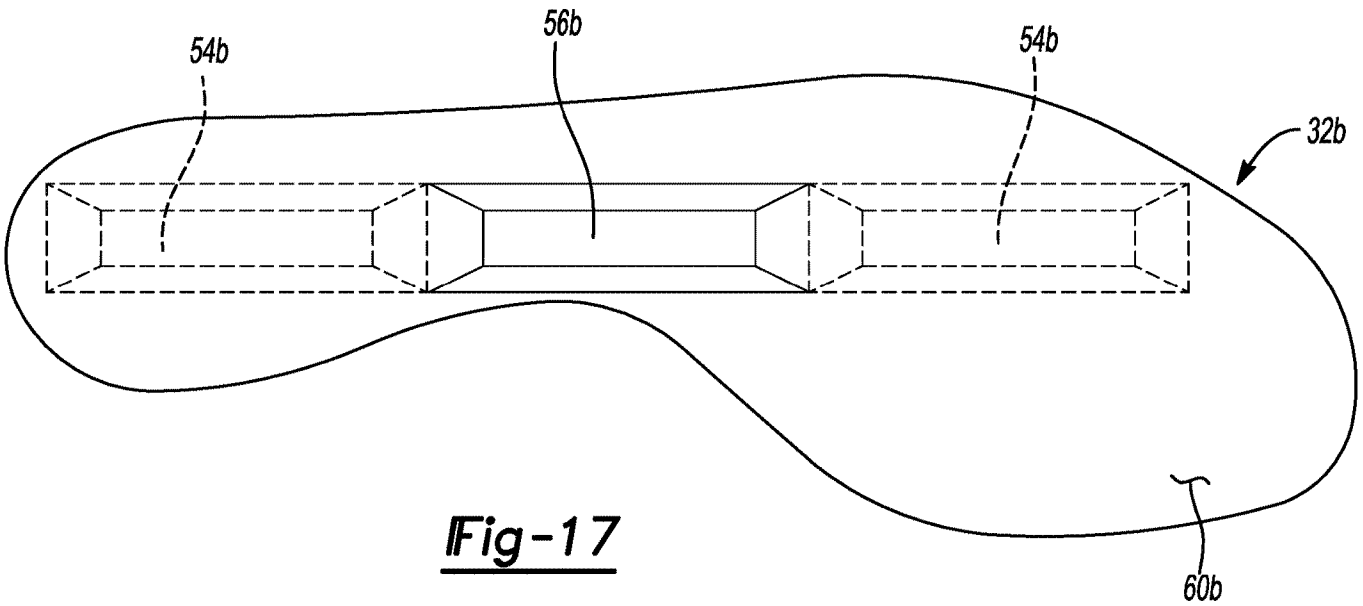
FIG. 17 is a bottom view of the midsole of FIG. 15.

The plurality of first cavities 54*b* and the second cavity 56 alternate along a length of the midsole 32*b*. As shown in FIGS. 16 and 17, an edge of each of the first cavities 54 is aligned vertically with opposite edges of the second cavity 56*b* in a direction extending along a length of the midsole 32*b*. Namely, the edges of the first cavities 54 are aligned with opposite edges of the second cavity 56*b* when the midsole 32*b* is viewed from the top (FIG. 16) or when the midsole 32*b* is viewed from the bottom (FIG. 17). While the edges of the first cavities 54*b* are aligned with opposite edges of the second cavity 56*b*, the cavities 54*b*, 56*b* are spaced apart from one another by a material of the midsole 32*b*, as shown in FIG. 15.

Figure 14:
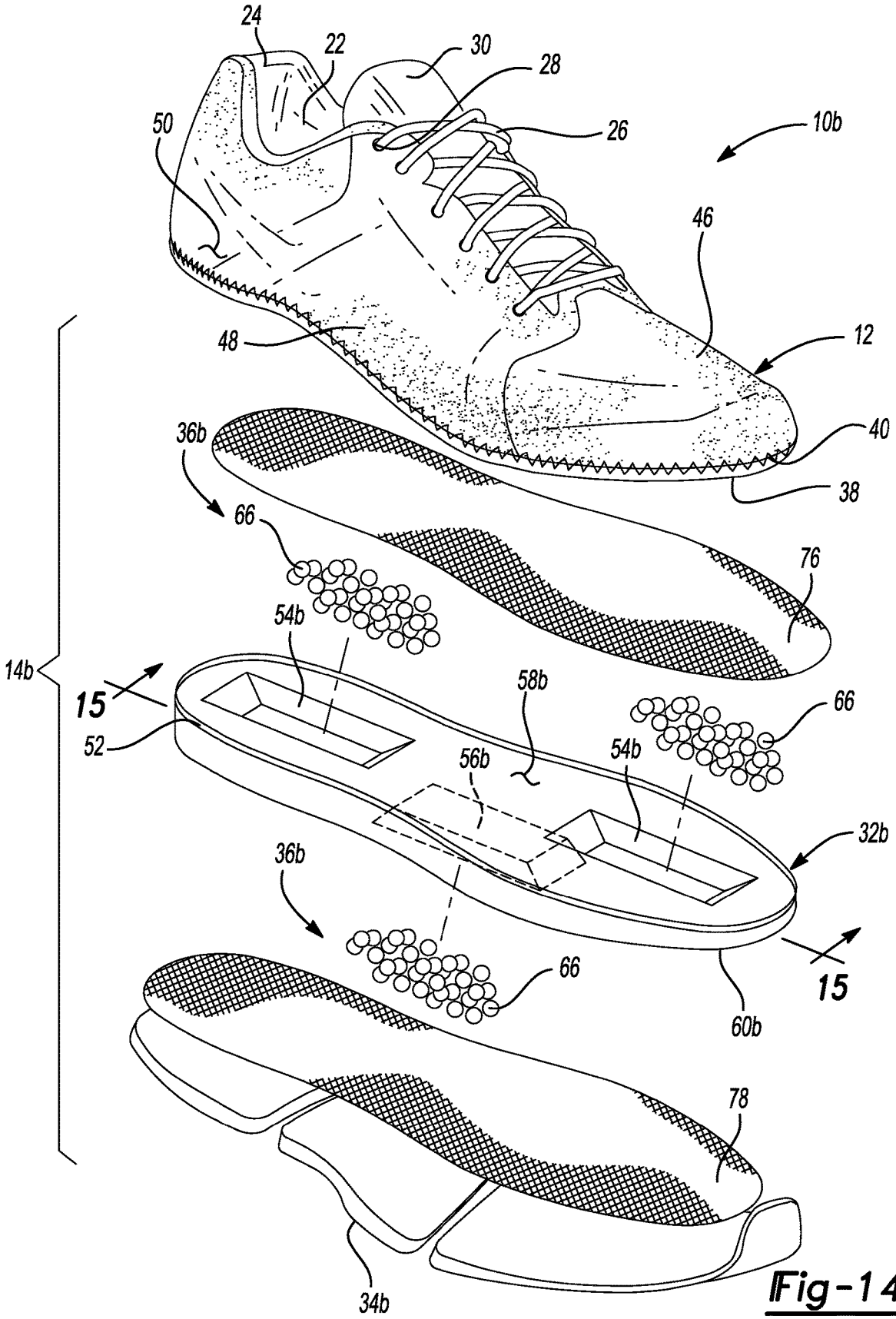
FIG. 14 is an exploded view of the article of footwear of FIG. 13.
Figure 15:
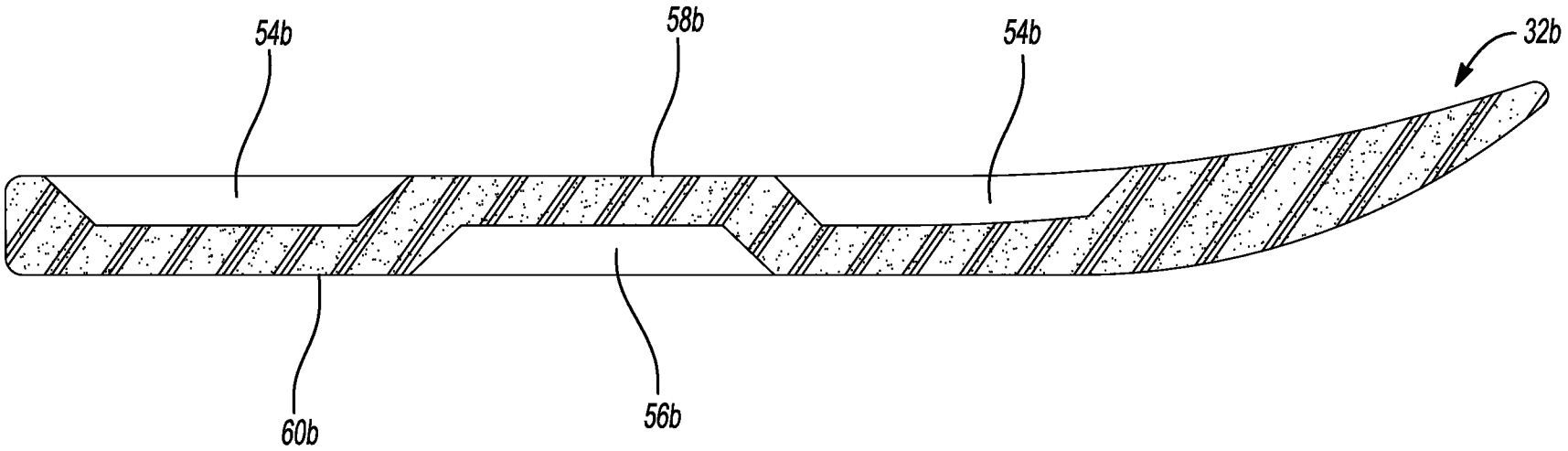
FIG. 15 is a cross-sectional view of a midsole of the article of footwear of FIG. 13 taken along Line 15-15 of FIG. 14.

As shown in FIGS. 14 and 15, the first cavities 54*b* and the second cavity 56*b* include the same, trapezoidal shape. In one configuration, the second cavity 56*b* is nested with the first cavities 54*b* such that the second cavity 56*b* is disposed between the first cavities 54*b* and is inverted relative to the first cavities 54*b*.

The cushioning member 36*b* incorporates particulate matter 66 in a similar fashion as the cushioning members 36, 36*a*. However, the particulate matter 66 is inserted directly into the first cavities 54*b* and is inserted directly into the second cavity 56*b* without incorporating a barrier member 64. While the particulate matter 66 will be described hereinafter as being incorporated directly into the first cavities 54*b* and directly into the second cavity 56*b* without use of a barrier member 64, the particulate matter 66 could alternatively be disposed within any or all of the cavities 54*b*, 56*b* after first being disposed within the interior void 72 of respective barrier members 64.

The particulate matter 66 may include foam beads having the same size and/or shape as the particulate matter 66 described above with respect to the sole structure 14. Further, each of the cavities 54*b*, 56*b* may receive the same quantity of particulate matter 66 or, alternatively, one or more of the cavities 54*b*, 56*b* may receive a different quantity of particulate matter 66. Regardless of the size, shape, and quantity of particulate matter 66 received within the respective cavities 54*b*, 56*b*, the particulate matter 66 is inserted into the first cavities 54*b* at the first surface 58*b* and is inserted into the second cavity 56*b* at the second surface 60*b*.

Once the particulate matter 66 is received within the first cavities 54*b* and the second cavity 56*b*, a first barrier member 76 may be attached to the midsole 32*b* at the first surface 58*b* and a second barrier member 78 may be attached to the second surface 60*b* of the midsole 32*b* in an effort to retain the particulate matter 66 within the cavities 54*b*, 56*b*, respectively. The first barrier member 76 and the second barrier member 78 may be formed from a flexible material such as, for example, spandex in a similar fashion as the second barrier member 70*a* associated with the barrier members 64*a*. The first barrier member 76 and the second barrier member 78 may be respectively attached to the first surface 58*b* and the second surface 60*b* via an adhesive in an effort to retain the particulate matter 66 within the respective cavities 54*b*, 56*b*.

Once the particulate matter 66 is retained within the cavities 54*b*, 56*b* by the first barrier member 76 and the second barrier member 78, respectively, the midsole 32*b* may be attached to the upper 12 and the outsole 34*b*. Specifically, the first barrier member 76 may be attached to the lower substrate 38 of the upper 12 via a suitable adhesive while the second barrier member 76 may be attached to the outsole 34*b* via a suitable adhesive.

Figure 18:
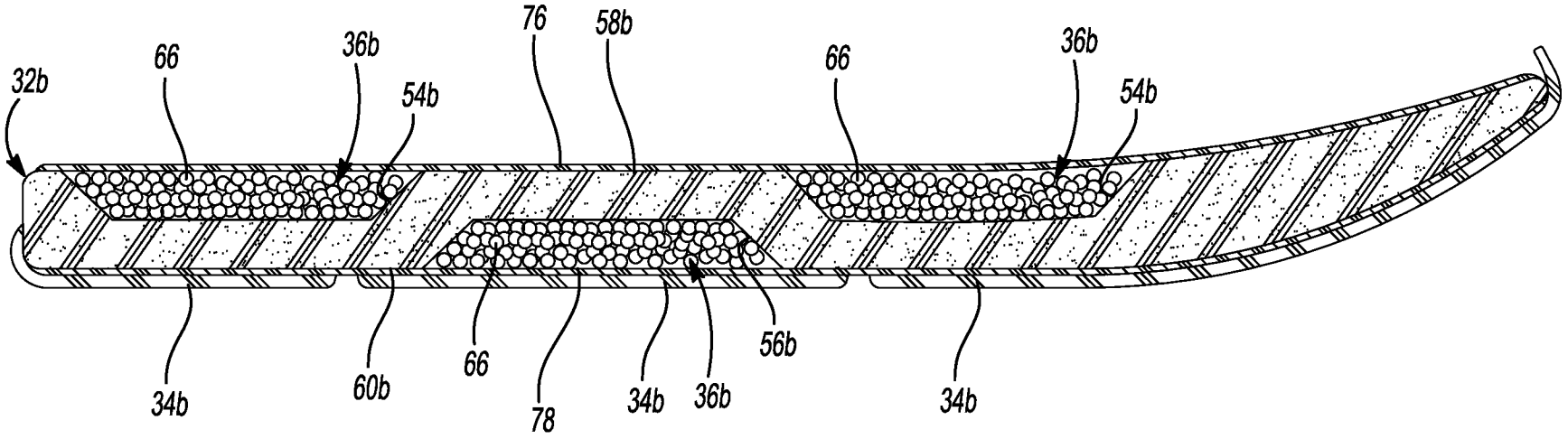
FIG. 18 is a partial cross-sectional view of the article of footwear of FIG. 13 taken along Line 18-18 of FIG. 13.
Figure 19:
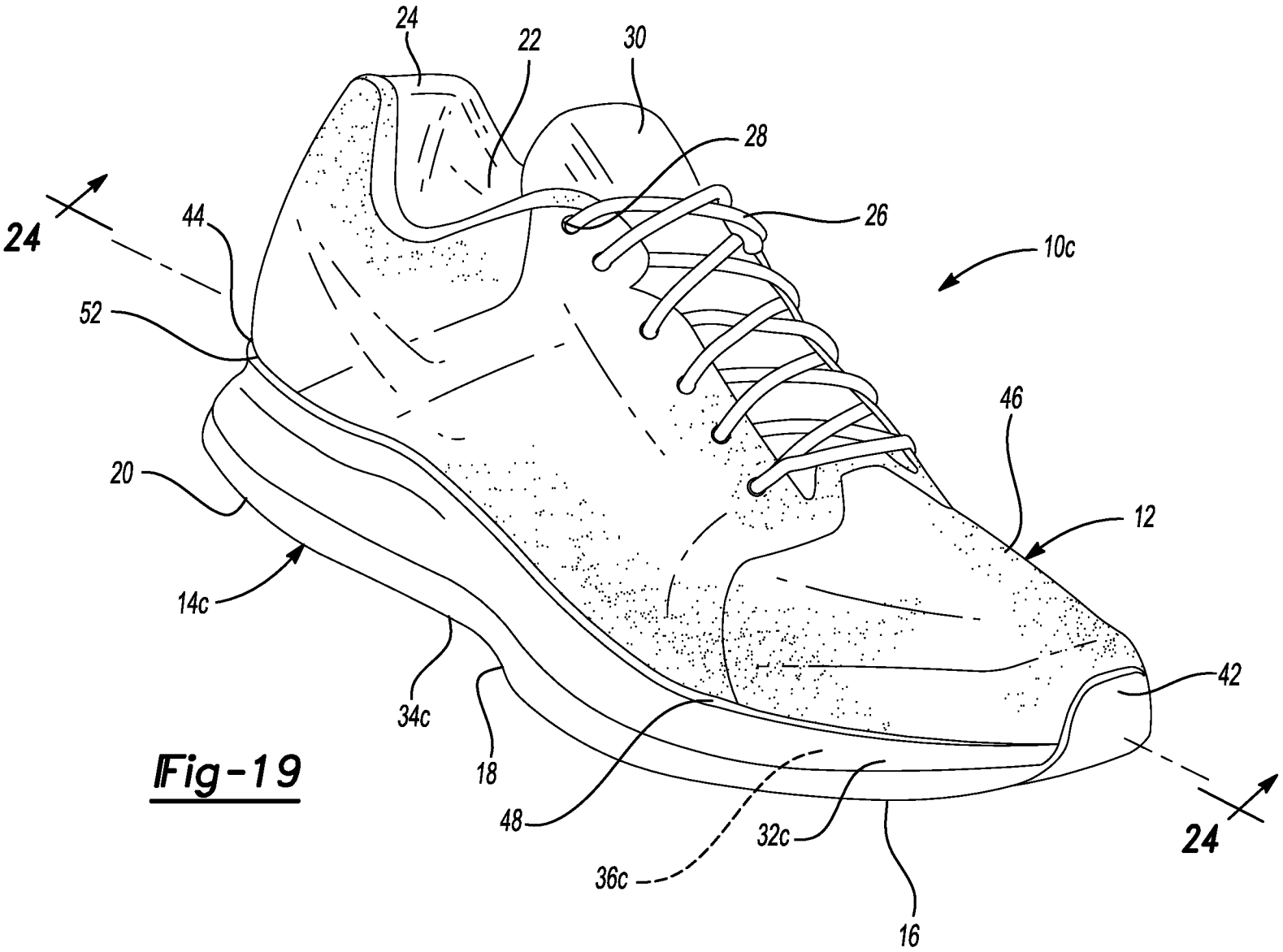
FIG. 19 is a perspective view of an article of footwear in accordance with the principles of the present disclosure.
Figure 20:
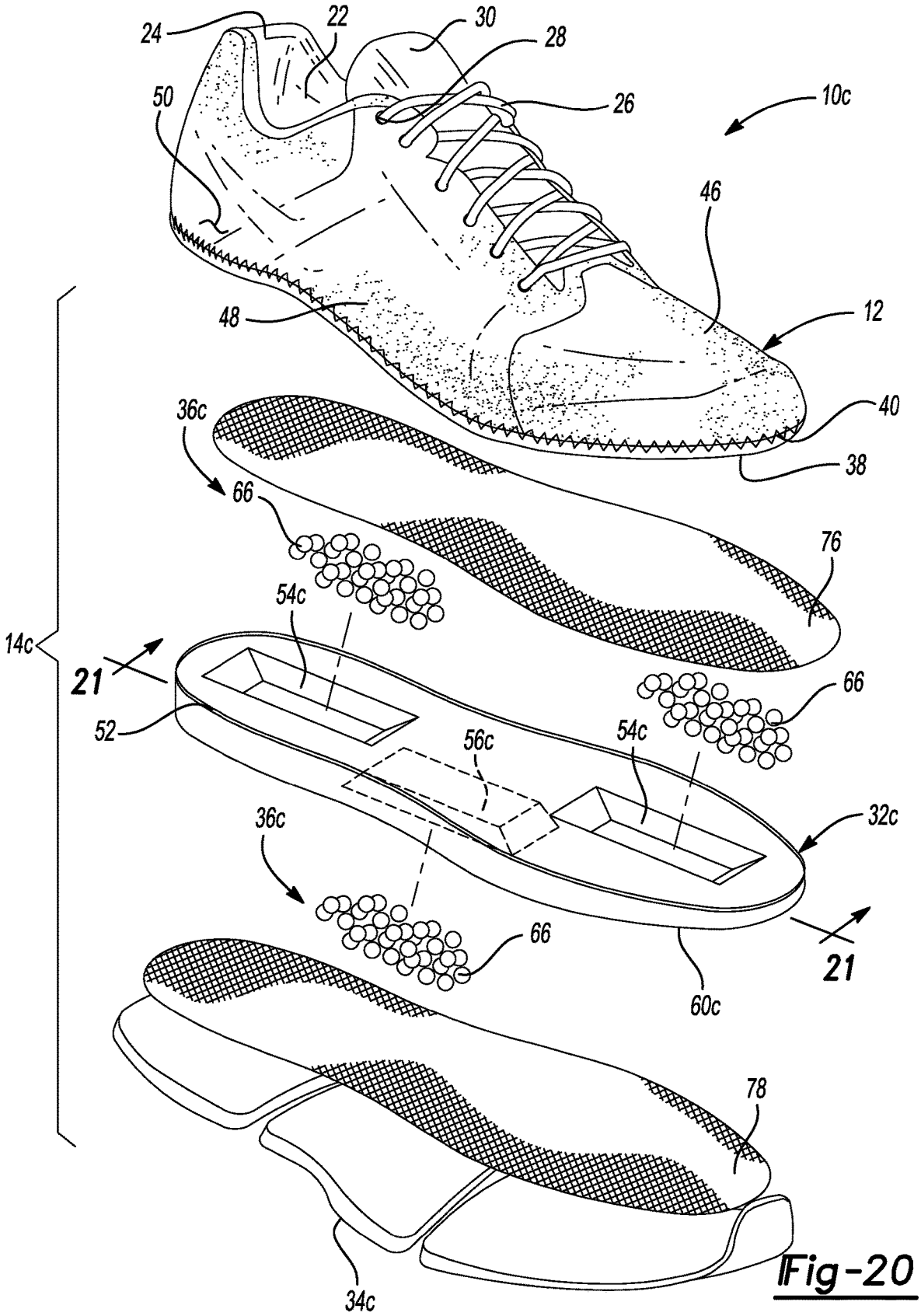
FIG. 20 is an exploded view of the article of footwear of FIG. 19.
Figure 21:
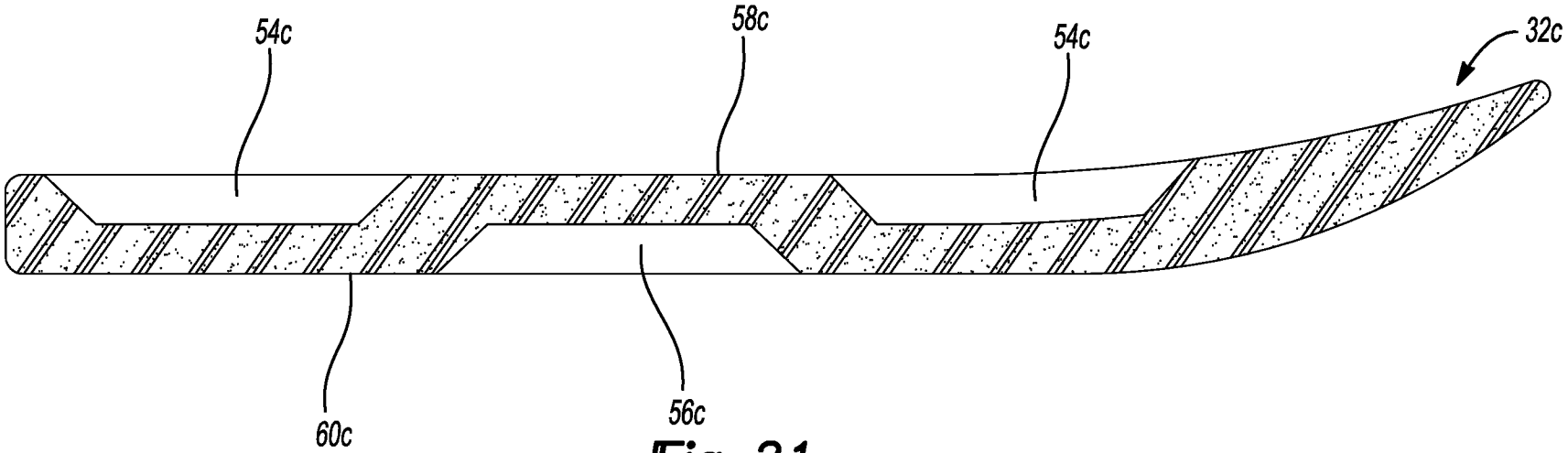
FIG. 21 is a cross-sectional view of a midsole of the article of footwear of FIG. 19 taken along Line 21-21 of FIG. 20.
Figure 22:
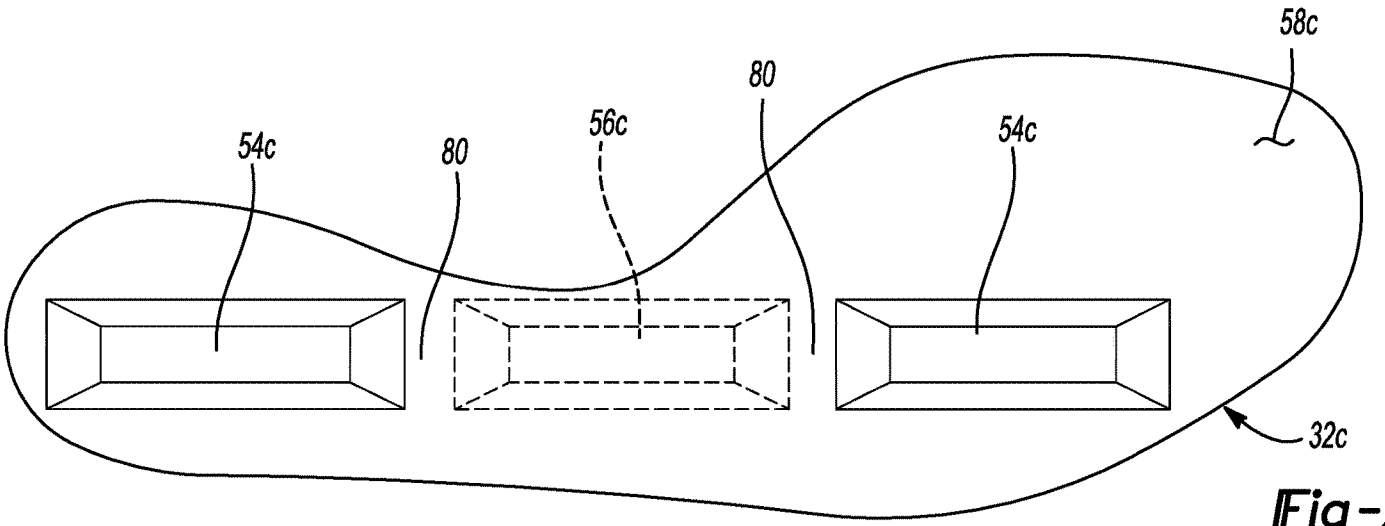
FIG. 22 is a top view of the midsole of FIG. 21.

As shown in FIGS. 14 and 18, the outsole 34*b* includes a series of separate outsole portions. The separate outsole portions are shown as being spaced apart and separated from one another along a length of the midsole 32*b* and provide the article of footwear 10*b* with abrasion resistance and traction during use. The separate outsole portions further provide the sole structure 14*b* with increased flexibility at gaps disposed between adjacent outsole portions, as compared to a sole structure incorporating a continuous outsole. In one configuration, one or more of the portions of the outsole 34*b* may be formed from a transparent or translucent material to expose the particulate matter 66 disposed within the second cavity 56*b* at the outsole 34*b*.

As with the articles of footwear 10, 10*a*, the cushioning member 36*b* provides the article of footwear 10*b* with a degree of cushioning during use. Further, because the particulate matter 66 is free to move relative to and within the cavities 54*b*, 56*b*, the particulate matter 66 enhances the ability of the material of the midsole 32*b* to absorb ground-reaction forces. Further yet, movement of the particulate matter 66 relative to and within the cavities 54*b*, 56*b* provides adaptive cushioning by responding to ever-changing applied loads during use of the article of footwear 10*b*.

With reference to FIGS. 19-24, an article of footwear 10*c* is provided and includes an upper 12 and a sole structure 14*c* attached to the upper 12. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

Figure 23:
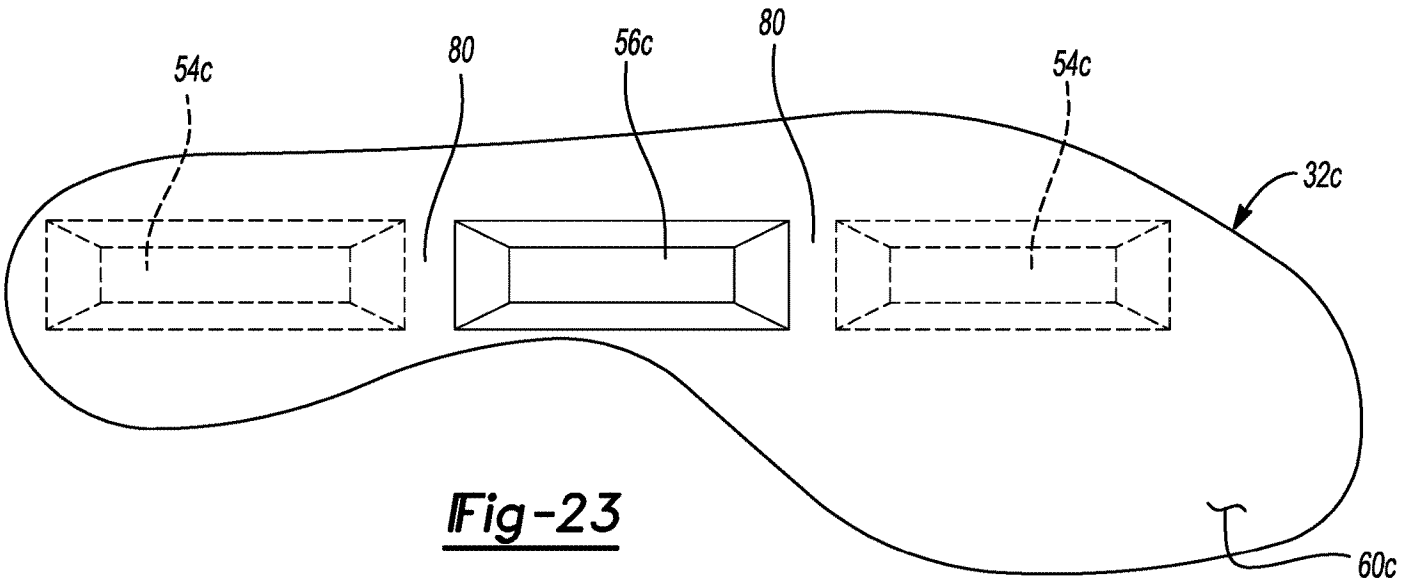
FIG. 23 is a bottom view of the midsole of FIG. 21.

The article of footwear 10*c* is virtually identical to the article of footwear 10*b* with the exception of the midsole 32*c*, the outsole 34*c*, and the cushioning member 36*c*. Namely, the midsole 32*c* includes a pair of first cavities 54*c* and a single second cavity 56*c* disposed on opposite sides of the midsole 32*c* in a similar fashion as the cavities 54*b*, 56*b* of the midsole 32*b*. However, the plurality of first cavities 54*c* and the single second cavity 56*c* are spaced apart and separated from one another by a gap 80 along a longitudinal access of the midsole 32*c*. Specifically, edges of the first cavities 54*c* are spaced apart and separated from opposite edges of the second cavity 56*c* in a direction extending along a longitudinal access of the midsole 32 such that the gap 80 is formed between the second cavity 56*c* and each of the first cavities 54*c* when the midsole 32*c* is viewed from the top (FIG. 22) or the bottom (FIG. 23). The midsole 32*c* is otherwise identical to the midsole 32*b*, as each of the first cavities 54*c* and the second cavity 56*c* receives a quantity of particulate matter 66 to enhance the ability of the midsole 32*c* to provide the article of footwear 10*c* with a desired cushioning effect.

Figure 24:
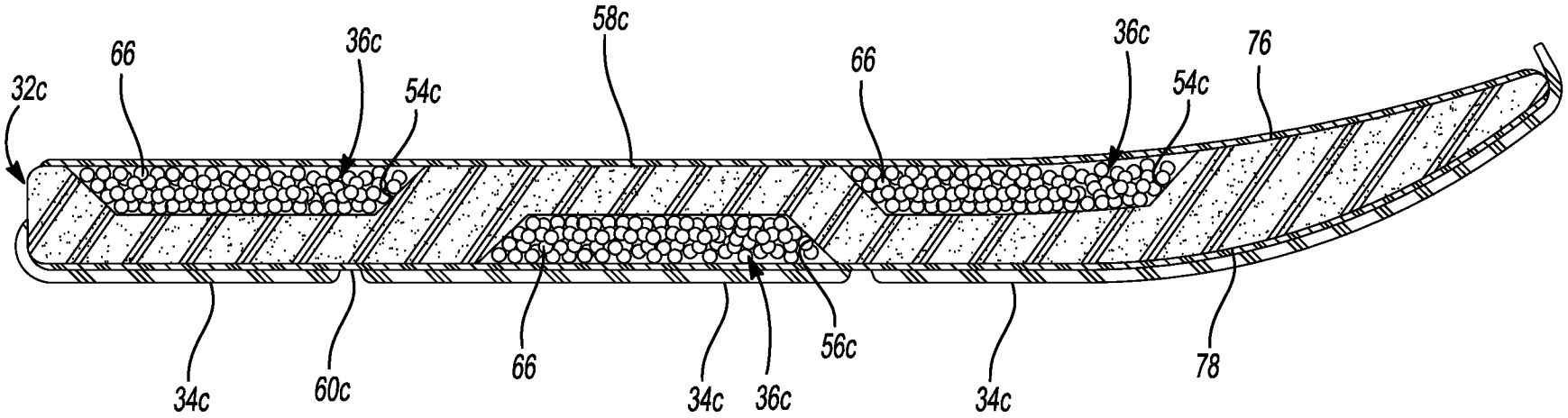
FIG. 24 is a partial cross-sectional view of the article of footwear of FIG. 19 taken along Line 24-24 of FIG. 19.
Figure 25:
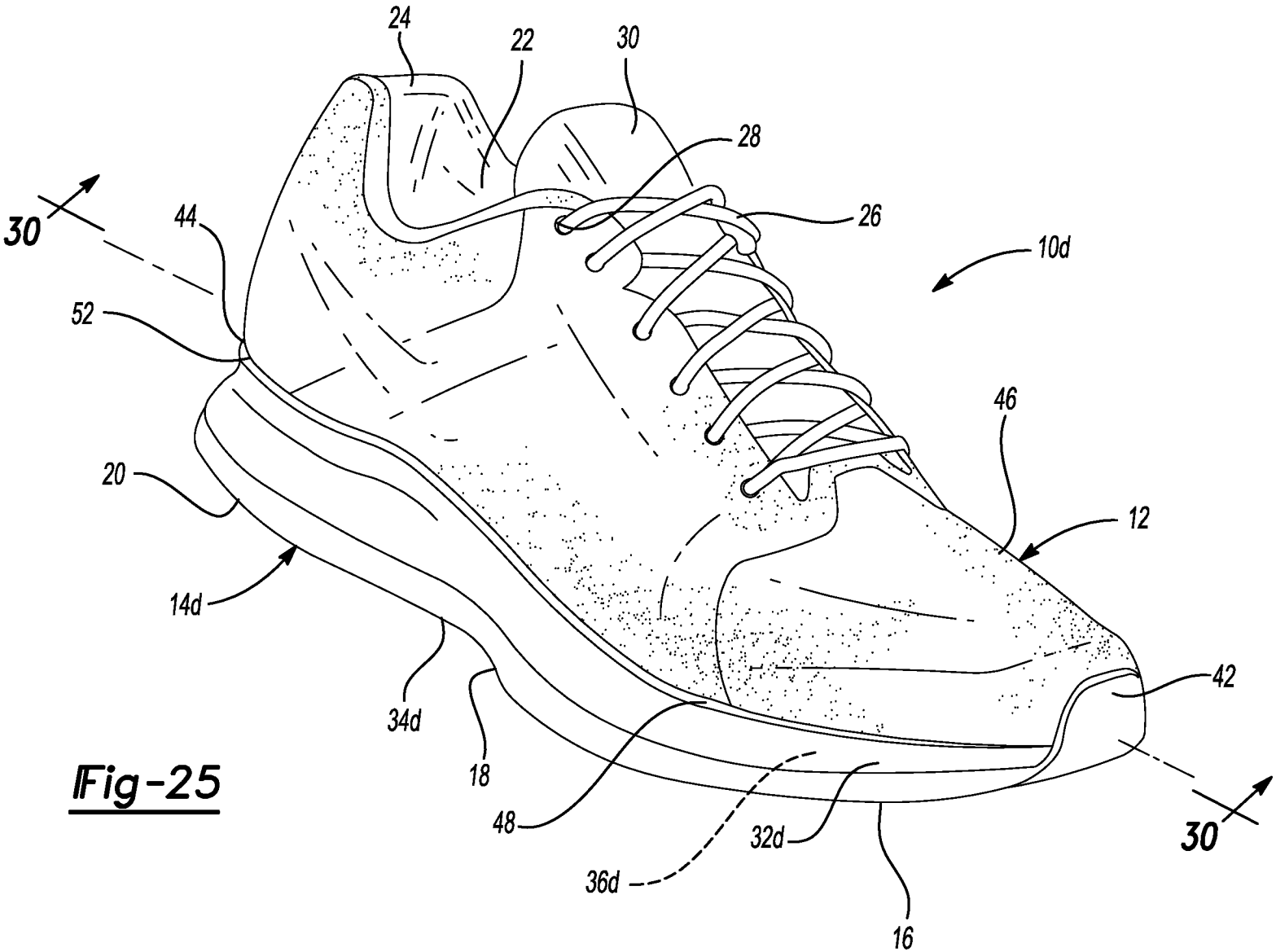
FIG. 25 is a perspective view of an article of footwear in accordance with the principles of the present disclosure.

As shown in FIG. 24, the first cavities 54*c* are spaced apart from the second cavity 56*c* such that edges of the first cavities 54*c* are not aligned with edges of the second cavity 56*c* in a vertical direction to permit the gap 80 to form between adjacent cavities 54*c*, 56*c*. As shown in FIG. 24 a material of the midsole 32*c* extends between the cavities 54*c*, 56*c* in a similar fashion as the cavities 54, 56 of the midsole 32.

As with the midsole 32*b*, once the particulate matter 66 is contained within the first cavities 54*c* by the first barrier member 76 and the particulate matter 66 is contained within the second cavity 56*c* by the second barrier member 78, the first barrier member 76 may be attached to the lower substrate 38 of the upper 12 and the second barrier member 78 may be attached to the portions of the outsole 34*c*. Attaching the first barrier member 76 to the lower substrate 38 of the upper 12 and attaching the second barrier member 78 to the portions of the outsole 34*c* provides the article of footwear 10*c* with a sole structure 14*c* having cushioning characteristics at locations of the particulate matter 66 that enhance the cushioning characteristics of the sole structure 14*c* already provided by a material of the midsole 32*c*.

With particular reference to FIGS. 25-30, an article of footwear 10*d* is provided and includes an upper 12 and a sole structure 14*d* attached to the upper 12. In view of the substantial similarity in structure and function of the components associated with the article of footwear 10 with respect to the article of footwear 10*d*, like reference numerals are used hereinafter and in the drawings to identify like components while like reference numerals containing letter extensions are used to identify those components that have been modified.

The article of footwear 10*d* is identical to the article of footwear 10 with the exception of the midsole 32*d*, the outsole 34*d*, and the cushioning member 36*d*. The midsole 32*d* includes a plurality of first cavities 54*d* and a plurality of second cavities 56*d*. The plurality of first cavities 54*d* are formed into the first surface 58*d* of the midsole 32*d* and the plurality of second cavities 56*d* are formed into the second surface 60*d* of the midsole 32*d*. As with the midsole 32 of the article of footwear 10, the second surface 60*d* is formed on an opposite side of the midsole 32*d* than the first surface 58*d*.

The plurality of first cavities 54*d* and the plurality of second cavities 56*d* include a substantially circular or oval shape. As such, the plurality of first cavities 54*d* taper in a direction from the first surface 58*d* toward the second surface 60*d*. Likewise, the plurality of second cavities 56*d* taper in a direction from the second surface 60*d* toward the first surface 58*d*.

Each of the plurality of first cavities 54*d* includes a first passageway 82 in fluid communication with the respective cavities 54*d*. Likewise, each of the plurality of second cavities 56*d* includes a second passageway 84 in fluid communication with the respective cavities 56*d*.

Figure 26:
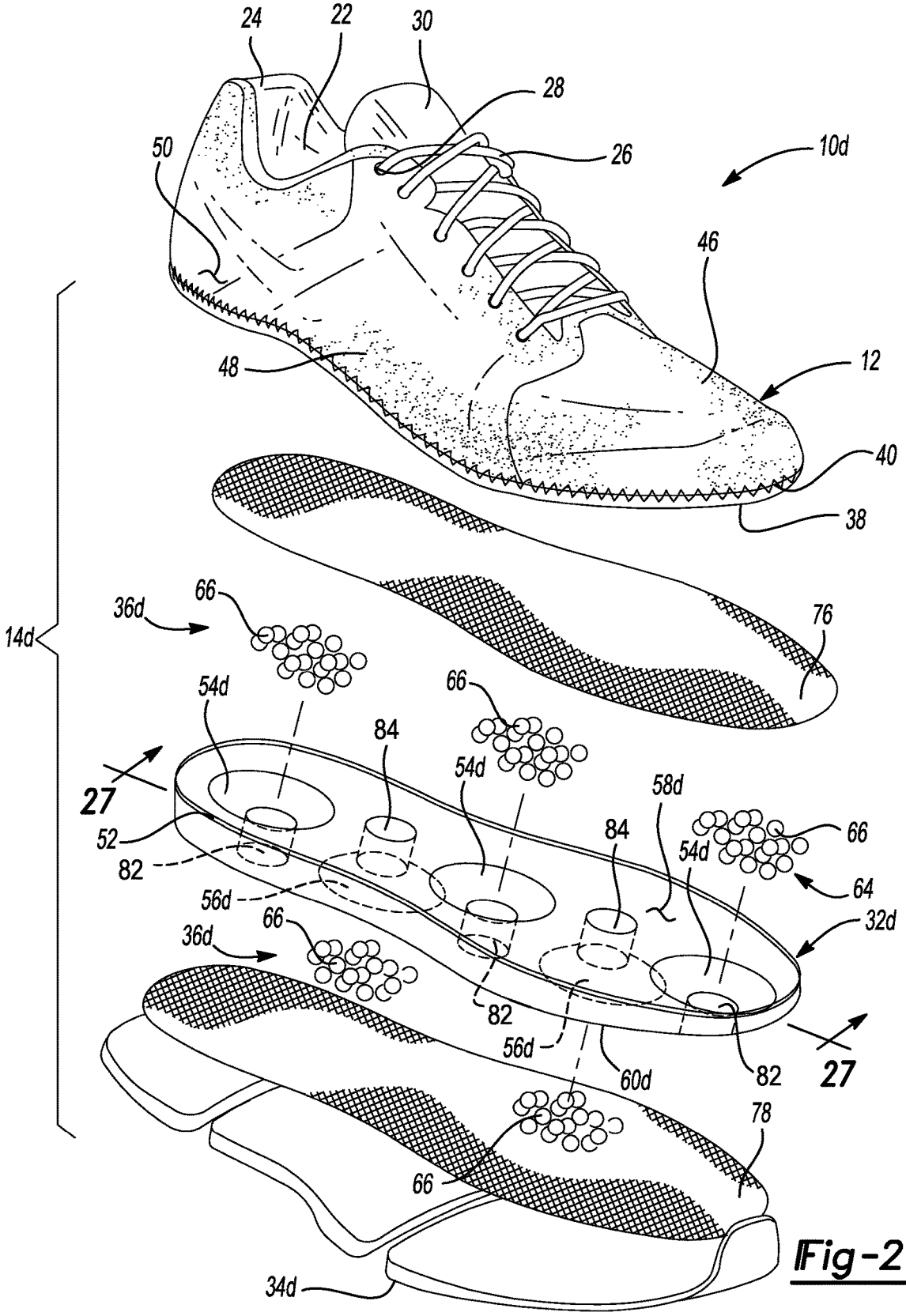
FIG. 26 is an exploded view of the article of footwear of FIG. 25.
Figure 27:
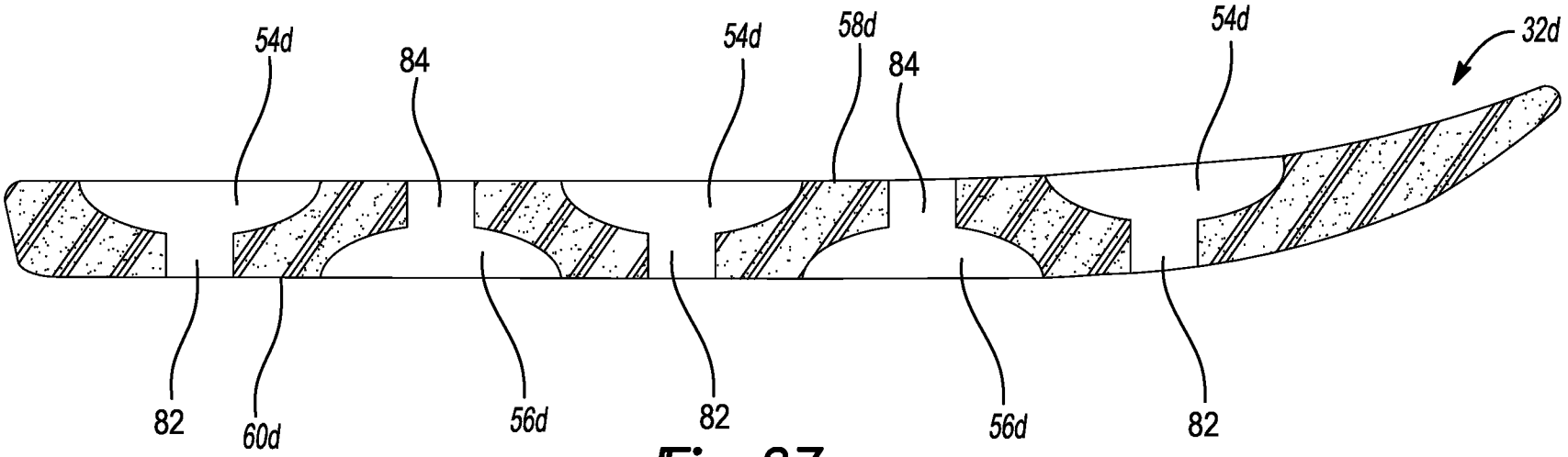
FIG. 27 is a cross-sectional view of a midsole of the article of footwear of FIG. 25 taken along Line 27-27 of FIG. 26.

The first passageways 82 extend from respective ones of the first cavities 54*d* to the second surface 60*d*. Likewise, the second passageways 84 extend from respective ones of the second cavities 56*d* to the first surface 58*d*. As shown in FIGS. 26 and 27, the first passageways 82 include a different shape than the cavities 54*d* and the second passageways 84 include a different shape than the cavities 56*d*. In the example provided, the passageways 82, 84 include a substantially cylindrical shape. The first passageways 82 extend from the respective first cavities 54*d* to the second surface 60*d* and the second passageways 84 extend from the respective second cavities 56*d* to the first surface 58*d*.

Figure 28:
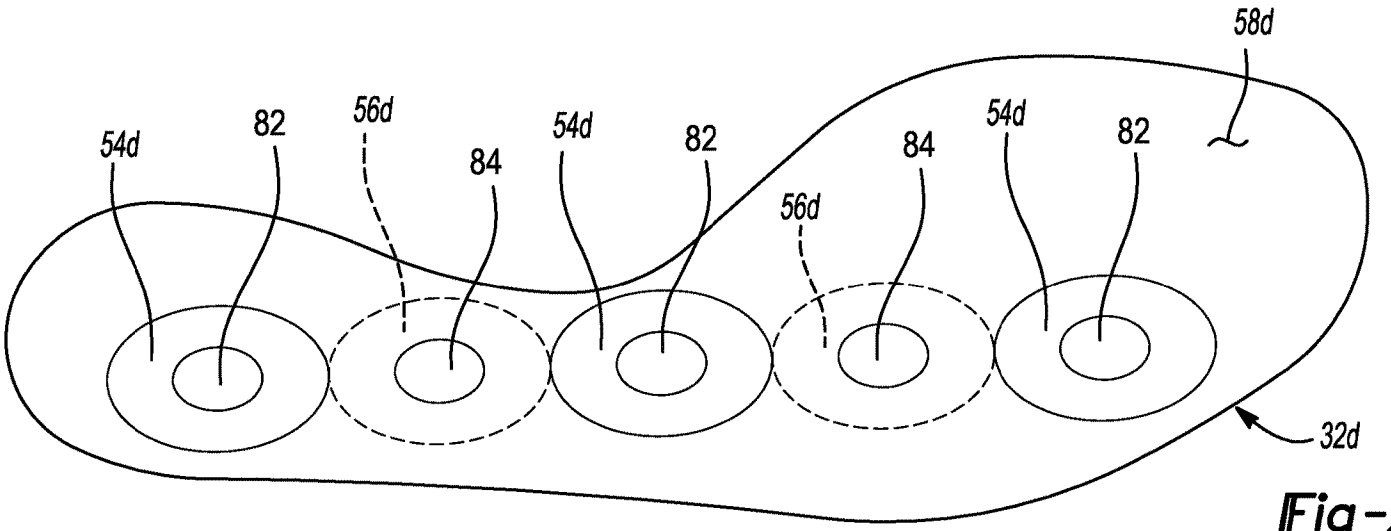
FIG. 28 is a top view of the midsole of FIG. 27.
Figure 29:
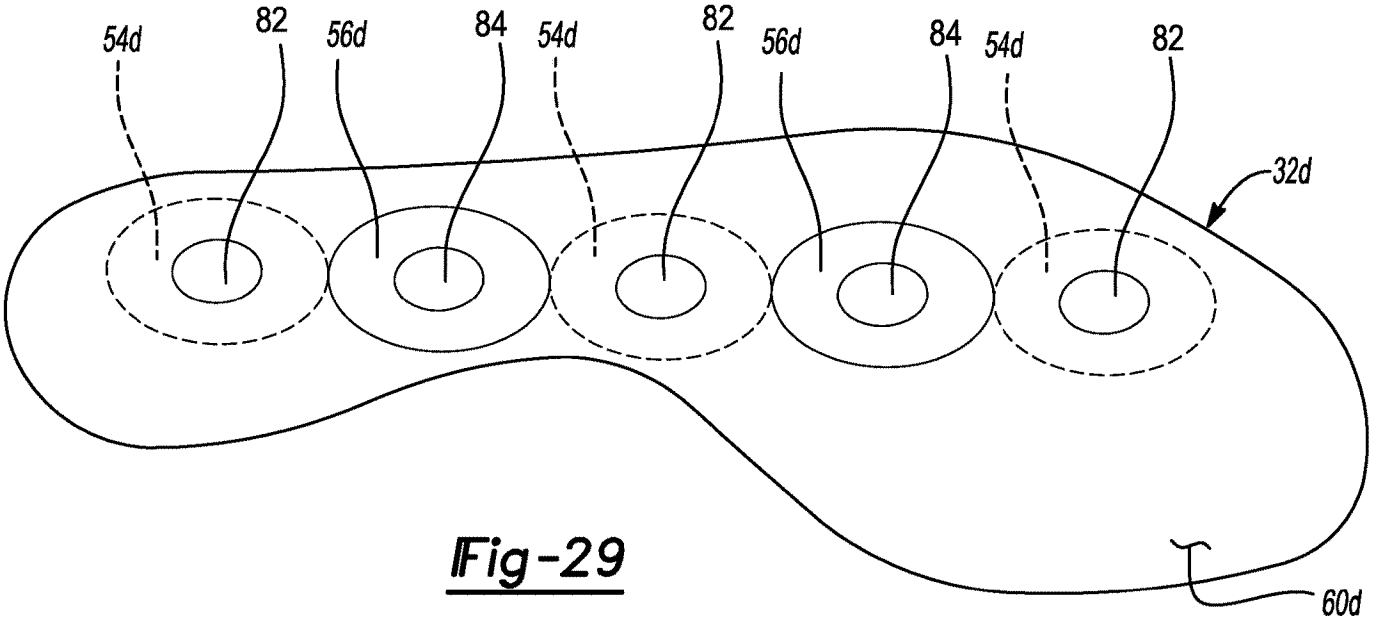
FIG. 29 is a bottom view of the midsole of FIG. 27.
Figure 30:
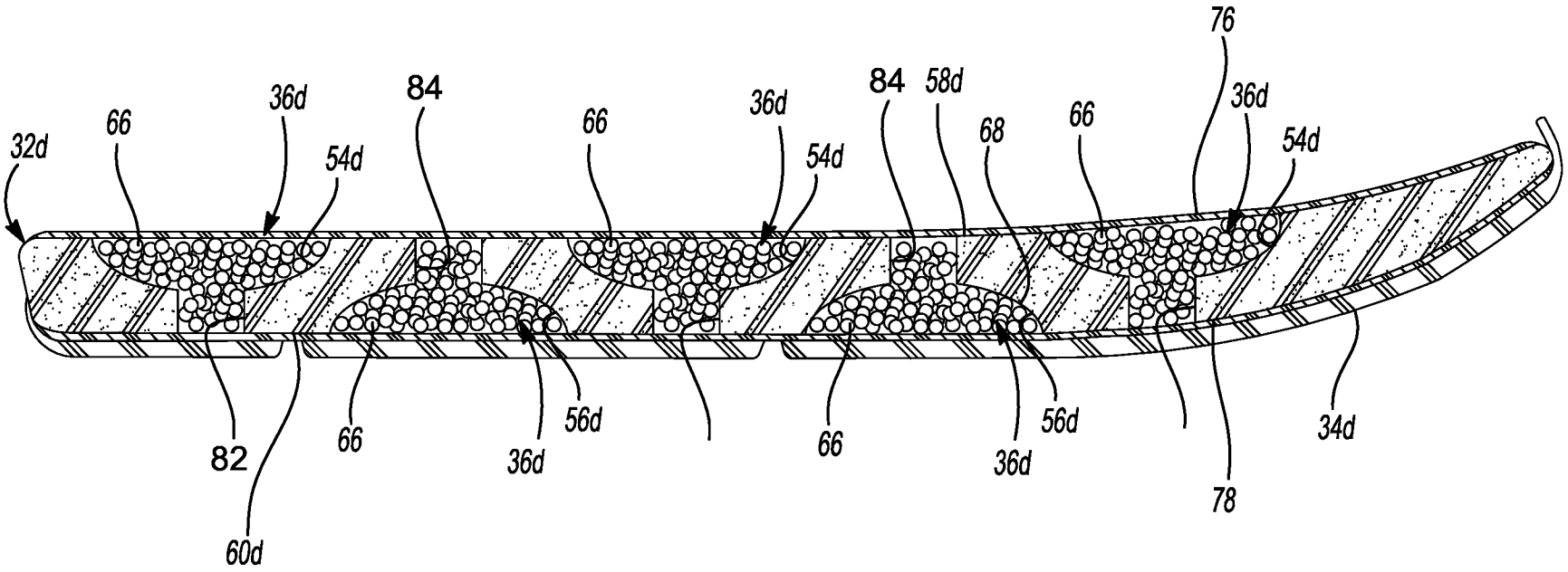
FIG. 30 is a partial cross-sectional view of the article of footwear of FIG. 25 taken along Line 30-30 of FIG. 25.
Figure 31:
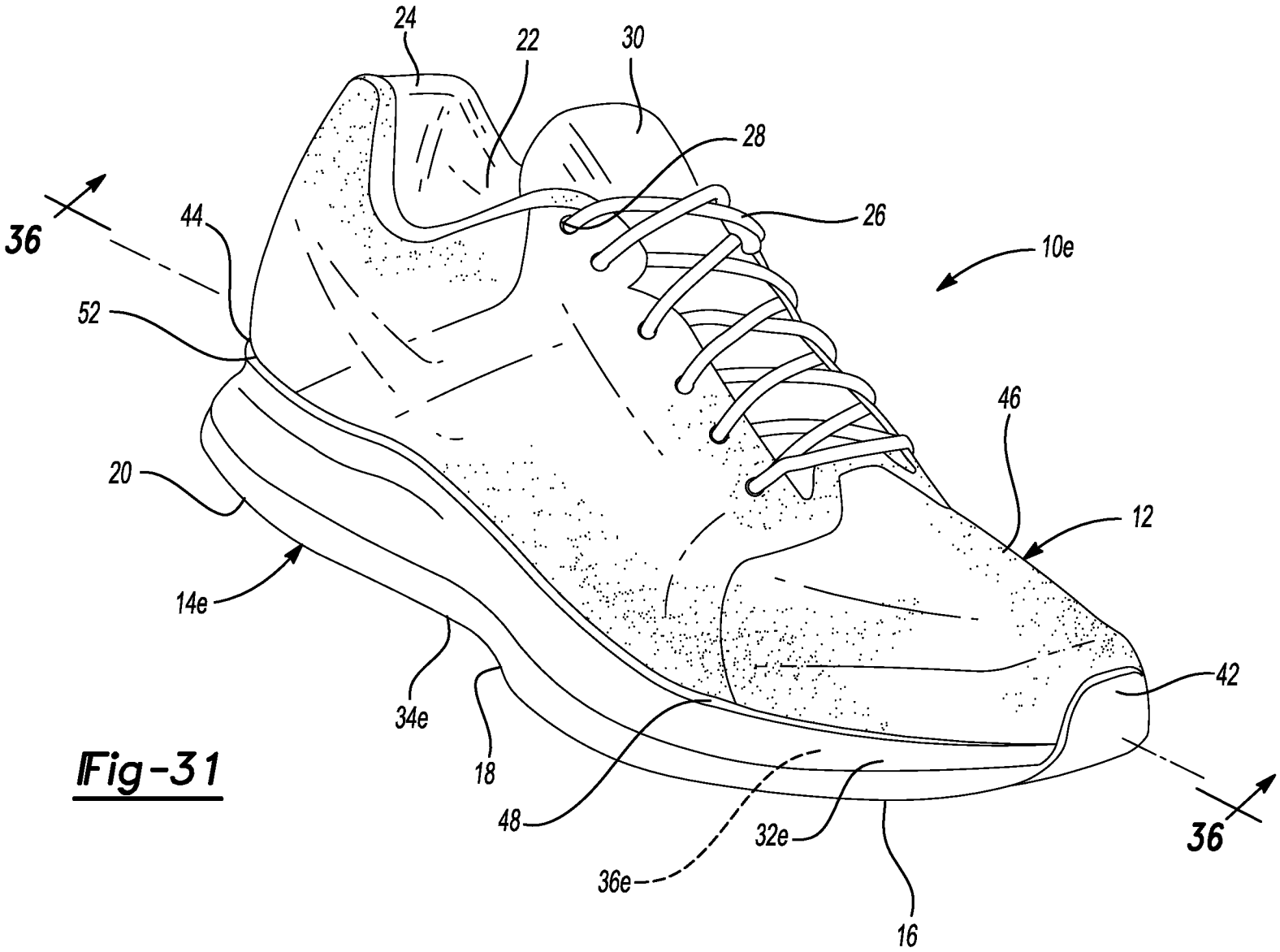
FIG. 31 is a perspective view of an article of footwear in accordance with the principles of the present disclosure.
Figure 32:
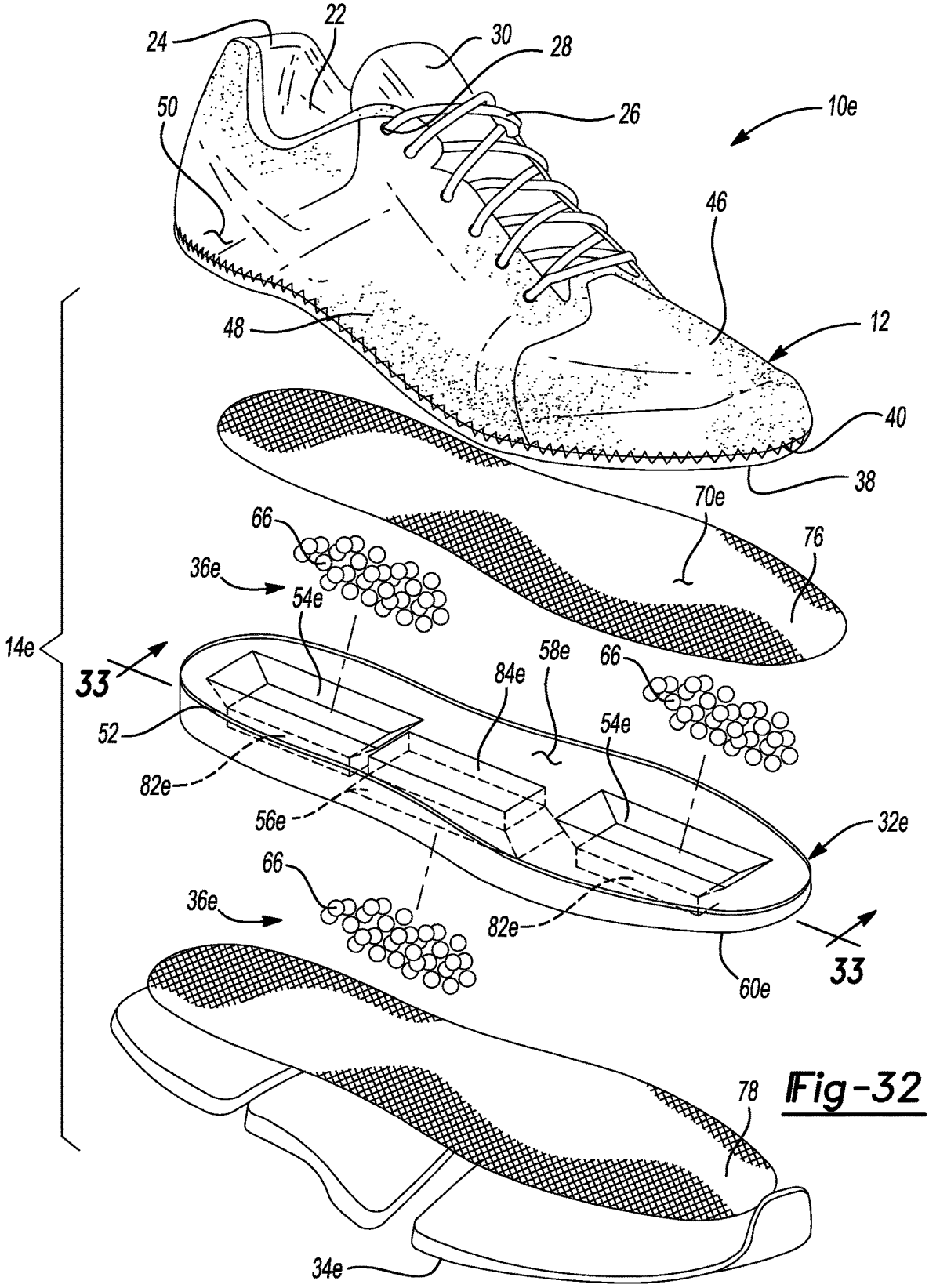
FIG. 32 is an exploded view of the article of footwear of FIG. 31.

The plurality of first cavities 54*d* alternate with the plurality of second cavities 56*b* along a length of the midsole 32*d*. As such, the plurality of first cavities 54*d* are nested with the plurality of second cavities 56*d*, as shown in FIG. 27. In one configuration, the plurality of first cavities 54*d* may include the same shape as the plurality of second cavities 58*d* including the combined shape of the cavities 54*d*, 56*d* with the respective passageways 82, 84. Accordingly, the plurality of second cavities 56*d* may be inverted relative to the plurality of first cavities 54*d*. As shown in FIGS. 28 and 29, edges of the first cavities 54*d* may be vertically aligned with edges of the second cavities 56*d* such that a gap does not exist between edges of the first cavities 54*d* and edges of adjacent second cavities 56*d* when the midsole 32*d* is viewed from the top (FIG. 28) or from the bottom (FIG. 29). While a gap does not exist between adjacent cavities 54*d*, 56*d*, a gap 74 could exist between one or more adjacent cavities 54*d*, 56*d* in a similar fashion as described above with respect to the midsole 32*a*

Providing the first cavities 54*d* with passageways 82 and providing the second cavities 56 with passageways 84 allows the cavities 54*d*, 56*d* as well as the passageways 82, 84 to be filled with particulate matter 66 from either side of the midsole 32*d*. Namely, each of the cavities 54*d*, 56*d* and each of the passageways 82, 84 may be filled with particulate matter 66 from either the first surface 58*d* or the second surface 60*d*. For example, the second barrier member 78 may be attached to the second surface 60*d* prior to filling any of the cavities 54*d*, 56*d* or the passageways 82, 84 with particulate matter 66. Once the second barrier member 78 is attached to the second surface 60*d* of the midsole 32*d*, particulate matter 66 may be inserted into the first cavities 54*d* directly at the first surface 58*d* and may be inserted into the second cavities 56*d* via the passageways 84 at the first surface 58*d*. Similarly, particulate matter 66 may be inserted into the passageways 82 of the first cavities 54*d* via the first cavities 54*d* at the first surface 58*d* and may be directly inserted into the passageways 84 at the first surface 58*d*.

While the particulate matter 66 is described as being inserted into the midsole 32*d* at the first surface 58*d*, the particulate matter 66 could alternatively be inserted into the midsole 32*d* at the second surface 60*d*. In such a configuration, the first barrier member 76 would be attached to the first surface 58*d* prior to inserting any particulate matter 66 into any of the cavities 54*d*, 56*d* or the passageways 82, 84. Once the first barrier member 76 is attached to the first surface 58*d* of the midsole 32*d*, particulate matter 66 may be directly inserted into the second cavities 56*d* and directly inserted into the passageways 82 at the second surface 60*d*. The particulate matter 66 may be inserted into the first cavities 54*d* via the passageways 82 and may be directly inserted into the second cavities 56*d* at the second surface 60*d*.

If the particulate matter 66 is inserted into the midsole 32*d* at the first surface 58*d*, the first barrier member 76 may be subsequently attached to the first surface 58*d* after the particulate matter 66 is disposed within the cavities 54*d*, 56*d* and the passageways 82, 84. If the particulate matter 66 is inserted into the midsole 32*d* at the second surface 60*d*, the second barrier member 78 may subsequently be attached to the second surface 60*d* of the midsole 32*d* after the particulate matter 66 is received by the cavities 54*d*, 56*d* and the passageways 82, 84.

Once the barrier members 76, 78 are attached to the midsole 32*d* and the particulate matter 66 is received by the cavities 54*d*, 56*d* and the passageways 82, 84, the first barrier member 76 may be attached to the lower substrate 38 of the upper 12 and the second barrier member 78 may be attached to the outsole 34*d* in a similar fashion as described above with respect to the article of footwear 10*c*. Once the midsole 32*d* is attached to the upper 12 and is attached to the outsole portions of the outsole 34*d*, the midsole 32*d* and, thus, the particulate matter 66 is disposed within the cavities 54*d*, 56*d* and the passageways 82, 84 is positioned in a predetermined location relative to the forefoot portion 16, the midfoot portion 18, and the heel portion 20 of the upper 12 and, as such, provides a degree of cushioning during use of the article of footwear 10*d*.

Providing the cavities 54*d*, 56*d* with passageways 82, 84, respectively, provides the midsole 32*d* with increased particulate matter 66 relative to the midsoles 32, 32*a*, 32*b*, 32*c*. Additionally, providing each cavity 54*d*, 56*d* with a respective passageway 82, 84 allows the midsole 32*d* to be filled with particulate matter 66 from one or both of the first surface 58*d* and the second surface 60*d*, thereby providing flexibility in manufacturing the midsole 32*d* and, thus, the article of footwear 10*d*. Further, allowing the passageways 82 associated with the first cavities 54*d* to extend to the second surface 60*d* of the midsole 32*d* provides for additional exposure of the particulate matter 66 at the outsole 32*d* should the portions of the outsole 34*d* be formed from a translucent or transparent material. As such, allowing the passageways 82 associated with the first cavities 54*d* to extend to the second surface 60*d* of the midsole 32*d* enhances the overall aesthetics of the sole structure 14*d*.

With particular reference to FIGS. 31-36 an article of footwear 10*e* is provided and includes an upper 12 and a sole structure 14*e* attached to the upper 12. In view of the substantial similarity in structure and function of the components associated with the article of footwear 10 with respect to the article of footwear 10*e*, like reference numerals are used hereinafter and in the drawings to identify like components while like reference numerals containing letter extensions are used to identify those components that have been modified.

Figure 36:
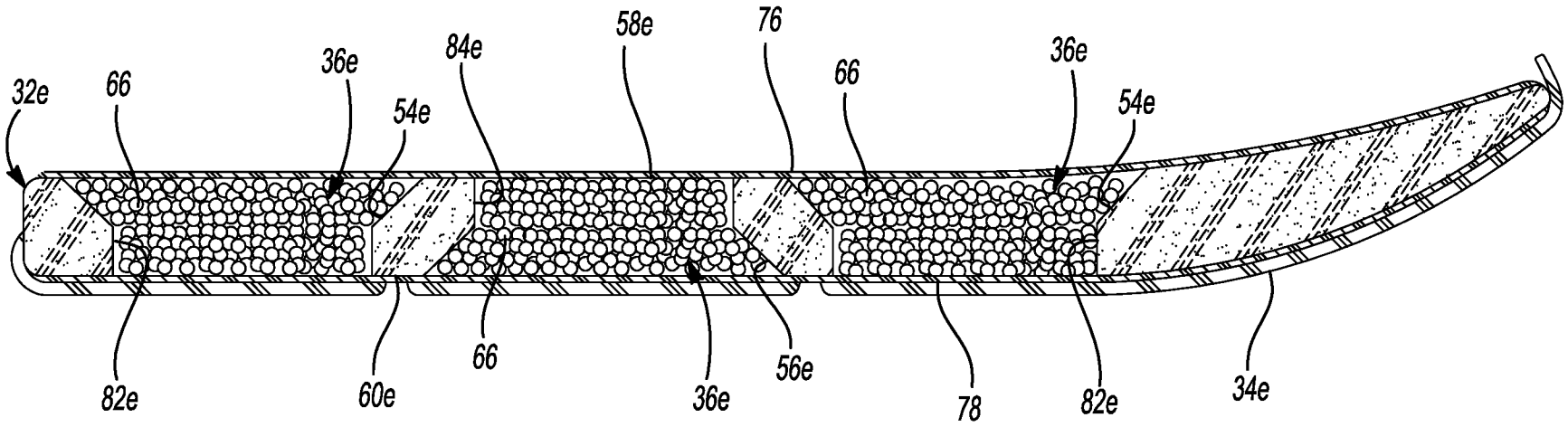
FIG. 36 is a partial cross-sectional view of the article of footwear of FIG. 31 taken along Line 36-36 of FIG. 31.
Figure 37:
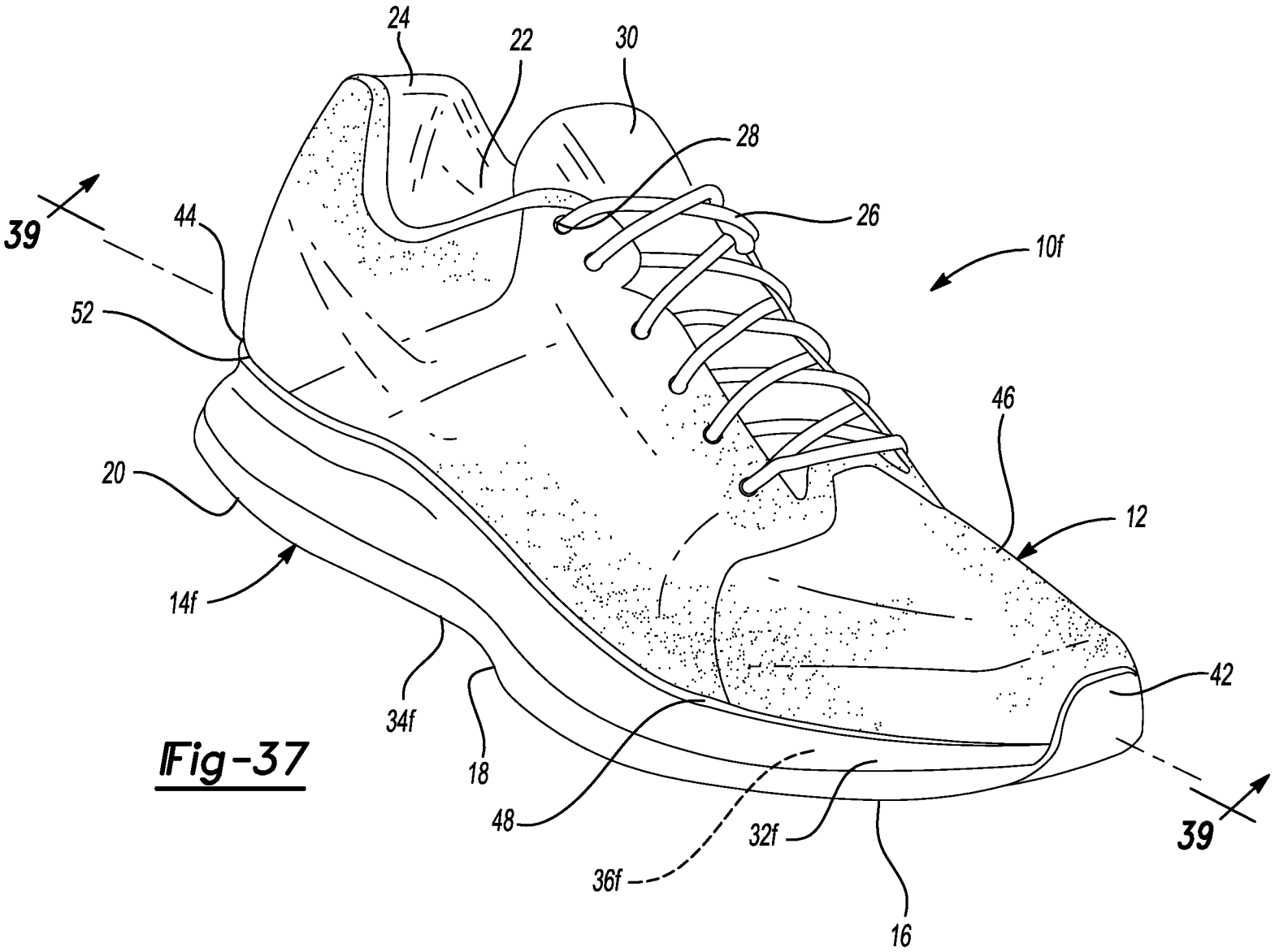
FIG. 37 is a perspective view of an article of footwear in accordance with the principles of the present disclosure.
Figure 38:
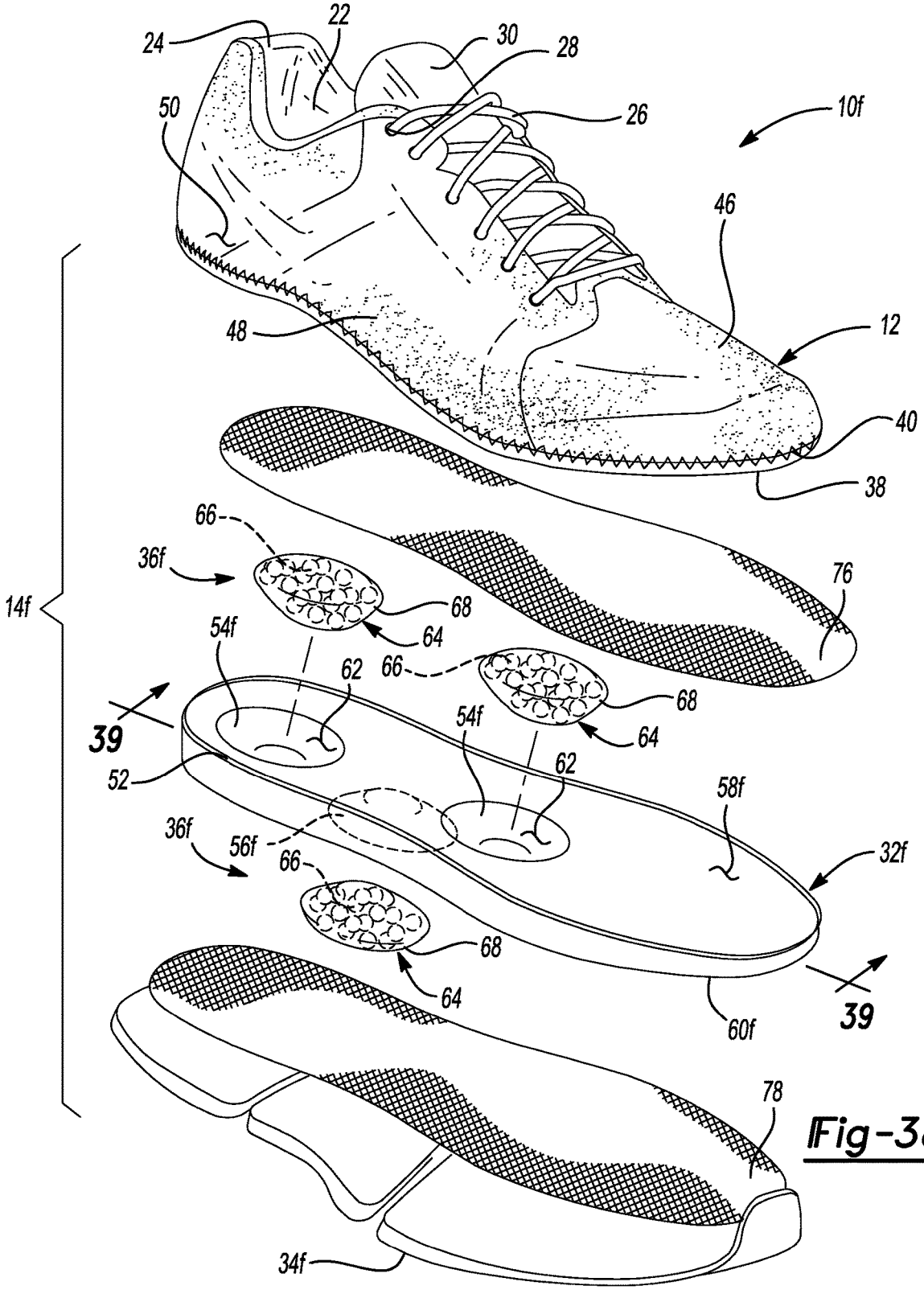
FIG. 38 is an exploded view of the article of footwear of FIG. 37.

The article of footwear 10*e* is virtually identical to the article of footwear 10*b* with the exception of the midsole 32*e*, the outsole 34*e*, and the cushioning member 36*e*. Namely, the midsole 32*e* includes a plurality of first cavities 54*e* and a second cavity 56*e* disposed on an opposite side of the midsole 32*e* than the cavities 54*e*. As with the midsole 32*b*, the first cavities 54*e* and the second cavity 56*e* alternate with one another along a length of the midsole 32*e* and include a substantially trapezoidal shape. As such, the cavities 54*e* taper in a direction from the first surface 58*e* toward the second surface 60*e* and the second cavity 56*e* tapers in a direction from the second surface 60*e* toward the first surface 58*e*. As shown in FIG. 36, the second cavity 56*e* nests between the first cavities 54*e* and is aligned with the first cavities 54*e* in a direction extending along a longitudinal access of the midsole 32*e*.

Figure 33:
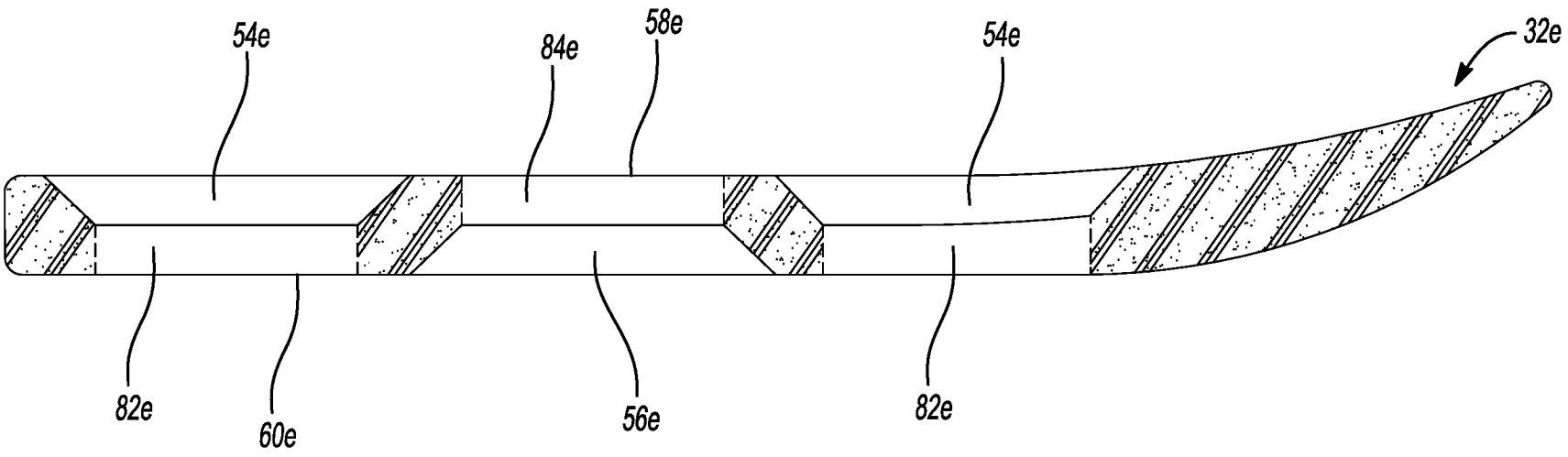
FIG. 33 is a cross-sectional view of a midsole of the article of footwear of FIG. 31 taken along Line 33-33 of FIG. 32.
Figure 34:
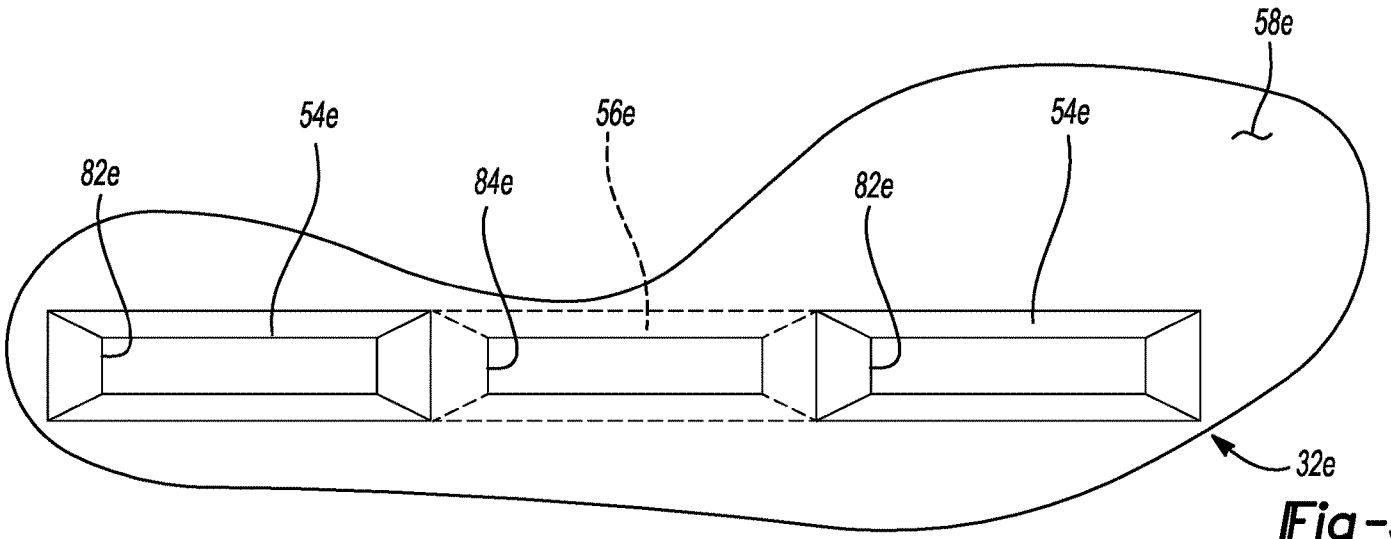
FIG. 34 is a top view of the midsole of FIG. 33.
Figure 35:
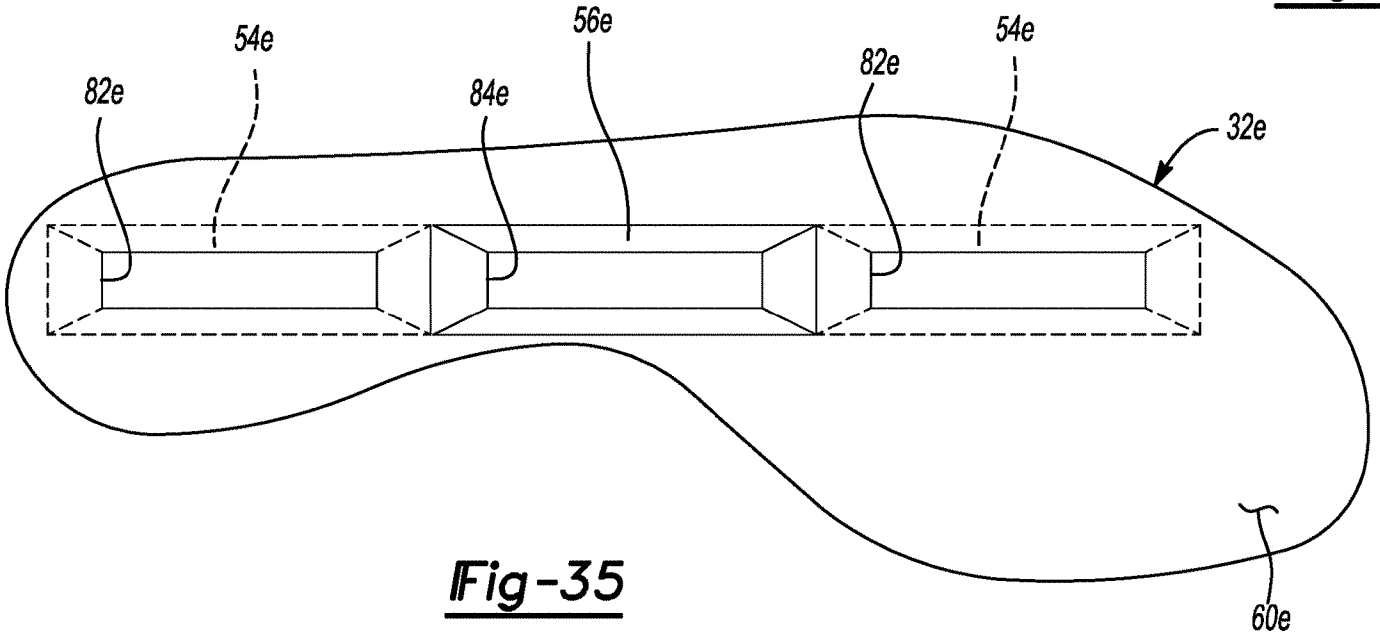
FIG. 35 is a bottom view of the midsole of FIG. 33.

With reference to FIGS. 34 and 35, edges of the cavities 54*e* are aligned with and disposed adjacent to opposite edges of the second cavity 56*e* when the midsole 52*e* is viewed from the top (FIG. 34) and when the midsole 32*e* is viewed from the bottom (FIG. 35). While edges of the first cavities 54*e* are aligned with opposite edges of the second cavity 56*e* in a direction extending along a length of the midsole 32*e*, the cavities 54*e*, 56*e* are spaced apart from one another by a material of the midsole 32*e*, as shown in FIG. 33. Namely, while the edges of the first cavities 54*e* may be aligned with opposite edges of the second cavity 56*e* in a vertical direction extending between the first surface 58*e* and the second surface 60*e*, the cavities 54*e* are spaced apart and separated from the cavity 56*e*. While the cavities 54*e*, 56*e* are described and shown as being aligned, the cavities 54*e*, 56*e* could alternatively be spaced apart from one another in a longitudinal direction of the midsole 32*e* by a gap 80 in a similar fashion as described above with respect to the midsole 32*c*.

In one configuration, the first cavities 54*e* include the same shape as the second cavity 56*e*. As such, the second cavity 56*e* is inverted relative to the first cavities 54*e* as the second cavity 56*e* is disposed on an opposite side of the midsole 32*e* than the first cavities 54*e*.

The first cavities 54*e* each include a first passageway 82*e* extending from each cavity 54 to the second surface 60*e*. Likewise, the second cavity 56 includes a second passageway 84*e* that extends from the second cavity 56*e* to the first surface 58*e*. The passageways 82*e* are in fluid communication with respective ones of the first cavities 54*e* and the passageway 84*e* is in fluid communication with the second cavity 56*e*. Accordingly, the passageways 82*e* cooperate with respective ones of the first cavities 54*e* to extend through a thickness of the midsole 32*e*. Likewise, the passageway 84*e* cooperates with the second cavity 56*e* to extend through the thickness of the midsole 32*e*. Accordingly, the midsole 32*e* may be filled with particulate matter 66 at the first cavities 54*e* and at the second cavities 56*e* from either side of the midsole 32*e* in a similar fashion as described above with respect to the midsole 32*d* of the sole structure 14*d*. Namely, the particulate matter 66 may be inserted into the cavities 54*e*, 56*e* from either the first surface 58*e* or the second surface 60*e*.

The midsole 32*e* may receive particulate matter 66 at either the first surface 58*e* or the second surface 60*e* by placing a first barrier member 76 over the first surface 58*e* or by placing a second barrier member 78 over the second surface 60*e*. For example, the first barrier member 76 may be attached to the first surface 58*e* such that the first barrier member 76 covers the first cavities 54*e* and the second passageway 84*e*. The first barrier member 76 may be attached to the first surface 58 via a suitable adhesive and, as such, may close the first cavities 54*e* and the second passageway 84*e* at the first surface 58*e*.

Once the first barrier member 76 is attached to the first surface 58*e* of the midsole 32*e*, particulate matter 66 may be inserted into the first cavities 54*e* at the second surface 60*e* via the first passageways 82 and may be inserted directly into the second cavity 56*e* at the second surface 60*e*. In so doing, particulate matter 66 is received by the second passageway 84 via the second cavity 56*e*. Once a predetermined amount of particulate matter 66 is received by each cavity 54*e*, 56*e* and each passageways 82*e*, 84*e*, the second barrier member 78 may be attached to the second surface 60*e* via a suitable adhesive. Attaching the second barrier member 78 to the second surface 60*e* of the midsole 32*e* covers the second cavity 56*e* and the first passageways 82*e*. In so doing, the second barrier member 78 cooperates with the first barrier member 76 to contain the particulate matter 66 within each cavity 54*e*, 56*e* and within each passageway 82*e*, 84*e*.

While the midsole 32*e* is described as first receiving the first barrier member 76 to allow particulate matter 66 to be inserted into the cavities 54*e*, 56*e* and the passageways 82*e*, 84*e* at the second surface 60*e*, the midsole 32*e* could alternatively receive the second barrier member 78 to allow the particulate matter 66 to be inserted into the cavities 54*e*, 56*e* and the passageways 82*e*, 84*e* at the first surface 58*e*. If the second barrier member 78*e* is attached to the midsole 32*e* prior to attachment of the first barrier member 76 to the midsole 32*e*, the first barrier member 76 is subsequently attached to the first surface 58*e* following insertion of the particulate matter 66 into the cavities 54*e*, 56*e* and the passageways 82*e*, 84*e* in a similar fashion as described above.

Regardless of which barrier member 76, 78 is attached to the midsole 32*e* first, once the particulate matter 66 is disposed within the cavities 54*e*, 56*e* and the passageways 82*e*, 84*e* and both barrier members 76, 78 are attached to the midsole 32*e*, the midsole 32*e* may be attached to the upper 12 and to the outsole 34*e*. Namely, the first barrier member 76 may be attached to the lower substrate 38 of the upper 12 via a suitable adhesive. Likewise, the second barrier member 78 may be attached to the portions of the outsole 34*e* to provide the sole structure 14*e* and, thus, the article of footwear 10*e* with abrasion resistance and traction during use. As described above, one or more of the portions of the outsole 34*e* may be formed from a transparent or translucent material to allow the particulate matter 66 disposed within the second cavity 56 and within the first passageways 82 to be visible at the outsole 34.

As described, providing the midsole 32*e* with cavities 54*e*, 56*e* that cooperate with respective passageways 82*e*, 84*e* to provide voids that extend through an entire thickness of the midsole 32*e* allows the particulate matter 66 to be inserted into the midsole 32*e* at either the first surface 58*e* or the second surface 60*e*. In so doing, manufacturing of the midsole 32*e* and, thus, the sole structure 14*e* is simplified, as the particulate matter 66 may be inserted into the midsole 32*e* at either surface 58*e*, 60*e*.

As with the sole structures 14, 14*a*, 14*b*, 14*c*, 14*d*, providing the sole structure 14*e* with a midsole 32*e* containing particulate matter 66 within the cavities 54*e*, 56*e* provides the sole structure 14*e* and, thus, the article of footwear 10*e* with increased cushioning during use. Further, the particulate matter 66 provides a degree of adaptive cushioning by allowing the particulate matter to move relative to and within the cavities 54*e*, 56*e* and the passageways 82*e*, 84*e* under an applied load. As such, the sole structure 14*e* provides additional cushioning relative to the cushioning provided by the material forming the midsole 32*e* and, therefore, enhances the comfort of the sole structure 14*e* during use.

With particular reference to FIGS. 37-40, an article of footwear 10*f* is provided and includes an upper 12 and a sole structure 14*f* attached to the upper 12. In view of the substantial similarity in structure and function of the components associated with the article of footwear 10 with respect to the article of footwear 10*f*, like reference numerals are used hereinafter and in the drawings to identify like components while like reference numerals containing letter extensions are used to identify those components that have been modified.

Figure 39:
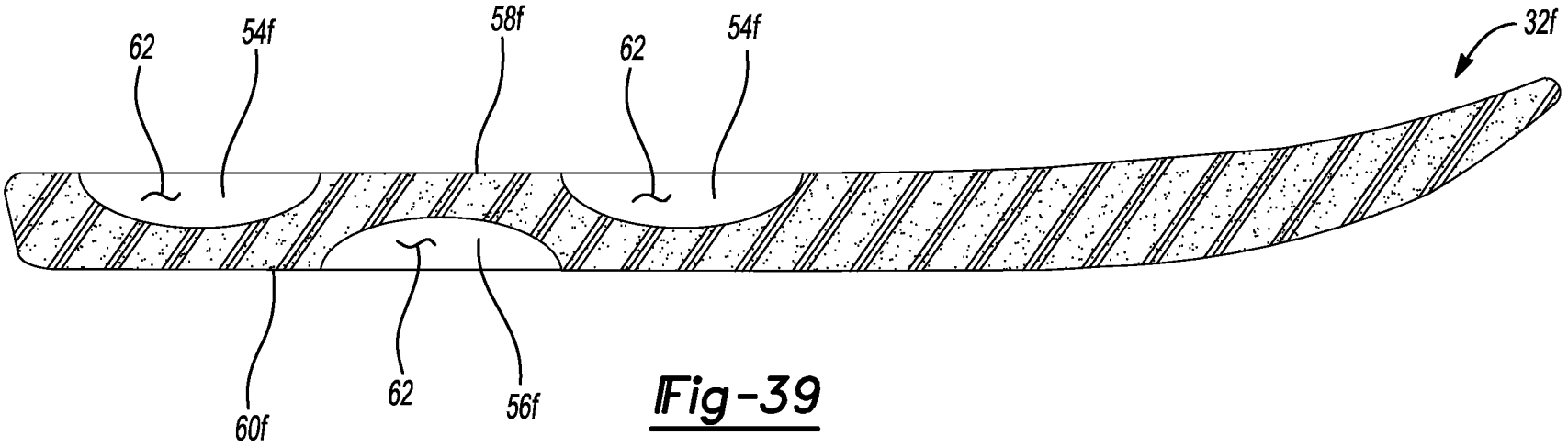
FIG. 39 is a cross-sectional view of a midsole of the article of footwear of FIG. 37 taken along Line 39-39 of FIG. 38.
Figure 40:
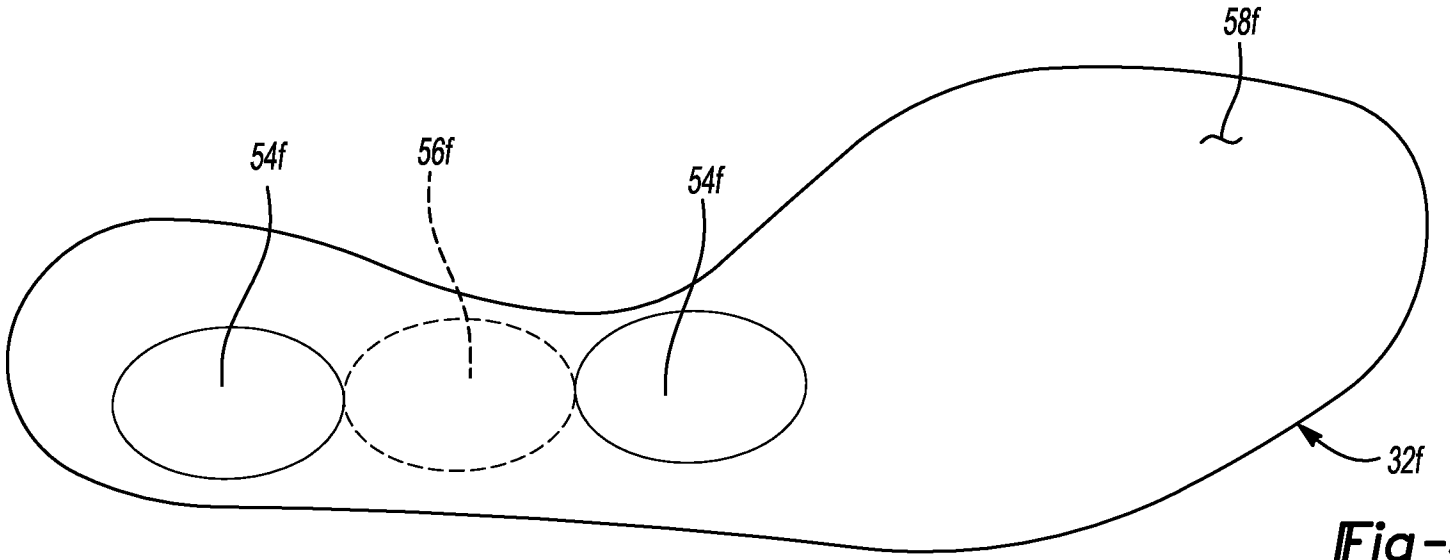
FIG. 40 is a top view of the midsole of FIG. 39.
Figure 41:
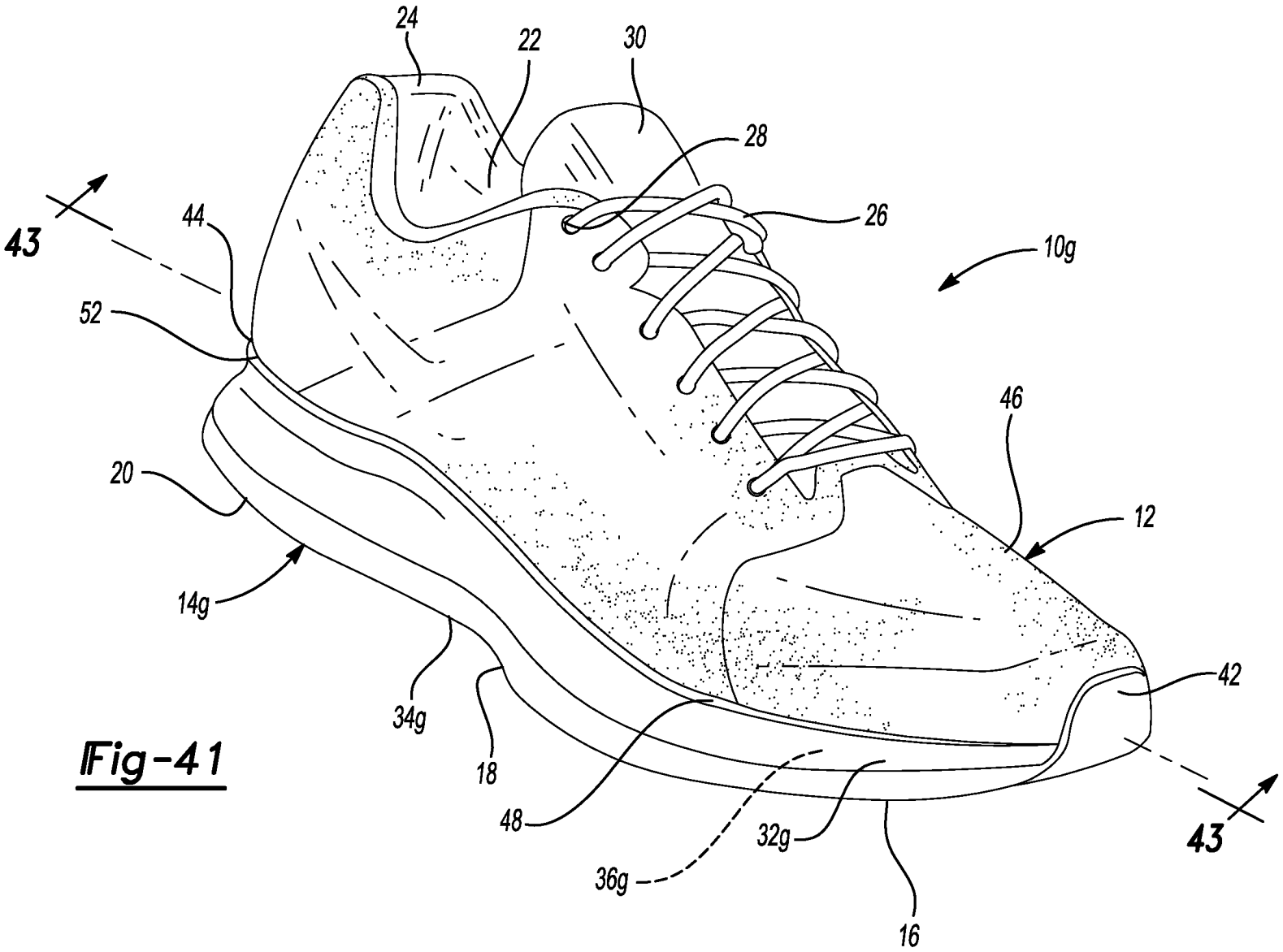
FIG. 41 is a perspective view of an article of footwear in accordance with the principles of the present disclosure.
Figure 42:
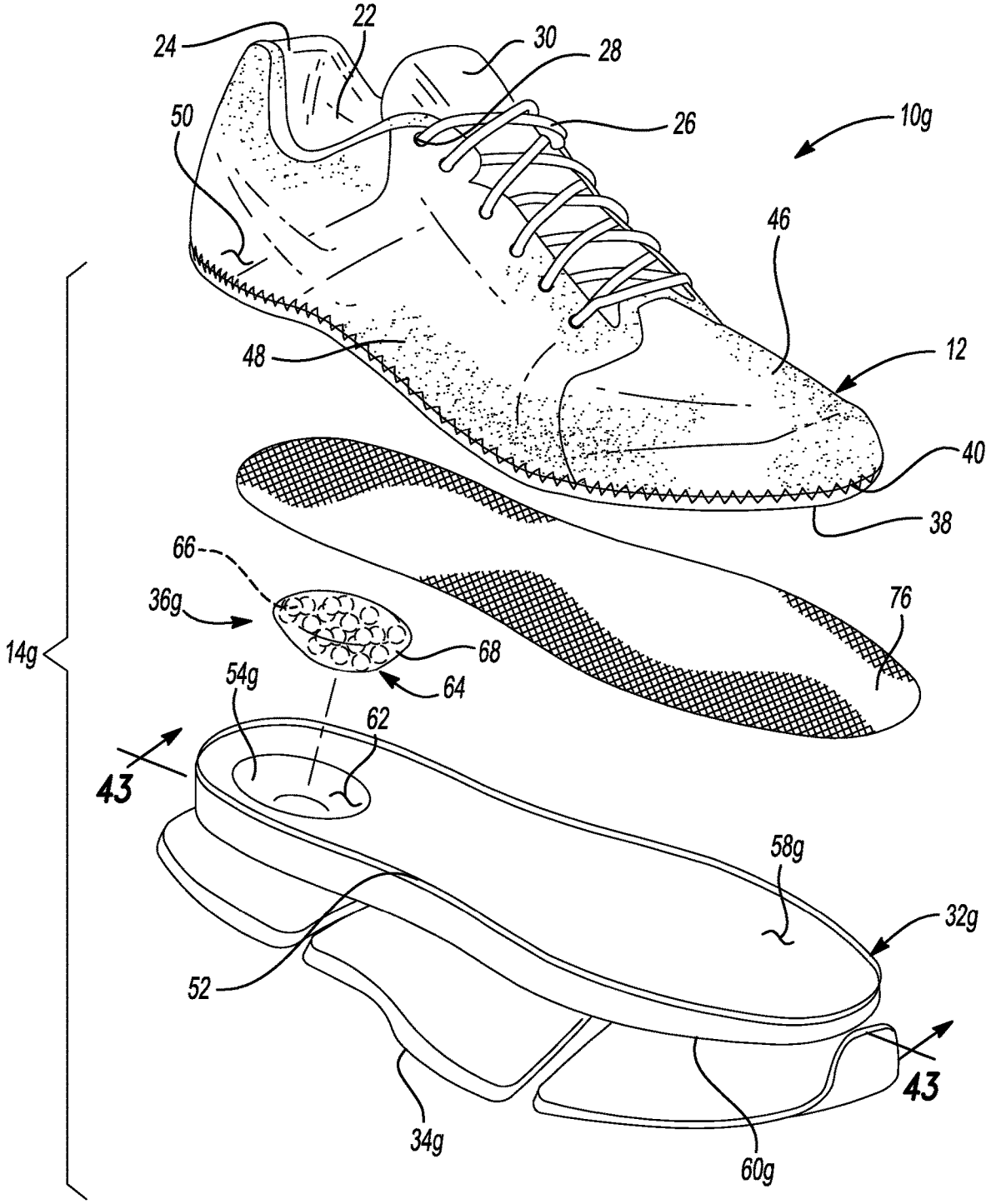
FIG. 42 is an exploded view of the article of footwear of FIG. 41.
Figure 43:
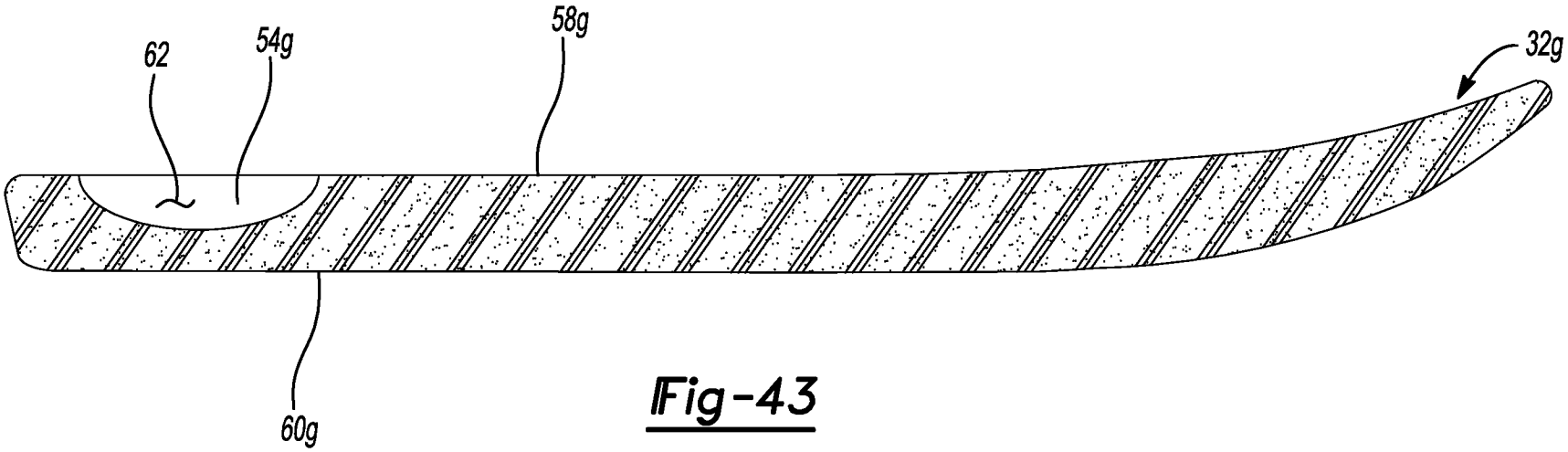
FIG. 43 is a cross-sectional view of a midsole of the article of footwear of FIG. 41 taken along Line 43-43 of FIG. 42.
Figure 44:
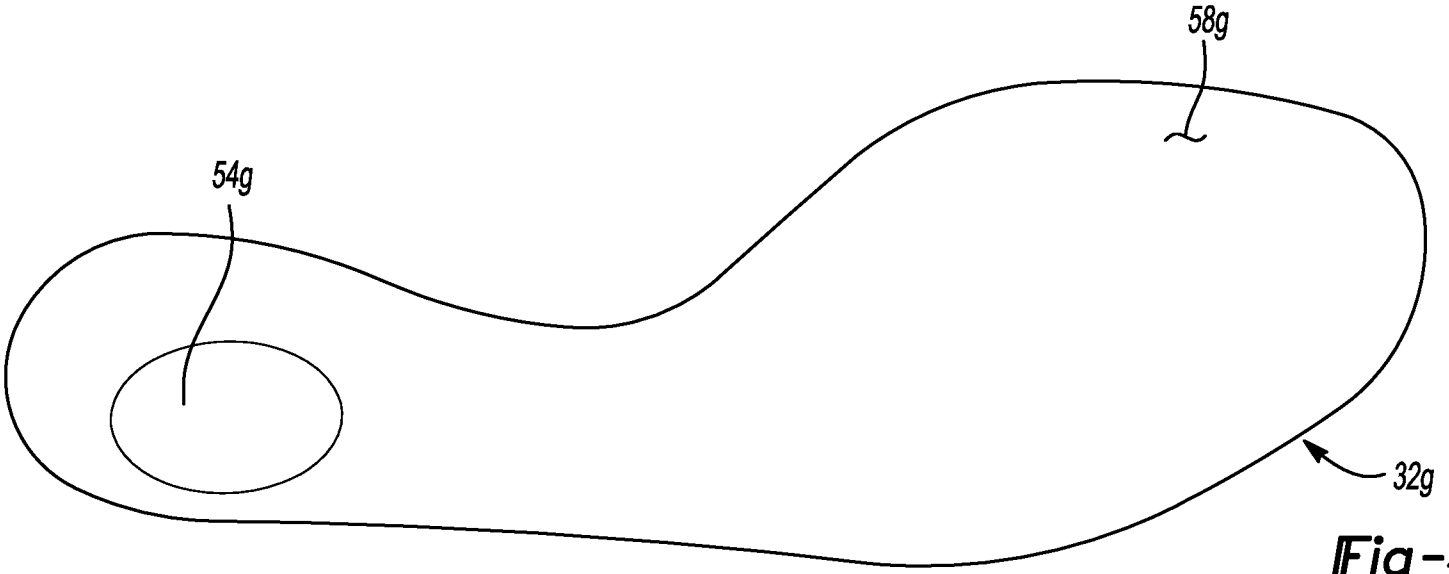
FIG. 44 is a top view of the midsole of FIG. 43.
Figure 45:
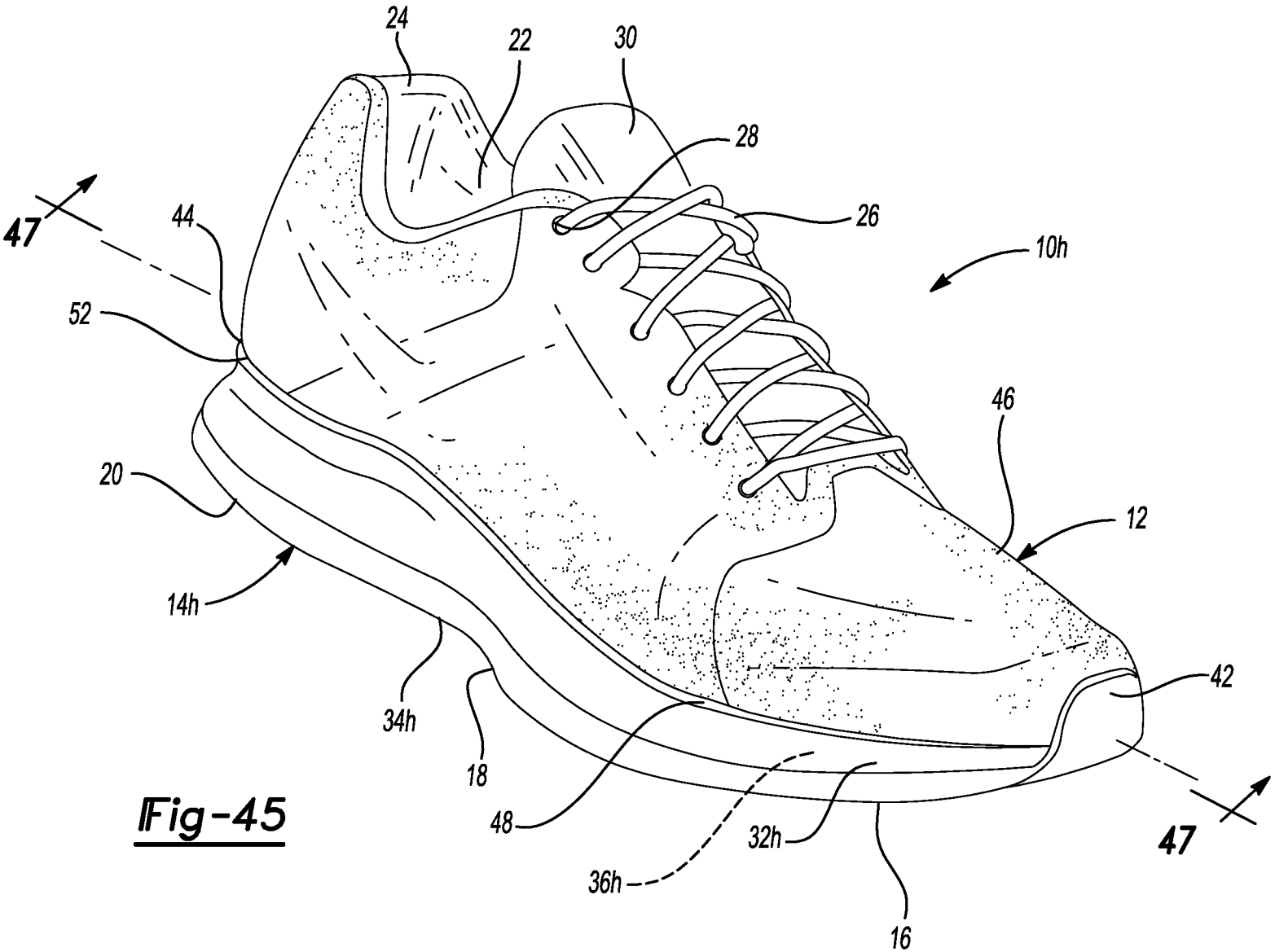
FIG. 45 is a perspective view of an article of footwear in accordance with the principles of the present disclosure.
Figure 46:
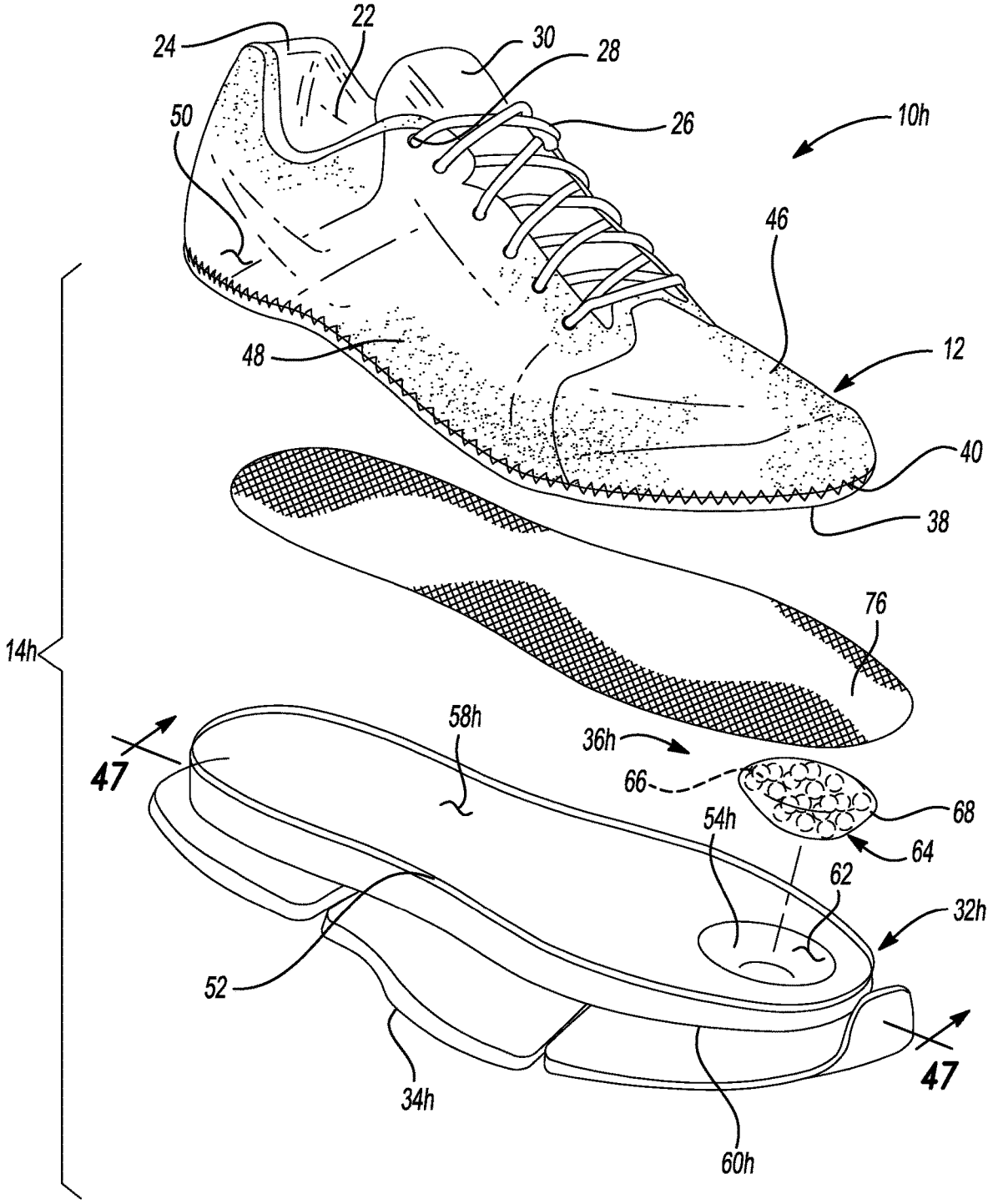
FIG. 46 is an exploded view of the article of footwear of FIG. 45.
Figure 47:
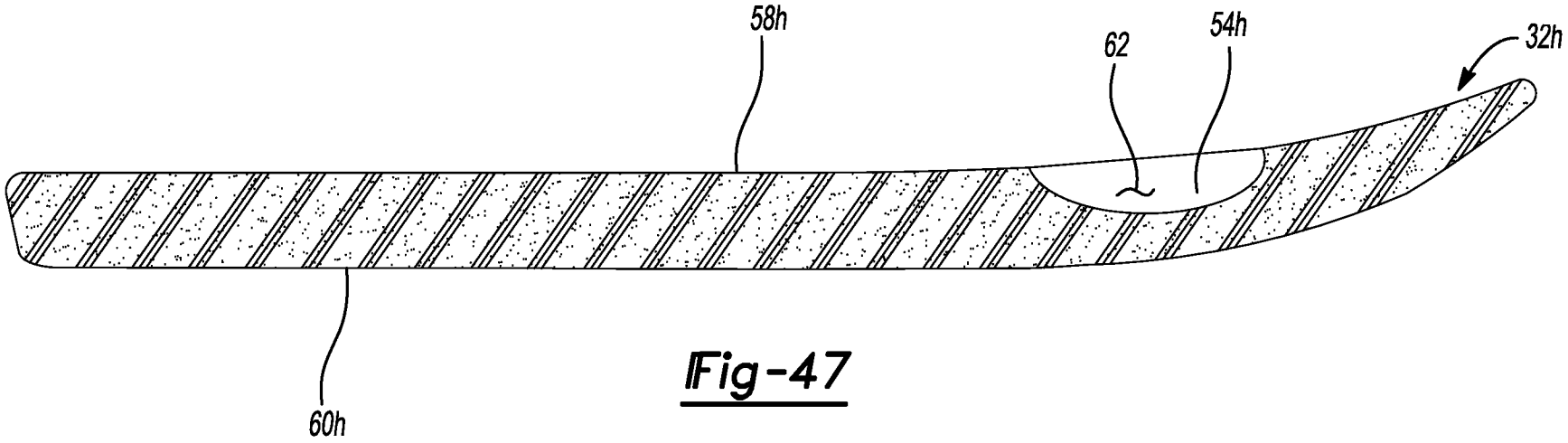
FIG. 47 is a cross-sectional view of a midsole of the article of footwear of FIG. 45 taken along Line 47-47 of FIG. 46.
Figure 48:
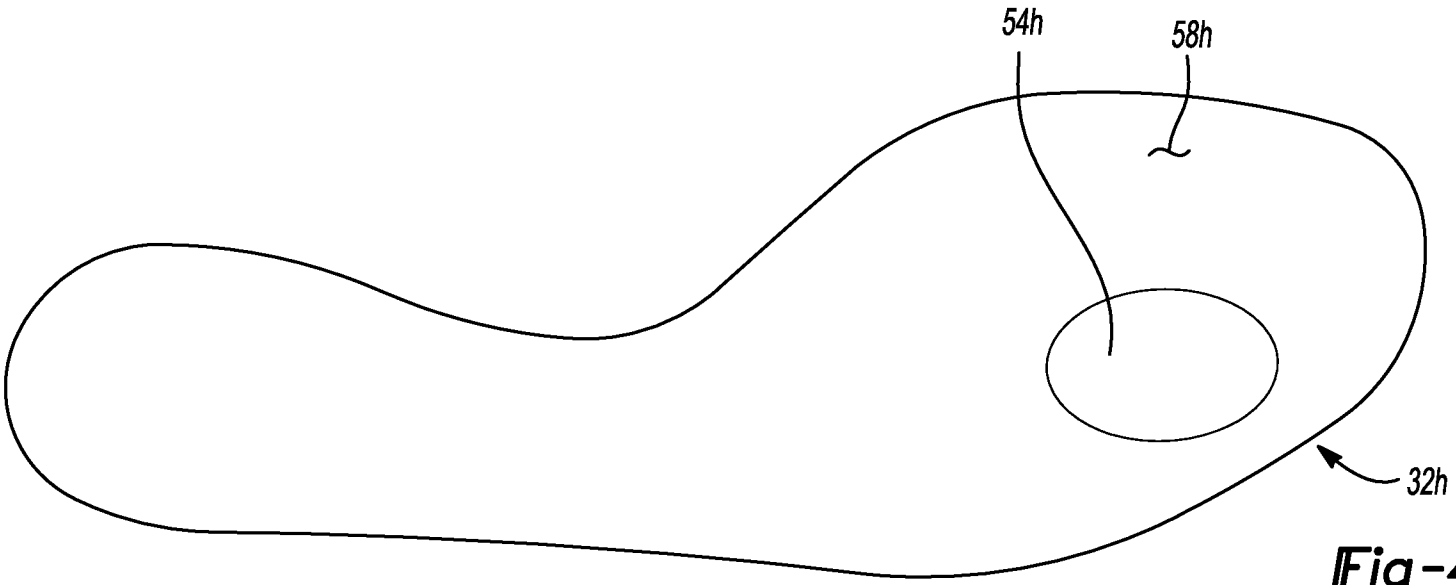
FIG. 48 is a top view of the midsole of FIG. 47.
Figure 49:
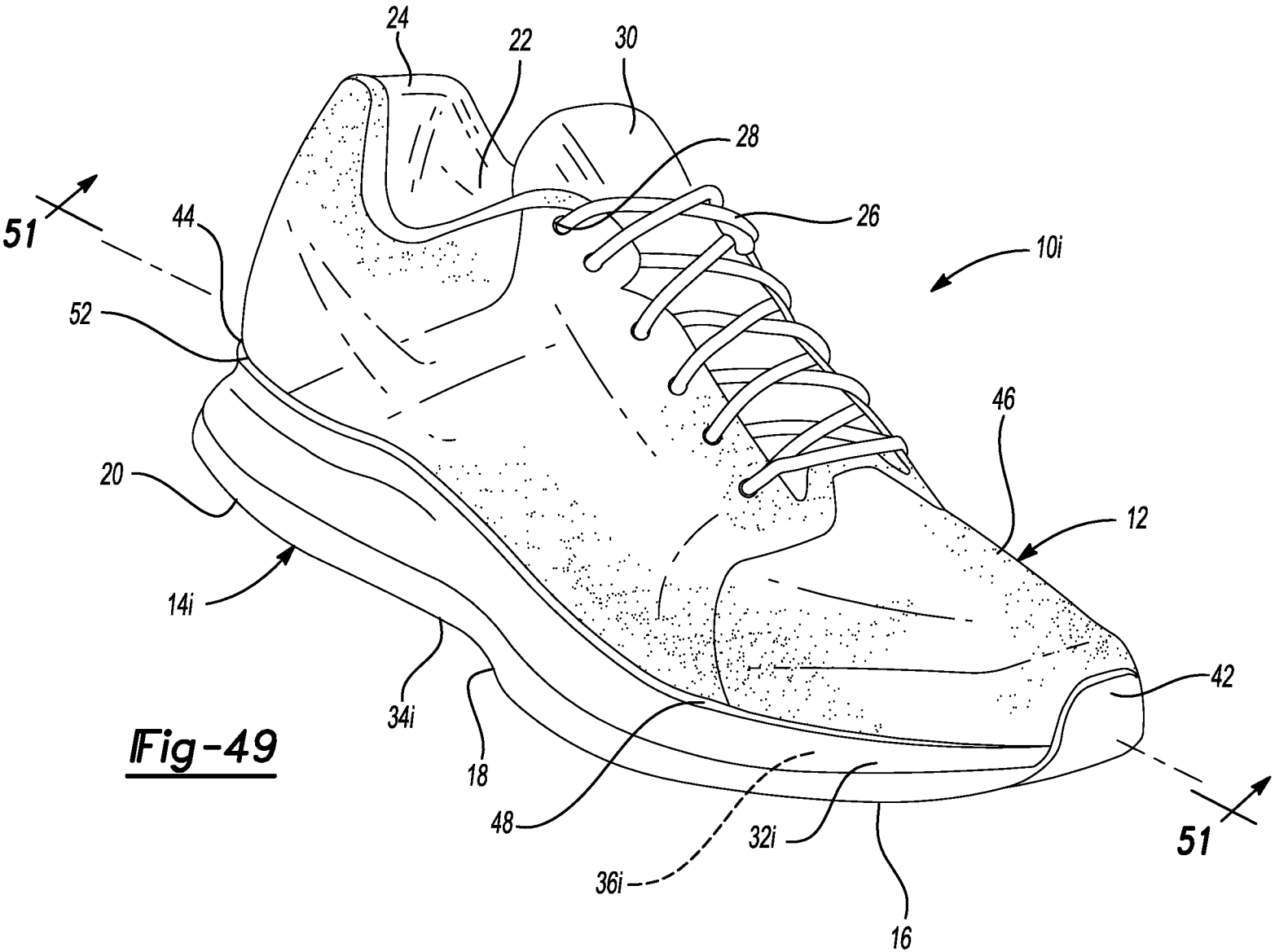
FIG. 49 is a perspective view of an article of footwear in accordance with the principles of the present disclosure.
Figure 50:
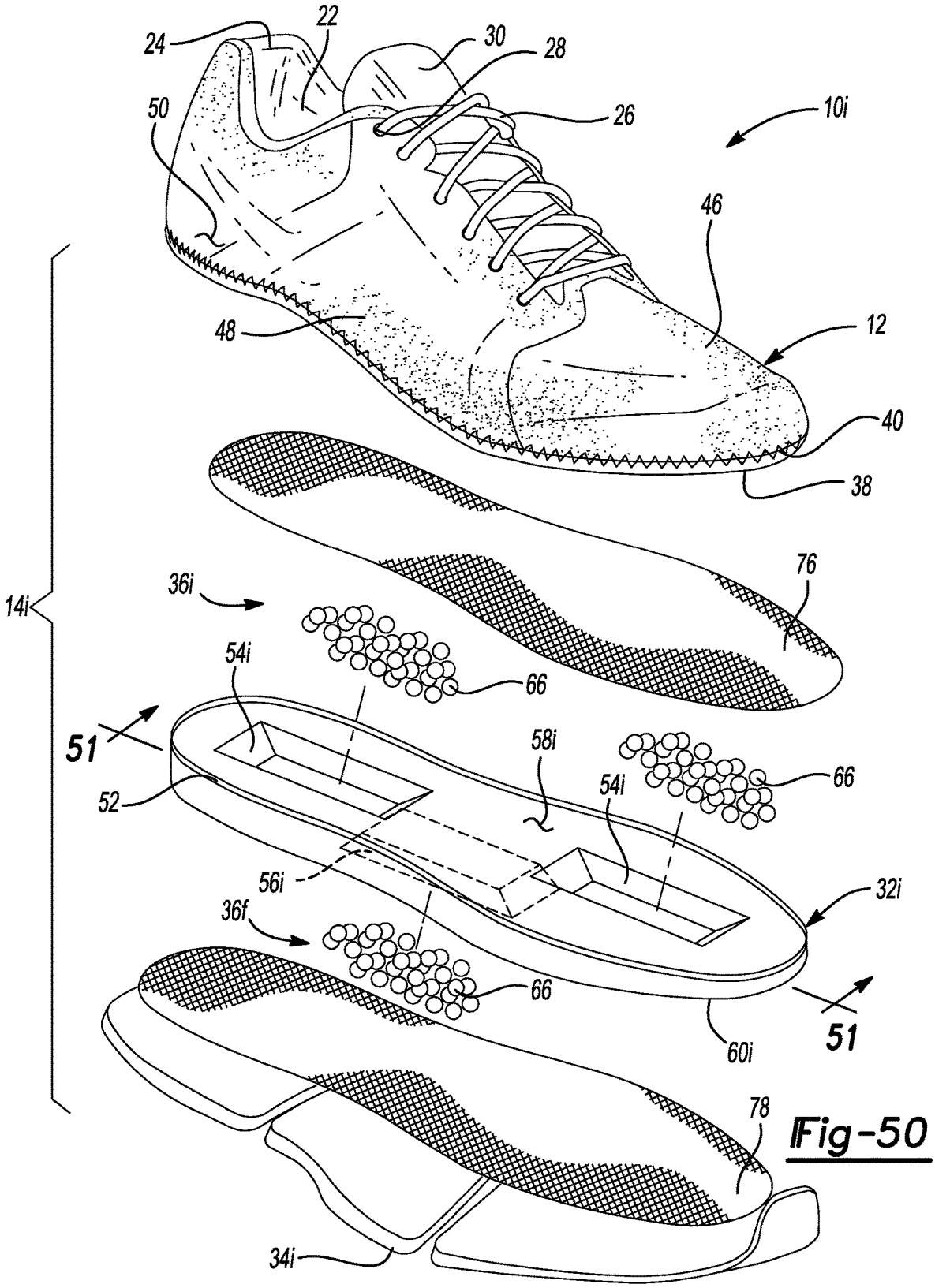
FIG. 50 is an exploded view of the article of footwear of FIG. 49.
Figure 51:
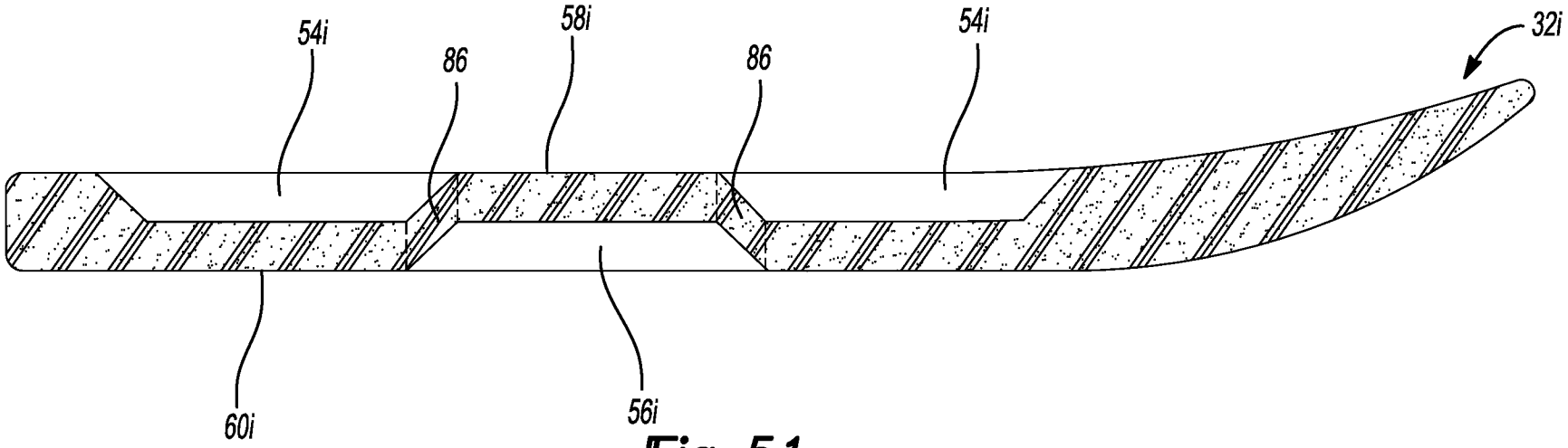
FIG. 51 is a cross-sectional view of a midsole of the article of footwear of FIG. 49 taken along Line 51-51 of FIG. 50.
Figure 52:
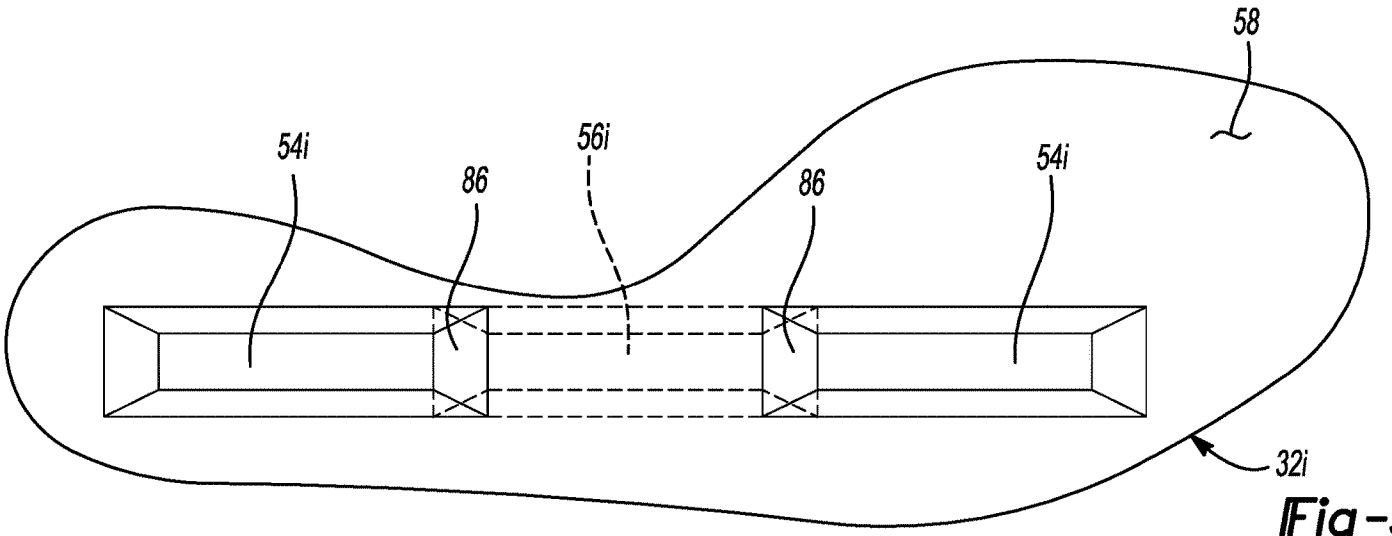
FIG. 52 is a top view of the midsole of FIG. 51.

The article of footwear 10*f* is virtually identical to the article of footwear 10 with the exception of the midsole 32*f*, the outsole 34*f*, and the cushioning member 36*f*. The midsole 32*f* differs from the midsole 32 in that the midsole 32*f* only includes cavities 54*f*, 56*f* in the heel portion 20 of the sole structure 14*f*, as shown in FIGS. 39 and 40. The cavities 54*f*, 56*g* each receive a barrier member 64 containing particulate matter 66 in a similar fashion as described above with respect to the sole structure 14. Providing the midsole 32*f* with a cushioning member 36*f* within the heel portion 20 of the sole structure 14*f* only provides particulate matter 66 in an area of the midsole 32*f* within the heel portion 20*f*. In so doing, the ability of the midsole 32*f* to absorb ground-reaction forces compared to the midsole 32 of the sole structure 14 is different and only provides adaptive cushioning via the particulate matter 66 within the heel portion 20. While the first cavities 54*f* are shown as being aligned with the second cavities 56*f* in a longitudinal direction of the midsole 32*f*, the first cavities 54*f* could alternatively be spaced apart and separated from the second cavity 56*f* by a gap 74 in a similar fashion as described and shown above with respect to the sole structure 14*a*.

With particular reference to FIGS. 41-44, an article of footwear 10*g* is provided and includes an upper 12 and a sole structure 14*g* attached to the upper 12. In view of the substantial similarity in structure and function of the components associated with the article of footwear 10 with respect to the article of footwear 10*g*, like reference numerals are used hereinafter and in the drawings to identify like components while like reference numerals containing letter extensions are used to identify those components that have been modified.

The article of footwear 10*g* is identical to the article of footwear 10 with the exception of the midsole 32*g*, the outsole 34*g*, and the cushioning member 36*g*. Namely, the midsole 32*g* includes a single first cavity 54*g* located in the heel portion 20 of the sole structure 14*g*. The cavity 54*g* receives a barrier member 64 containing particulate matter 66 in an identical fashion as described above with respect to the plurality of first cavities 54 of the sole structure 14.

As with the sole structure 14, providing the sole structure 14*g* with particulate matter 66 disposed within the first cavity 54*g* of the midsole 32*g* provides the midsole 32*g* with increased cushioning at a localized area of the midsole 32*g*. Namely, cushioning is increased in the heel portion 20 at the location of the first cavity 54*g* to provide the heel portion 20 with additional cushioning via the particulate matter 66 disposed within the first cavity 54*g*.

Once the barrier member 64 containing particulate matter 66 is disposed within the first cavity 54*g*, the first barrier member 76 may be attached to the first surface 58*g* of the midsole 32*g* via a suitable adhesive. At this point, the first barrier member 76 may be attached to the lower substrate 38 of the upper 12 and the second surface 60*g* of the midsole 32*g* may be attached to the outsole portions of the outsole 34*g*.

With particular reference to FIGS. 45-48, an article of footwear 10*h* is provided and includes an upper 12 and a sole structure 14*h* attached to the upper 12. In view of the substantial similarity in structure and function of the components associated with the article of footwear 10 with respect to the article of footwear 10*h*, like reference numerals are used hereinafter and in the drawings to identify like components while like reference numerals containing letter extensions are used to identify those components that have been modified.

The article of footwear 10*h* is virtually identical to the article of footwear 10 with the exception of the midsole 32*h*, the outsole 34*h*, and the cushioning member 36*h*. Namely, the midsole 32*h* includes a single first cavity 54*h* formed in the first surface 58*h* of the midsole 32*h*. The first cavity 54*h* is located in the forefoot portion 16 of the sole structure 14*h* and, as such, provides increased cushioning within the forefoot portion 16.

As with the midsole 32 of the sole structure 14, the first cavity 54*h* of the midsole 32*h* receives a barrier member 64 containing particulate matter 66 therein. Once the barrier member 64 and associated particulate matter 66 is disposed within the first cavity 54*h*, the first barrier member 76 may be attached to the first surface 58*h* of the midsole 32*h* via a suitable adhesive. The first barrier member 76 may then be attached to the lower substrate 38 of the upper 12 and the second surface 60*h* of the midsole 32*h* may be attached to the portions of the outsole 34*h*.

With particular reference to FIGS. 49-54, an article of footwear 10*i* is provided and includes an upper 12 and a sole structure 14*i* attached to the upper 12. In view of the substantial similarity in structure and function of the components associated with the article of footwear 10 with respect to the article of footwear 10*i*, like reference numerals are used hereinafter and in the drawings to identify like components while like reference numerals containing letter extensions are used to identify those components that have been modified.

The article of footwear 10*i* is virtually identical to the articles of footwear 10*b*, 10*c* with the exception of the spacing between the first cavities 54*i* and the second cavity 56*i*. For example, the first cavities 54*b* and the second cavity 56*b* of the midsole 32*b* are vertically aligned with one another such that edges of the first cavities 54*b* are aligned with opposite edges of the second cavity 56*b* when the midsole 32*b* is viewed from the top (FIG. 16) or viewed from the bottom (FIG. 17). Conversely, the first cavities 54*c* and the second cavity 56*c* of the midsole 32*c* are spaced apart from one another along a longitudinal axis of the midsole 32*c* by a gap 80 when viewed from a top of the midsole 32*c* (FIG. 22) or from a bottom of the midsole 32*c* (FIG. 23).

Figure 53:
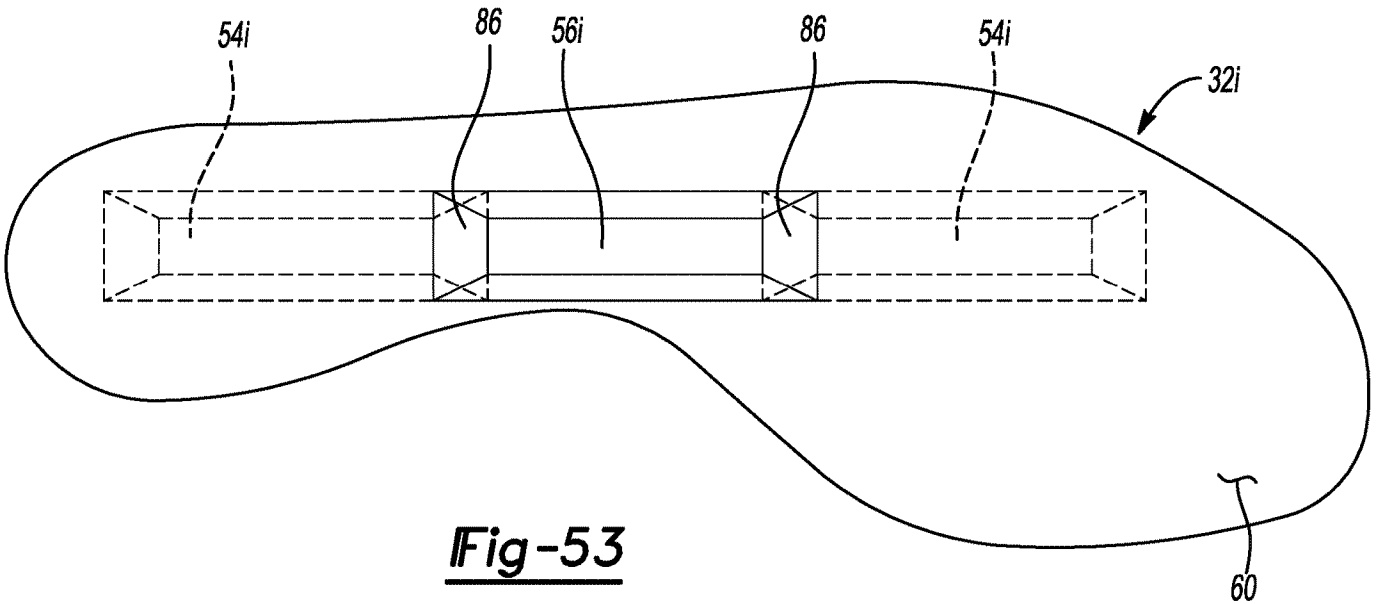
FIG. 53 is a bottom view of the midsole of FIG. 51.
Figure 54:
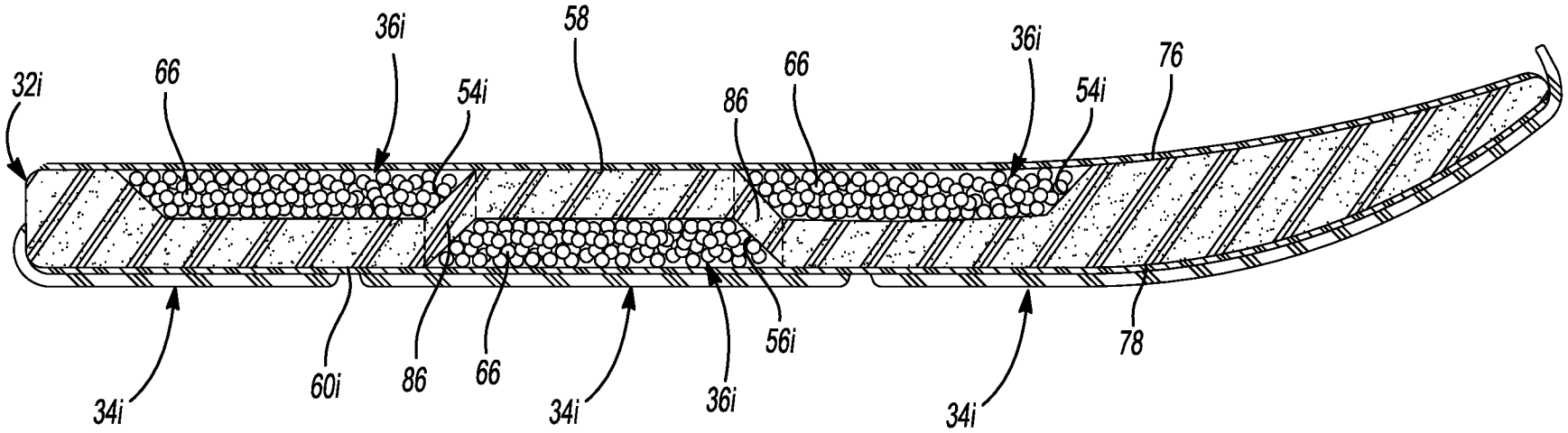
FIG. 54 is a partial cross-sectional view of the article of footwear of FIG. 49 taken along Line 54-54 of FIG. 49.

The first cavities 54*i* and the second cavity 56*i* overlap one another in a direction substantially parallel to a longitudinal access of the midsole 32*i* when the midsole 32*i* is viewed from the top (FIG. 52) or when the midsole 32*i* is viewed from the bottom (FIG. 53). Namely, the first cavities 54*i* overlap opposite ends of the second cavity 56*i* in an overlapped region 86. In so doing, the first cavities 54*i* may be disposed closer to the second cavity 56*i* such that the second cavity 56*i* is nested in closer proximity to the first cavities 54*i* when compared to the midsoles 32*b*, 32*c* of the sole structures 14*b*, 14*c*, respectively. As shown in FIG. 54, while the first cavities 54*i* and the second cavity 56*i* are disposed in closer proximity to one another due to the overlapped region 86, the first cavities 54*i* are spaced apart and separated from the second cavity 56*i* by a material of the midsole 32*i*.

Overlapping the first cavities 54*i* with the second cavity 56*i* provides a different cushioning characteristic to the midsole 32*i* when compared to the midsoles 32*b*, 32*c*. Namely, assuming the first cavity 54*i* and the second cavity

56*i* have the same shape as the cavities 54*b*, 54*c*, 56*b*, 56*c* and, further, that each of the cavities 54*b*, 56*b*, 54*c*, 56*c*, 54*i*, 56*i* receive the same quantity, type, and size of particulate matter 66, providing the cavities 54*i*, 56*i* in an overlapping relationship, as shown in FIG. 54, concentrates the particulate matter 66 closer to the midfoot portion 18 when compared to the midsoles 32*b*, 32*c*. While the cavities 54*i*, 56*i* are shown as including a trapezoidal shape, the cavities 54*i*, 56*i* could alternatively include a circular or oval shape in a similar fashion as cavities 54, 54*a*, 56, 56*a*, whereby an overlapped region is disposed between adjacent circular or oval cavities.

Once the particulate matter 66 is inserted into the cavities 54*i* and the cavity 56*i*, the first barrier member 76 may be attached to the first surface 58*i* and the second barrier member 78 may be attached to the second surface 60*i* via a suitable adhesive. Subsequently, the barrier member 76 may be attached to the lower substrate 38 of the upper 12 and the barrier member 78 may be attached to the portions of the outsole 34*i*.

As with the sole structures 14, 14*a*, 14*b*, 14*c*, 14*d*, 14*e*, 14*f*, 14*g*, providing the sole structure 14*i* with particulate matter 66 enhances the ability of the midsole 32*i* to absorb ground-reaction forces and, thus, provide a degree of comfort to a user during use of the article of footwear 10*i*.

The following Clauses provide an exemplary configuration for an article of footwear described above.

Clause 1: A sole structure for an article of footwear, the sole structure comprising a midsole including a first surface, a second surface formed on an opposite side of the midsole than the first surface, a first cavity formed in the first surface and tapering in a direction from the first surface toward the second surface, and a second cavity formed in the second surface and tapering in a direction from the second surface toward the first surface, a first quantity of particulate matter disposed within the first cavity and a second quantity of particulate matter disposed within the second cavity.

Clause 2: The sole structure of Clause 1, wherein the first cavity and the second cavity include substantially the same shape.

Clause 3: The sole structure of any of the preceding clauses, wherein the first cavity and the second cavity are spaced apart from one another in a direction extending substantially parallel to a longitudinal axis of the midsole.

Clause 4: The sole structure of Clause 1, wherein the first cavity and the second cavity overlap one another in a direction extending substantially parallel to a longitudinal axis of the midsole.

Clause 5: The sole structure of any of the preceding clauses, wherein the first cavity and the second cavity include one of a spherical shape, an oval shape, and a trapezoidal shape.

Clause 6: The sole structure of any of the preceding clauses, wherein the first cavity includes a first passageway in fluid communication with the first cavity and extending from the first cavity to the second surface.

Clause 7: The sole structure of any of the preceding clauses, wherein the second cavity includes a second passageway in fluid communication with the second cavity and extending form the second cavity to the first surface.

Clause 8: The sole structure of Clause 7, wherein the first passageway includes a different shape than the first cavity and the second passageway includes a different shape than the second cavity.

Clause 9: The sole structure of any of the preceding clauses, wherein the first quantity of particulate matter is received by a first barrier member and the second quantity of particulate matter is received by a second barrier member, the first barrier member being disposed between the first quantity of particulate matter and the first cavity and the second barrier member being disposed between the second quantity of particulate matter and the second cavity.

Clause 10: The sole structure of Clause 9, wherein the first barrier member and the second barrier member are formed from a polymer.

Clause 11: The sole structure of Clause 9, wherein the first barrier member and the second barrier member are formed from thermoplastic polyurethane (TPU).

Clause 12: The sole structure of Clause 9, wherein the first barrier member includes a first barrier portion received within the first cavity and the second barrier member includes a first barrier portion received within the second cavity.

Clause 13: The sole structure of Clause 12, wherein the first barrier member includes a second barrier portion attached to the first barrier portion to define a first inner void that receives the first quantity of particulate matter and the second barrier member includes a second barrier portion attached to the first barrier portion of the second barrier member to define a second inner void that receives the second quantity of particulate matter.

Clause 14: The sole structure of Clause 13, wherein the second barrier portion of the first barrier member and the second barrier portion of the second barrier member are formed from the same material as the first barrier portion of the first barrier member and the first barrier portion of the second barrier member.

Clause 15: The sole structure of Clause 13, wherein the second barrier portion of the first barrier member and the second barrier portion of the second barrier member are formed from a different material than the first barrier portion of the first barrier member and the first barrier portion of the second barrier member.

Clause 16: The sole structure of Clause 1, wherein the first quantity of particulate matter and the second quantity of particulate matter are approximately the same.

Clause 17: The sole structure of Clause 1, wherein the first quantity of particulate matter and the second quantity of particulate matter are different.

Clause 18: The sole structure of any of the preceding clauses, wherein at least one of the first quantity of particulate matter and the second quantity of particulate matter includes foam beads.

Clause 19: The sole structure of Clause 18, wherein the foam beads include a substantially spherical shape.

Clause 20: The sole structure of Clause 18, wherein the foam beads include approximately the same size and shape.

Clause 21: The sole structure of Clause 18, wherein the foam beads include at least one of a different size and shape.

Clause 22: A sole structure for an article of footwear, the sole structure comprising a midsole including a first surface, a second surface formed on an opposite side of the midsole than the first surface, a first cavity formed in the first surface and including a first shape, and a second cavity formed in the second surface and including the first shape, the second cavity being inverted relative to the first cavity, a first quantity of particulate matter disposed within the first cavity and a second quantity of particulate matter disposed within the second cavity.

Clause 23: The sole structure of Clause 22, wherein the first cavity tapers in a direction from the first surface toward the second surface and the second cavity tapers in a direction from the second surface toward the first surface.

Clause 24: The sole structure of any of the preceding clauses, wherein the first cavity and the second cavity are spaced apart from one another in a direction extending substantially parallel to a longitudinal axis of the midsole.

Clause 25: The sole structure of Clause 22, wherein the first cavity and the second cavity overlap one another in a direction extending substantially parallel to a longitudinal axis of the midsole.

Clause 26: The sole structure of any of the preceding clauses, wherein the first cavity and the second cavity include one of a spherical shape, an oval shape, and a trapezoidal shape.

Clause 27: The sole structure of any of the preceding clauses, wherein the first cavity includes a first passageway in fluid communication with the first cavity and extending from the first cavity to the second surface.

Clause 28: The sole structure of any of the preceding clauses, wherein the second cavity includes a second passageway in fluid communication with the second cavity and extending form the second cavity to the first surface.

Clause 29: The sole structure of Clause 28, wherein the first passageway includes a different shape than the first cavity and the second passageway includes a different shape than the second cavity.

Clause 30: The sole structure of any of the preceding clauses, wherein the first quantity of particulate matter is received by a first barrier member and the second quantity of particulate matter is received by a second barrier member, the first barrier member being disposed between the first quantity of particulate matter and the first cavity and the second barrier member being disposed between the second quantity of particulate matter and the second cavity.

Clause 31: The sole structure of Clause 30, wherein the first barrier member and the second barrier member are formed from a polymer.

Clause 32: The sole structure of Clause 30, wherein the first barrier member and the second barrier member are formed from thermoplastic polyurethane (TPU).

Clause 33: The sole structure of Clause 30, wherein the first barrier member includes a first barrier portion received within the first cavity and the second barrier member includes a first barrier portion received within the second cavity.

Clause 34: The sole structure of Clause 33, wherein the first barrier member includes a second barrier portion attached to the first barrier portion to define a first inner void that receives the first quantity of particulate matter and the second barrier member includes a second barrier portion attached to the first barrier portion of the second barrier member to define a second inner void that receives the second quantity of particulate matter.

Clause 35: The sole structure of Clause 34, wherein the second barrier portion of the first barrier member and the second barrier portion of the second barrier member are formed from the same material as the first barrier portion of the first barrier member and the first barrier portion of the second barrier member.

Clause 36: The sole structure of Clause 34, wherein the second barrier portion of the first barrier member and the second barrier portion of the second barrier member are formed from a different material than the first barrier portion of the first barrier member and the first barrier portion of the second barrier member.

Clause 37: The sole structure of Clause 22, wherein the first quantity of particulate matter and the second quantity of particulate matter are approximately the same.

Clause 38: The sole structure of Clause 22, wherein the first quantity of particulate matter and the second quantity of particulate matter are different.

Clause 39: The sole structure of any of the preceding clauses, wherein at least one of the first quantity of particulate matter and the second quantity of particulate matter includes foam beads.

Clause 40: The sole structure of Clause 39, wherein the foam beads include a substantially spherical shape.

Clause 41: The sole structure of Clause 39, wherein the foam beads include approximately the same size and shape.

Clause 42: The sole structure of Clause 39, wherein the foam beads include at least one of a different size and shape.

Clause 43: A sole structure for an article of footwear, the sole structure comprising a midsole including a first surface, a second surface formed on an opposite side of the midsole than the first surface, a plurality of first cavities formed in the first surface, and a plurality of second cavities formed in the second surface, the plurality of second cavities alternating with the plurality of first cavities along a length of the midsole, a first quantity of particulate matter disposed within the first cavity and a second quantity of particulate matter disposed within the second cavity.

Clause 44: The sole structure of Clause 43, wherein the plurality of first cavities include a first shape and the plurality of second cavities include the first shape, the plurality of second cavities being inverted relative to the plurality of first cavities.

Clause 45: The sole structure of Clause 43, wherein the plurality of first cavities taper in a direction from the first surface toward the second surface and the plurality of second cavities taper in a direction from the second surface toward the first surface.

Clause 46: The sole structure of any of the preceding clauses, wherein the plurality of first cavities and the plurality of second cavities are spaced apart from one another in a direction extending substantially parallel to a longitudinal axis of the midsole.

Clause 47: The sole structure of Clause 43, wherein the plurality of first cavities and the plurality of second cavities overlap one another in a direction extending substantially parallel to a longitudinal axis of the midsole.

Clause 48: The sole structure of any of the preceding clauses, wherein the plurality of first cavities and the plurality of second cavities include one of a spherical shape, an oval shape, and a trapezoidal shape.

Clause 49: The sole structure of any of the preceding clauses, further comprising first passageways in fluid communication with respective ones of the plurality of first cavities and extending from the respective first cavity to the second surface.

Clause 50: The sole structure of any of the preceding clauses, further comprising second passageways in fluid communication with respective ones of the plurality of second cavities and extending from the respective second cavity to the first surface.

Clause 51: The sole structure of Clause 50, wherein the first passageway includes a different shape than the plurality of first cavities and the second passageway includes a different shape than the plurality of second cavities.

Clause 52: The sole structure of any of the preceding clauses, wherein the first quantity of particulate matter is received by first barrier members and the second quantity of particulate matter is received by second barrier members, the first barrier members being disposed between the first quantity of particulate matter and respective ones of the plurality of first cavities and the second barrier members being disposed between the second quantity of particulate matter and respective ones of the plurality of second cavities.

Clause 53: The sole structure of Clause 52, wherein the first barrier members and the second barrier members are formed from a polymer.

Clause 54: The sole structure of Clause 52, wherein the first barrier members and the second barrier members are formed from thermoplastic polyurethane (TPU).

Clause 55: The sole structure of Clause 52, wherein the first barrier members include a first barrier portion received within respective ones of the plurality of first cavities and the second barrier members include a first barrier portion received within respective ones of the plurality of second cavities.

Clause 56: The sole structure of Clause 55, wherein the first barrier members include a second barrier portion attached to the first barrier portion to define a first inner void that receives the first quantity of particulate matter and the second barrier members include a second barrier portion attached to the first barrier portion of the second barrier members to define a second inner void that receives the second quantity of particulate matter.

Clause 57: The sole structure of Clause 56, wherein the second barrier portion of the first barrier members and the second barrier portion of the second barrier members are formed from the same material as the first barrier portion of the first barrier members and the first barrier portion of the second barrier members.

Clause 58: The sole structure of Clause 56, wherein the second barrier portion of the first barrier members and the second barrier portion of the second barrier members are formed from a different material than the first barrier portion of the first barrier members and the first barrier portion of the second barrier members.

Clause 59: The sole structure of Clause 43, wherein the first quantity of particulate matter and the second quantity of particulate matter are approximately the same.

Clause 60: The sole structure of Clause 43, wherein the first quantity of particulate matter and the second quantity of particulate matter are different.

Clause 61: The sole structure of any of the preceding clauses, wherein at least one of the first quantity of particulate matter and the second quantity of particulate matter includes foam beads.

Clause 62: The sole structure of Clause 61, wherein the foam beads include a substantially spherical shape.

Clause 63: The sole structure of Clause 61, wherein the foam beads include approximately the same size and shape.

Clause 64: The sole structure of Clause 61, wherein the foam beads include at least one of a different size and shape.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a midsole including a first surface, a second surface formed on an opposite side of the midsole than the first surface, a first cavity formed in the first surface and tapering in a direction from the first surface toward the second surface, and a second cavity formed in the second surface and tapering in a direction from the second surface toward the first surface;

a first cushioning member formed from a first barrier member and a second barrier member joined together to define a first inner void, the first cushioning member received within the first cavity;

a second cushioning member formed from a third barrier member and a fourth barrier member joined together to define a second inner void, the second cushioning member received within the second cavity;

a first quantity of particulate matter disposed within the first inner void; and a second quantity of particulate matter disposed within the second inner void.

2. The sole structure of claim 1, wherein the first cavity and the second cavity include substantially the same shape.

3. The sole structure of claim 1, wherein the first cavity and the second cavity are spaced apart from one another in a direction extending substantially parallel to a longitudinal axis of the midsole.

4. The sole structure of claim 1, wherein the first cavity and the second cavity overlap one another in a direction extending substantially parallel to a longitudinal axis of the midsole.

5. The sole structure of claim 1, wherein the first cavity and the second cavity include one of the shapes selected from a group consisting of a semi-spherical shape, an oval shape, and a trapezoidal shape.

6. The sole structure of claim 1, wherein the first cavity includes a first passageway in fluid communication with the first cavity and extending from the first cavity to the second surface.

7. The sole structure of claim 6, wherein the second cavity includes a second passageway in fluid communication with the second cavity and extending from the second cavity to the first surface.

8. The sole structure of claim 7, wherein the first passageway includes a different shape than the first cavity and the second passageway includes a different shape than the second cavity.

9. The sole structure of claim 1, wherein at least one of the first quantity of particulate matter and the second quantity of particulate matter includes foam beads.

10. A sole structure for an article of footwear, the sole structure comprising:

a midsole including a first surface, a second surface formed on an opposite side of the midsole than the first surface, a first cavity formed in the first surface and including a first shape, and a second cavity formed in the second surface and including the first shape, the second cavity being inverted relative to the first cavity;

a first cushioning member formed from a first barrier member and a second barrier member joined together to define a first inner void, the first cushioning member received within the first cavity;

a second cushioning member formed from a third barrier member and a fourth barrier member joined together to define a second inner void, the second cushioning member received within the second cavity;

a first quantity of particulate matter disposed within the first inner void; and a second quantity of particulate matter disposed within the second inner void.

11. The sole structure of claim 10, wherein the first cavity tapers in a direction from the first surface toward the second surface and the second cavity tapers in a direction from the second surface toward the first surface.

12. The sole structure of claim 10, wherein the first cavity and the second cavity are spaced apart from one another in a direction extending substantially parallel to a longitudinal axis of the midsole.

13. The sole structure of claim 10, wherein the first cavity and the second cavity overlap one another in a direction extending substantially parallel to a longitudinal axis of the midsole.

14. The sole structure of claim 10, wherein the first cavity and the second cavity include one of the shapes selected from a group consisting of a semi-spherical shape, an oval shape, and a trapezoidal shape.

15. The sole structure of claim 10, wherein the first cavity includes a first passageway in fluid communication with the first cavity and extending from the first cavity to the second surface.

16. The sole structure of claim 15, wherein the second cavity includes a second passageway in fluid communication with the second cavity and extending from the second cavity to the first surface.

17. The sole structure of claim 16, wherein the first passageway includes a different shape than the first cavity and the second passageway includes a different shape than the second cavity.

18. The sole structure of claim 10, wherein at least one of the first quantity of particulate matter and the second quantity of particulate matter includes foam beads.

* * * * *